United States Patent [19]

Rowe et al.

[11] Patent Number: 4,753,430

[45] Date of Patent: Jun. 28, 1988

[54] METHOD AND APPARATUS FOR CONTROLLING A COLLATOR

[75] Inventors: Thomas A. Rowe, North Ridgeville; Andrew D. Bruce, Troy, both of Ohio; Stephen M. Ent, New Britain, Conn.

[73] Assignee: AM International Incorporated, Chicago, Ill.

[21] Appl. No.: 56,557

[22] Filed: May 29, 1987

[51] Int. Cl.[4] ..... B65H 39/02

[52] U.S. Cl. ..... 270/58; 271/259; 364/470

[58] Field of Search ..... 270/54–58, 270/53; 364/470, 471, 478; 271/259, 9; 355/3 SH, 14 SH

[56] References Cited

U.S. PATENT DOCUMENTS

| | | | |
|---|---|---|---|
| 3,519,264 | 7/1970 | Beacham et al. . | |
| 3,525,516 | 8/1970 | Bushnell et al. . | |
| 3,578,310 | 5/1971 | Carson, Jr. . | |
| 3,593,065 | 7/1971 | Domalski et al. . | |
| 3,684,890 | 8/1972 | Hayne et al. . | |
| 3,702,187 | 11/1972 | Hageman et al. . | |
| 3,815,895 | 6/1974 | Dufour . | |
| 3,825,247 | 7/1974 | Fernandez-Rana et al. . | |
| 3,924,846 | 12/1975 | Reed . | |
| 4,211,483 | 7/1980 | Hannigan | 355/35 SH X |
| 4,317,203 | 2/1982 | Botte et al. | 270/58 X |
| 4,439,865 | 3/1984 | Kikuchi et al. | 355/14 SH X |
| 4,484,733 | 11/1984 | Loos et al. | 270/54 |
| 4,544,146 | 10/1985 | Zemke et al. | 270/58 |
| 4,547,846 | 10/1985 | Gottlieb | 364/478 X |
| 4,566,681 | 1/1986 | Bottcher et al. | 270/58 |
| 4,603,629 | 8/1986 | Pou | 270/58 |
| 4,625,954 | 12/1986 | Pusey | 271/9 |
| 4,639,873 | 1/1987 | Baggarly | 364/478 X |

*Primary Examiner*—Eugene H. Eickholt

*Attorney, Agent, or Firm*—Tarolli, Sundheim & Covell

[57] ABSTRACT

A method and apparatus are disclosed for controlling a collator. A microcomputer learns hopper insertion points, jam switch insertion points, and hopper miss and double feed service angles relative to a reject gate. Based on the learn collator configuration, the controller controls collator operation. When a hopper phase adjustment is made by an operator, the controller automatically re-learns the hopper service angles during a ripple start of the collator and adjusts its reject data in response thereto. A miss verify sensor arrangement permits the controller to monitor for phase adjustments after a ripple start and to warn the operator upon such occurence.

15 Claims, 10 Drawing Sheets

METHOD AND APPARATUS FOR CONTROLLING A COLLATOR

TECHNICAL BACKGROUND

The present invention relates to collating machines and is particularly directed to a method and apparatus for controlling a collator.

BACKGROUND ART

The use of collators or gathering devices for assembling a plurality of different signatures into assemblages, such as magazines or books, is well known in the art. Electronic controllers for collators are also known in the art. One example of an electronically controlled collator is described in U.S. Pat. No. 3,924,846 to Reed.

The Reed '846 patent describes a collator having a plurality of hoppers, each of which feed different signatures to a passing conveyor to form assemblages. The collator includes a plurality of raceway jam detection switches. The switches are mounted at spaced apart locations along the path of the conveyor, one switch located between alternate hoppers. When a jam occurs, i.e., a signature incorrectly positioned on the conveyor, the signature causing the jam trips a jam detection switch. The electronic controller detects the jam switch trip and tracks the progress of the conveyor feed location where the jam occurred. The electronic controller not only rejects the assemblage at the feed location where the jam occurred, but also rejects one or more assemblages in feed locations upstream and/or downstream from the feed location where the jam occurred in accordance with a preselected reject pattern. Also, the electronic controller of the Reed '846 patent inhibits downstream hoppers from feeding signatures into feed locations which are to be rejected in accordance with the preselected reject pattern.

The collator disclosed in the '846 patent also includes means for detecting a hopper feed malfunction. The detector senses when a signature has not been fed by a hopper and also senses when more than one signature has simultaneously been fed from a hopper. Such feed malfunctions are known in the art as a miss or a double feed, respectively.

The physical configuration of the collator can be changed by the operator depending upon the type of assemblage being made. The operator can change the physical location of the hoppers, location of the jam switches, phasing of any one of the hoppers thereby effecting a change in the hopper insertion point, and change the location of the reject gate. When such changes in the physical configuration of the collator have occurred in the past, the configuration of the electronic controller had to also be changed. Also, nonintended physical changes occur in the collator's configuration over time that can result in control problems. One example is conveyor chain stretch. Mechanical rephasing of hopper drums to compensate for chain stretch can change a hopper's insertion point. A change in a hopper's insertion point without a change in the electronic controller would result in a good assemblage being rejected when a feed malfunction occurs and an improper assemblage being passed for further processing.

It has been found desirable to provide a method and apparatus for controlling a collator that is readily adaptable to changes in the physical configuration of the collator.

BRIEF SUMMARY OF THE INVENTION

The present invention provides a new and improved method and apparatus for controlling a collator. In particular, the present invention provides a method and apparatus for teaching an electronic controller the physical configuration of a collator during an initial collator make-ready routine including hopper inserting points, hopper service angles, and jam switch insertion points. The collator is controlled by the electronic controller based on the learned data. The invention further provides a method and apparatus for teaching the electronic controller, after initial set up, changes in the collator's physical configuration automatically during a ripple start of the collator.

The collator includes a plurality of hoppers that feed signatures to feed locations on a conveyor to form assemblages. Each of the hoppers has a rotatable drum for transporting signatures from an associated first location to feed locations on the conveyor. The apparatus, in accordance with the present invention, comprises drive means operatively connected to the hoppers and to the conveyor for driving the hopper drum of each hopper in rotation and for moving the conveyor. Means is provided for generating a plurality of coded electrical signals during operation of the drive means. Each coded electrical signal is indicative of a finite distance the conveyor has been moved by the drive means. A collator machine cycle is defined as an amount of conveyor movement necessary to displace a feed location on the conveyor downstream of one complete feed location distance. The means for generating the plurality of coded electrical signals is reset once each machine cycle. The apparatus further includes first sensing means for sensing an improper signature feed from a hopper and for generating an electrical signal indicative thereof. Means is provided downstream of the hoppers for rejecting a signature assemblage in response to a reject signal. Second sensing means, located a predetermined distance from the reject means, generates an electrical signal indicative of a signature being present at the location of the second sensing means. Means is provided for feeding a single signature from one of the hoppers to a feed location on the conveyor. Counting means counts the number of complete machine cycles needed to move the feed location containing the single fed signature to the location of the second sensing means. Means, responsive to the counting means, determines the distance, in machine cycle counts, between the feed location which received the single signature fed from the feeding hopper and the location of the rejecting means. Storing means, responsive to the determining means, stores the determined distance for each of the hoppers. The apparatus further includes control means for, upon the occurrence of a signal from the first sensing means indicative of an improper signature feed from a hopper, recalling from the storing means the stored distance that the hopper having the sensed improper signature feed is from the rejecting means, counting the number of present machine cycles that occur after the improper signature feed was sensed by the first sensing means, and generating the reject signal to the rejecting means when the present machine cycle count is equal to the recalled distance.

In accordance with another aspect of the present invention, the apparatus for controlling a collator comprises drive means operatively connected to the hoppers and to the conveyor for driving the hopper drum of each hopper in rotation and for moving the conveyor. Coded signal generating means is provided for generating a plurality of coded electrical signals during operation of the drive means. Each coded signal is indicative of a finite distance the conveyor is moved by the drive means. A machine cycle is defined as an amount of conveyor movement necessary to displace a feed location on the conveyor downstream one complete feed location distance. The coded signal generating means is reset once each machine cycle. A plurality of drum angle sensing means is provided, each hopper having an associated drum angle sensing means, for generating an electrical signal when its associated drum is at a predetermined rotational angle. A plurality of first storing means, each hopper having an associated first storing means, stores the signal from the coded signal generating means when its associated drum angle sensing means generates an electrical signal indicative of its associated drum being at its predetermined rotational angle. Signature feed sensing means senses an improper signature feed from a hopper and generates an electrical signal indicative thereof. Means, located downstream of the hoppers, is provided for rejecting a signature assemblage in response to a reject signal. Means determines the distance, in machine cycle counts, between the feed location which first received the single signature fed from the feeding hopper and the location of the rejecting means. Second storing means is provided responsive to the determining means for storing the determined distance for each of the hoppers. Means is provided for subsequently monitoring the coded signal generated by the coded signal generating means for each hopper when its associated drum is at its predetermined rotational angle. Means is provided for comparing the coded signal for each hopper stored in the first storing means with the subsequently monitored coded signal for such hopper. The apparatus further includes control means for, upon the occurrence of a signal from the signature feed sensing means indicative of an improper signature feed from a hopper, recalling from the second storing means the stored distance that such hopper having the improper signature feed is from the rejecting means, correcting the recalled distance if the subsequently monitored coded signal varies from the coded signal stored in its associated first storing means by greater than a predetermined amount, counting the number of machine cycles that occur after the improper signature feed is sensed, and generating the reject signal for the rejecting means when (i) the counted number of complete machine cycles is equal to the recalled distance if no correction was made and (ii) the counted number of completed machine cycles is equal to the corrected distance if a correction was made.

The collator conveyor includes a plurality of spaced apart pins, spaced in a direction of raceway travel, the space between the pins defining the signature feed locations. In accordance with another aspect of the present invention, a plurality of jam detection switches are provided, each of the jam switches being located between hoppers and adapted to detect a fed signature overlying a pin and to generate an electrical signal indicative thereof. The apparatus further includes means for aligning a pin under each of the jam switches separately, means for placing a signature downstream of an aligned pin, means for tripping the jam switch, means for moving the conveyor toward the reject means, means for counting the number of machine cycles that occur when the signature is moved to the second sensing means, and means for determining the distance between the jam switch location and the reject gate.

A method for controlling a collator in accordance with the present invention comprises the steps of driving the hopper drum of each hopper in rotation, moving the conveyor, and generating a plurality of coded signals during driving of the hopper drum, each coded signal being indicative of a finite distance the conveyor is moved by the drive means, a machine cycle being an amount of conveyor movement necessary to displace a feed location on the conveyor downstream one complete feed location distance. The method further includes the steps of resetting the generated coded electrical signal once each machine cycle, sensing an improper signature feed from a hopper, and generating an electrical signal indicative thereof. A signature assemblage is rejected in response to a reject signal at a rejecting location On the conveyor. An electrical signal is generated indicative of a signature being present at a sensing location a predetermined distance from the rejecting location. The method further comprises the step of feeding a single signature from one of the hoppers to a feed location on the conveyor, counting the number of complete machine cycles needed to move the feed location receiving the single fed signature to the sensing location, determining the distance, in machine cycle counts, between the feed location in which the single signature was fed from the feeding hopper and the location where the signatures are rejected, and storing the determined distance, in machine cycle counts, for each of the hoppers. Upon the occurrence of a signal indicative of an improper signature fed from a hopper, the method recalls the stored machine cycle count for the hopper having the improper signature feed, counts the numer of machine cycles that occur after the improper signature feed was sensed, and generates the reject signal when present machine cycle count is equal to the recalled distance in machine cycle counts.

A method for controlling a collator, in accordance with another aspect of the present invention, comprises the steps of driving the hopper drum of each hopper in rotation, moving the conveyor, and generating a pluality of coded electrical signals during said driving, each coded signal being indicative of a finite distance the conveyor is moved, a machine cycle being an amount of conveyor movement necessary to displace a feed location on the conveyor downstream one complete feed location distance. The method further includes the steps of resetting said coded signal once each machine cycle, generating an electrical signal for each hopper when its associated drum is at predetermined rotational angle, storing in a first storing means the electrical signal which is generated indicative of its associated drum being at its predetermined rotational angle, sensing an improper signature feed from a hopper and generating an electrical signal indicative thereof, and rejecting a signature assemblage at a reject location in response to a reject signal. Determining for each hopper the distance, in machine cycle counts, between the associated feed location where a signature is fed from the associated feeding hopper when such hopper is in its initially phased condition and the reject location. The method further includes storing in a second storing means the determined distance, in machine cycle counts, for each of the hoppers, subsequently monitoring the coded electrical signal for each hopper when such hopper drum is at its predetermined rotational angle, comparing the coded electrical signal for each hopper stored in the first storing means with the coded electrical signal for such hopper subsequently monitored. The method further includes the step of, upon the occurrence of a signal indicative of an improper signature feed, recalling the stored distance in machine cycle counts for the hopper having the improper signature feed is from the reject location, correcting the recalled distance if the subsequently monitored coded electrical signal varies from the stored coded signal for such hoppers by greater than a predetermined amount, counting the number of machine cycles that occur after the improper signature feed is sensed, and generating the reject signal when (i) the counted number of complete machine cycles is equal to the recalled distance in machine cycle counts if no correction is made and (ii) the counted number of complete machine cycles is equal to the corrected distance if a correction was made.

A method for controlling a collator in accordance with yet another aspect of the present invention includes the steps of driving the hoppers, moving the conveyor, and generating a plurality of coded electrical signals during operation of said drive means, each coded signal being indicative of a finite distance the conveyor is moved by the drive means, a machine cycle being an amount of conveyor movement necessary to displace a feed location on the conveyor downstream one complete feed location distance, the coded signal generating means being reset once each machine cycle. The method further includes the steps of rejecting a signature assemblage in response to a reject signal at a location downstream of the hoppers, and generating an electrical signal indicative of a signature being present at the location of the second sensing means. A plurality of jam detection switches are provided, each of the jam switches being located between hoppers and adapted to detect a fed signature overlying a pin and to generate an electrical signal indicative thereof. The method further includes the steps of aligning a pin under each of the jam switches separately, placing a signature downstream of an aligned pin, tripping the jam switch, moving the conveyor toward the reject means, counting the number of machine cycles that occur when the signature is moved to the second sensing means, and determining the distance between the jam switch location and the rejecting location.

BRIEF DESCRIPTION OF THE DRAWINGS

Other objects and features of the invention will become apparent to those skilled in the art upon reading and understanding the detailed description taken in conjunction with the accompanying drawings wherein.

DESCRIPTION OF A PREFERRED EMBODIMENT

Figure 1:
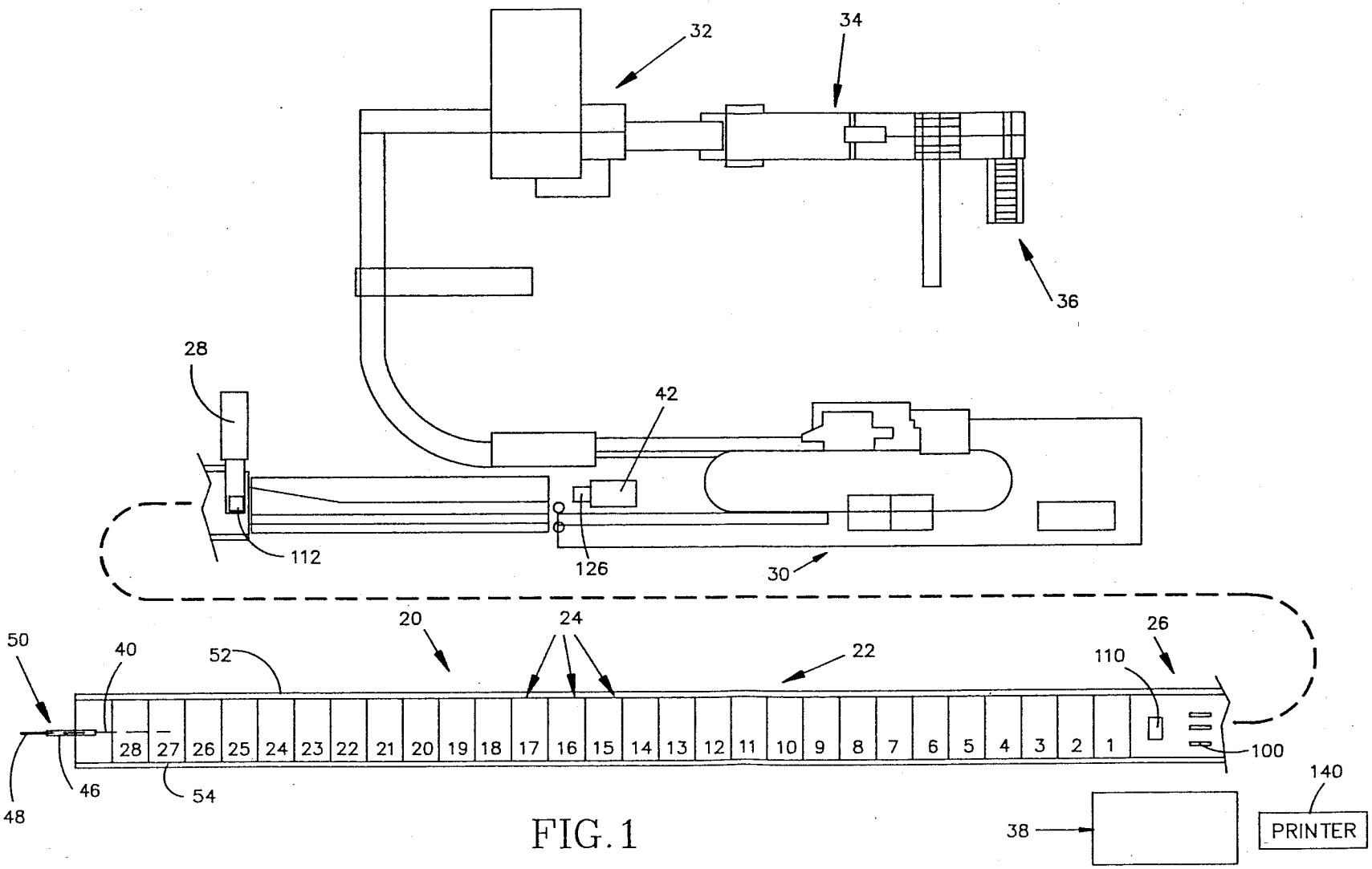
FIG. 1 is a top plan view of a collator/binder system.

Referring to FIG. 1, a collator/bindery system 20 includes a collator section 22 which includes a plurality of hoppers 24 aligned in a linear array. The system 20 further includes a reject station 26 which is used to divert undesired signature assemblages to a reject conveyor 28. The reject conveyor 28 carries rejected signature assemblages away for further handling.

Assembled signatures are glued at a binder station 30 and are trimmed in a trimmer station 32. Mail labels are attached to the assembled signatures at a mail station 34. The assembled signatures are stacked in a stacker 36 for further handling. A control console 38, located adjacent the system 20 and preferably near the reject station 20, electrically controls the operation of the system 20.

Figure 2:
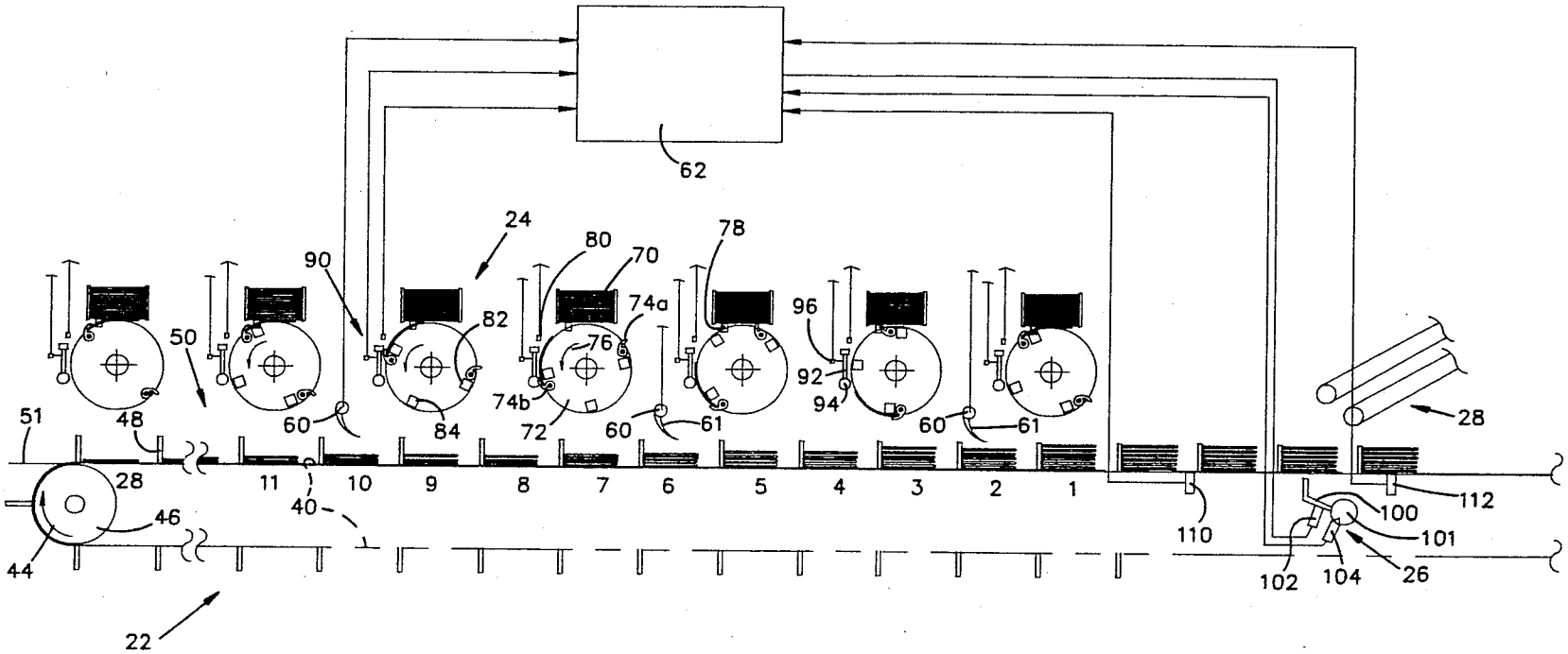
FIG. 2 is a side elevational view schematically depicting the collator shown in FIG. 1.

Referring to FIGS. 1 and 2, a chain 40 is positioned below the hoppers 24 and is driven by a drive motor 42 so that the chain 40 moves in a direction indicated by the arrow 44 on the idler wheel 46.

Chain 40 carries a plurality of spaced apart chain pins 48 which define a plurality of signature feed locations and are used to move the signatures along a raceway 50. The raceway 50 has a bottom wall 51 and spaced apart side walls 52, 54 that run the length of the collator section 22. The side walls 52, 54 are of sufficient height to retain the signatures in the raceway 50. The bottom wall 51 has a centrally located slot to accommodate travel of the chain 40 and pins 48.

Jam detection switches 60 are mounted at spaced apart locations along the raceway 50 and are preferably located between every other hopper 24 within the collator section 22. Each of the jam detection switches 60 are electrically connected to a controller 62 located within the control console 38. Such jam detection switches are well known in the art and are, therefore, not described in detail herein.

Basically, a jam detection switch 60 is a lightly, spring-biased, electrical switch having an actuation lever 61 extending downward toward the signatures in the raceway 50. The end of the actuation lever 61 is approximately at the same elevation as the top of the chain pins 48. When the actuating lever 61 of a jam detector switch 60 encounters a signature that has been incorrectly fed down to raceway 50, e.g., overlying the top of one of the chain pins 48, its associated switch contacts close. When the switch contacts close, the jam switch is said to be actuated. The controller 62 monitors each of the jam switches 60 and detects the occurrence of switch contact closure, i.e., the occurrence of a signature jam.

Each of the hoppers 24 are similarly constructed. Therefore, only one hopper is described in detail. The hopper 24 includes a bin 70 for storing a plurality of signatures. Each of the hoppers typically includes signatures which are different from the signatures of the other hoppers in the collator section 22. A feeder drum 72 is disposed below the bin 70. Fingers 74 are operatively secured to the drum 72 and are disposed near the outer surface of the drum. For purposes of explanation only, the feeder drum 72 has two fingers **74*a*, 74*b*** located diagonally opposite from each other on the drum. Those skilled in the art will appreciate that a feeder drum having three spaced apart fingers or any other combination can be used.

A suction device 78 is located at the bottom of the bin 70. The feeder drum 72 is driven in rotation by the main drive motor 42 in a known manner. As the feeder drum 72 rotates in a direction indicated by arrow 76, the suction device moves upward to pull a single signature downward. A separator dish, not shown, retains the other signatures in the bin. As the drum 72 continues to rotate, the fingers 74 close and grab the pulled down signature. The fingers 74 secure the signature to a block 77 and pull the signature from the bin 70. One such hopper arrangement is fully disclosed in U.S. Pat. No. 3,702,187 to Hageman et al., which is hereby fully incorporated herein by reference. As the feeder drum 72 continues to rotate, the signature is retained against the drum's outer surface and is fed toward the moving chain 40. After sufficient rotation, the fingers 74 open and the signature drops into a feed location on the moving chain 40. Such a signature feed arrangement is fully disclosed in U.S. Pat. No. 3,825,247 to Fernandez-Rana et al., which is hereby fully incorporated herein by reference.

Figure 3:
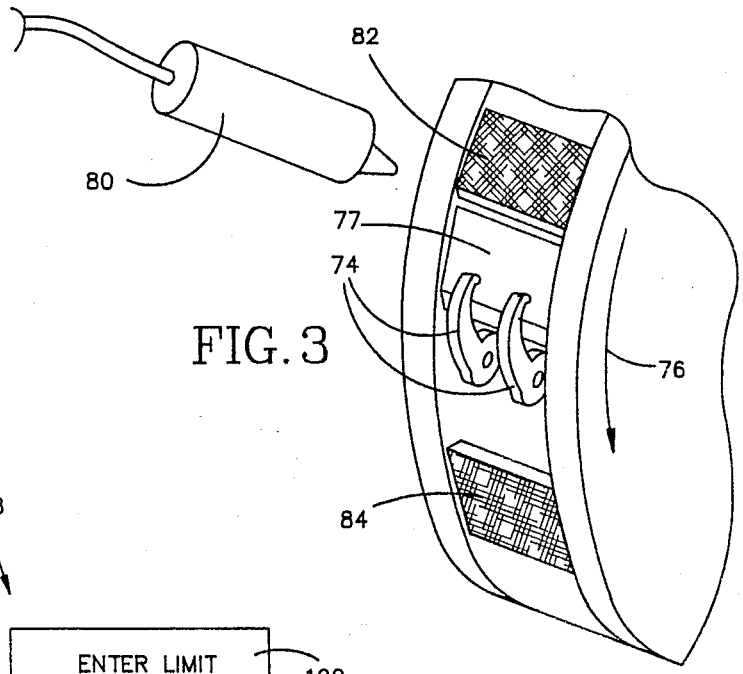
FIG. 3 is an enlarged view of a portion of a hopper drum, some parts of which have been removed for clarity.

An optical sensor switch 80 is used to detect whether or not the fingers 74 have grabbed a signature as the fingers revolve past the bin 70. Referring to FIG. 3, the optical sensor switch 80 shines a beam of light down onto the feeder drum 72. A miss reflector 82 is located on the downstream side of associated fingers 74. The reflector 82 is a corner cube-type that passes a reversed polarized light back to the sensor 80. When the fingers 74 grap a signature from the bin 70, the signature is retained against the drum's outer surface and covers the miss reflector 82.

The optical sensor switch 80 is electrically connected to the controller 62 and is in one electrical state when the light is refelected from a reflector, i.e., the reflector is not covered, and a second electrical state when no reflection is received, i.e., the reflector is covered. If the fingers fail to grap a signature from the bin 70, the optical sensor 80 will receive a reflection from the miss reflector 82. The controller 62 monitors the sensor 80 and is thereby "informed" of whether a signature feed miss has occurred.

A miss verifying reflector 84 is secured to the feed drum 72 at a location relative to the fingers so as to ensure that it is not covered when a maximum size signature is fed by the hopper. The miss verify reflector is also a corner cube-type reflector that passes a reversed polarized light back to the sensor 80. Once each revolution of a feed drum 72, the sensor switch 80 detects a reflection from the miss verify reflector which is, in turn, detected by the controller 62.

Referring to FIG. 2, each hopper has an associated caliber switch assembly 90 mounted adjacent to its drum 72. The caliber switch assembly includes an arm 92 and wheel 94 that is spring biased against the feeder drum 72. A switch 96 contacts the arm 92 and is electrically connected to the controller 62. The caliber assembly 90 monitors the thickness of a signature held to the feeder drum 72 during a signature feed operation as the drum 72 rotates therepast. If more than one signature is being fed from the bin 70, the thickness of the signatures cause the arm 92 to move an amount sufficient to close the contacts of switch 96. The controller 62 monitors the condition of switch 96.

The reject station 26 includes a reject arm 100 that is drivable upward through a mechanically driven cam 101 connected to the system main drive. An electrically actuatable hold down device 102 is electrically connected to the controller 62. When it is desired to reject an assemblage, the controller 62 outputs an electrical signal to the actuator 102 to release the arm 100 thereby permitting the arm to move upward, forcing the assemblage into a takeway conveyor 28. A sensor 104 is mounted adjacent to the cam 101 and is electrically connected to the controller 62. The sensor generates an electrical signal indicative of the rotary position of the cam 101.

A learn eye 110 is located on the upstream side of the reject station 26. A book eye 112 is located on the downstream side of the reject station 26. The learn eye 110 and the book eye 112 can be either optical sensors or proximity sensors. The learn eye 110 and book eye 112 each generate one electrical signal when a signature assemblage is at their respective locations, and a second electrical signal in the absence of a signature assemblage at their respective locations. The learn eye 110 and the book eye 112 are electrically connected to the controller 62.

Figure 4:
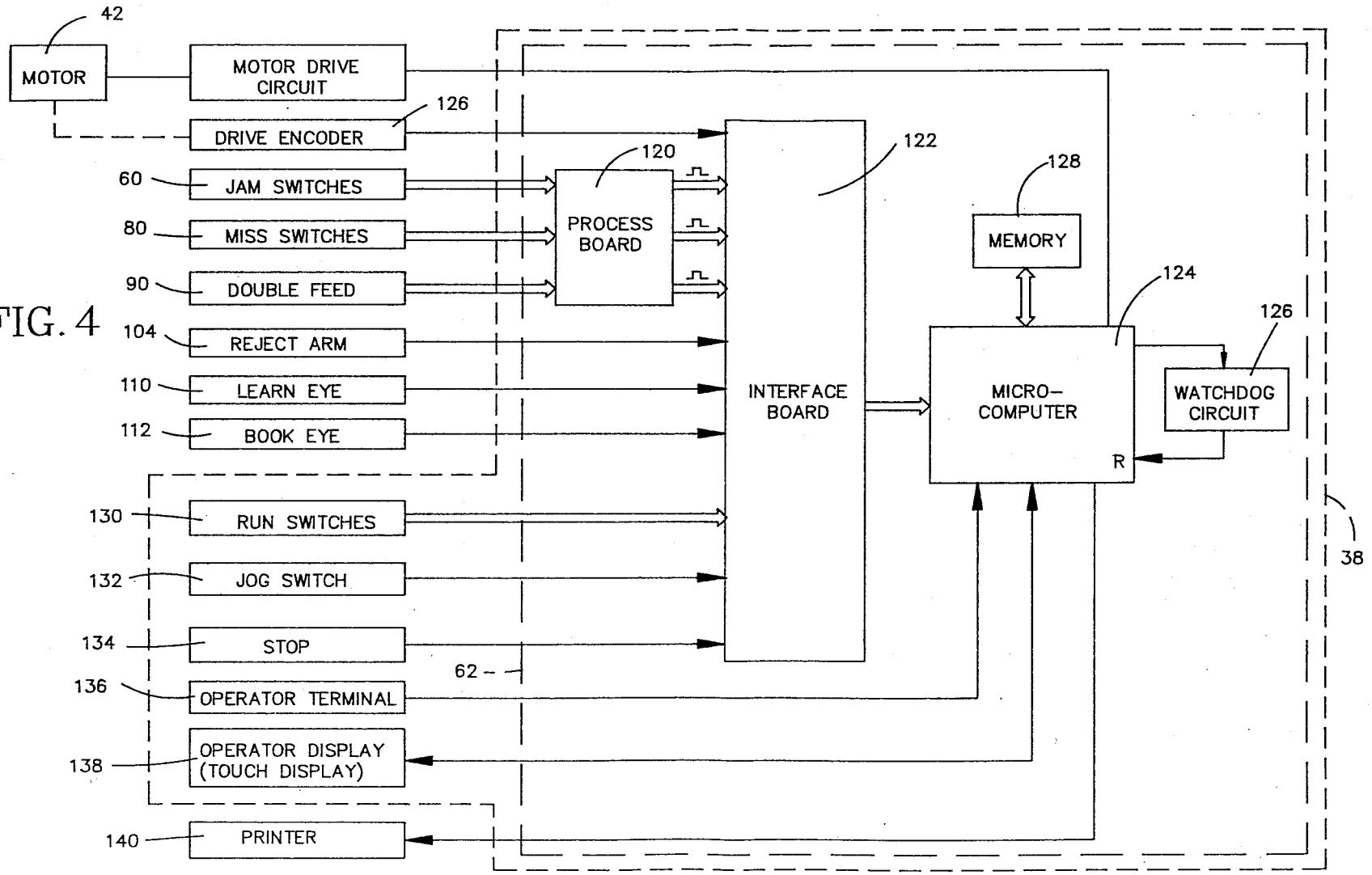
FIG. 4 is a block diagram of control circuitry for use in the present invention.

Referring to FIG. 4, the controller 62 includes a signal processing board 120 electrically connected to each of the jam sensor switches 60, the miss sensor switches 80, and the double feed sensor switches 90. The processing board 120 outputs electrical signals to an interface board 122 when any of the sensor switches 60, 80, 90 are actuated. The processing board 120 outputs a pulse of a predetermined duration upon the sensed occurrence of either a signature jam, a signature miss, i.e., no feed of a signature, or a double feed of a signature.

A microcomputer 124 is electrically connected to the interface board 122. A watchdog circuit 126 is electrically connected to the microcomputer 124. The use of watchdog circuits in combination with a microcomputer or a microprocessor are well known in the art and therefore will not be described herein. A nonvolatile memory 128 is electrically connected to the microcomputer 124.

A drive encoder 126 is operatively connected to the main drive motor 42 and outputs a digitally coded signal indicative of the rotary position of the motor 42 which is, in turn, indicative of the position of the chain 40. The drive encoder 126 is electrically connected to the microcomputer 124 through the interface board 122.

The reject arm cam sensor 104, the learn eye 110, and the book eye 112 are electrically connected to the microcomputer 124 through the interface board 122. The control panel 38 includes a plurality of switches, including run switches 130, a jog switch 132, and a stop switch 134. Each of the switches 130, 132, 134 are electrically connected to the microcomputer 124 through the interface board 122. The control panel 38 further includes an operator terminal 136, such as a keyboard electrically connected to the microcomputer 124. An operator touch display 138 is electrically connected to the microcomputer 124. The touch display 138 allows the microcomputer to display information to the operator and permits an easy way for the operator to enter information to the microcomputer by simply touching the display screen in appropriate locations prompted by a system software program. Such touch displays are well known in the art and will not be described in detail herein. A printer 140 is electrically connected to the microcomputer 124 for the purpose of providing a hard copy of system data.

Figure 5A:
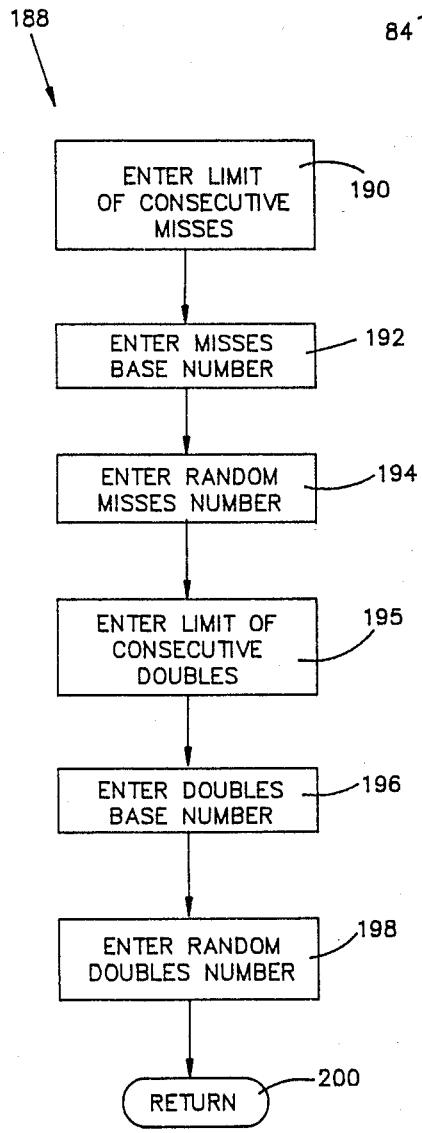
FIGS. 5–8 are flow charts depicting system operation of the collator in accordance with the present invention.
Figure 5B:
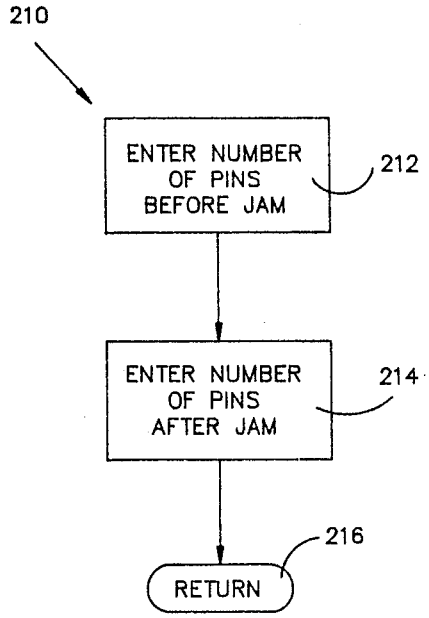
Figure 5:
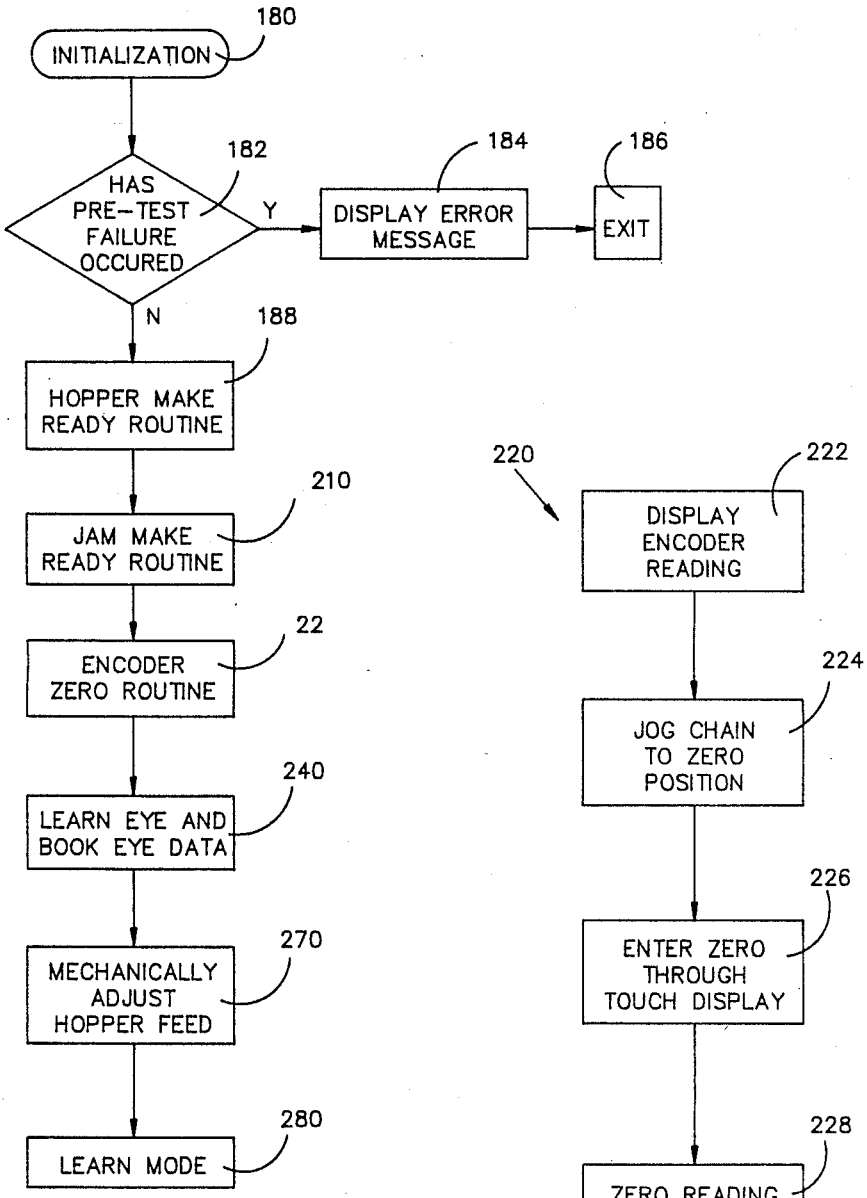

Referring to FIG. 5, the flow chart depicts the process followed for the set up of the collator system in accordance with the present invention. The set up routine is also referred to as the system make-ready routine.

In step 180, the electronics are initially energized. The microcomputer 124 performs a plurality of memory tests, determines whether all circuit boards are present, and determines whether the nonvolatile memory is functioning correctly. Such pretests are well known in the art and are referred to as system self-diagnostic tests. In step 182, a determination is made as to whether any pretest failure has occurred If a failure has occurred, the determination in step 182 is affirmative and an error message is displayed on the display 138 in step 184. The microcomputer system program then exits in step 186. If no failure has occurred in the pretest, the determination in step 182 is negative and the process proceeds to one of a plurality of system make-ready routines. The make-ready routines can be performed in any order. FIG. 5 depicts one sequence for explanation purposes only. Preferably, a make-ready menu is displayed on the touch display 138 and the operator selects one of the make-ready procedures to be performed.

A hopper make ready routine is performed in step 188. The purpose of the hopper make ready routine is to enter certain operating limits into the controller's memory for each of the hoppers. In one embodiment of the present invention, the hopper closest to the reject station has its operating limits entered first. Limits for each of the other hoppers is entered, in accordance with a preferred embodiment, in a consecutive manner.

In FIG. 5A, the hopper make ready routine 188 for a hopper is shown. In step 190, the operator enters a limit for consecutive misses for that hopper. In step 192, the operator enters a misses base number to be used by the microcomputer 124 in establishing a limit for random misses per base number. The base number is equal to a number of collator machine cycles which is equal to a number of signatures fed by the hopper. In step 194, the operator enters the number of random misses for that hopper. The random miss limit per base number for that hopper is then retained by the microcomputer 124. During the operation of the collator, the microcomputer keeps track of the number of signature misses by a hopper. When a miss occurs, the microcomputer determines whether or not the total number of random misses per base number of collator machine cycles or signature feeds for that hopper exceeds the set limit.

In step 195, the operator enters a limit for a consecutive number of signature double feeds for that hopper. In step 196, the operator enters a double feed base number. In step 198, the operator enters the random double feed limit per double feed base number. During operation of the collator, the microcompouter keeps track of the number of double feeds by a hopper. When a double feed occurs, the microcomputer determines whether or not the total number of random double feed errors per base number of collator machine cycles or signature feeds for that hopper exceeds the set limit. The consecutive error limit, the random miss limit per misses base number and the double feed limit per double feed base number is set for each of the hoppers in the collator 22. After the limits are set for each of the hoppers, step 200 returns to the routine shown in FIG. 5.

In step 210, a jam make ready routine is performed. Referring to FIG. 5B, the jam make ready routine is shown. This routine is used to establish a signature assemblage reject pattern for use when a signature jam occurs. The reject pattern is defined as the number of chain pin spaces or feed locations before and after the location where the jam occurred that are to be tracked and whose assemblages therein are to be subsequently rejected at the reject station 26. The reject pattern established during the jam make ready routine is done for each of the jam switches separately within the collator. In one preferred embodiment of the present invention, the jam switch located closest to the reject gate has its reject pattern established first.

In step 212, the operator enters the number of feed locations before the jam switch location that are to have their assemblages rejected. In step 214, the operator enters the number of feed locations after the jam switch location that are to have their assemblages rejected. Each of the jam switches may not only have a different before and after limits, but may also different before and after limits from the other jam switches within the collator. After the reject pattern is set for each of the jam switches, step 216 returns to the routine shown in FIG. 5.

Figure 5C:
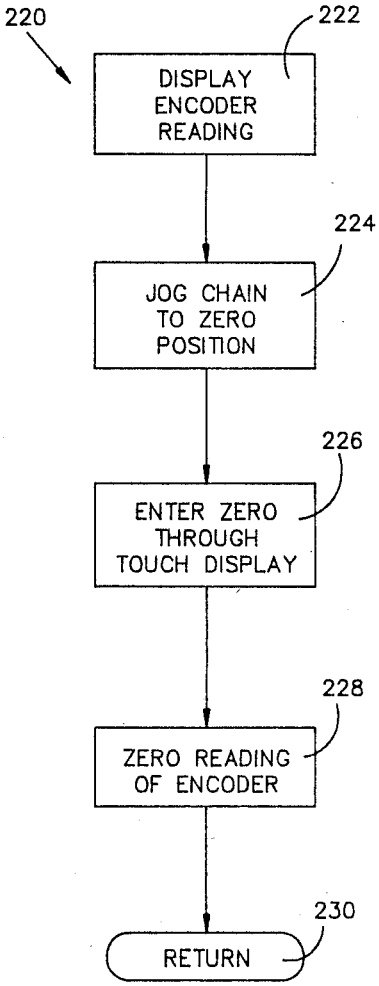

In step 220, an encoder zero routine is performed. Referring to FIG. 5C, the microcomputer displays in step 222 the present reading of the encoder. In step 224, the operator jogs the chain 40 using the jog switch 132 until one chain pin 40 aligns with a permanently fixed mark on the raceway 50. Once a chain pin aligns with the mark on the raceway, the operator, in step 226, tells the microcomputer, through the touch display 138, that the chain is at the zero position. In step 228, the microcomputer uses this reading from the encoder as the zero encoder position or the zero chain position. Each time a chain pin passes the mark on the raceway during operation of the collator, the collator is said to go through a machine cycle. The machine cycle is divided by the microcomputer into degrees such that 360° is equal to one machine cycle. The microcomputer resets the angle to 0° each time a new machine cycle begins. The angular division of the machine cycle is referred to as the encoder angle. If the chain is moved such that chain pins are spaced an equal distance upstream and downstream of the reaceway mark, the encoder reading will be interpreted by the microcomputer as an encoder angle of 180°.

The hoppers feed one signature each machine cycle. Each machine cycle will result in a hopper drum 72 rotating 180°. It will be appreciated that a 180° turn of the drum is a 360° change in the collator machine cycle. Similarly, although the fingers 74 are physically positioned 180° apart on the drum, they are 360° apart in terms of the collator machine cycle. In step 230 the program returns to the routine shown in FIG. 5.

Figure 5D:
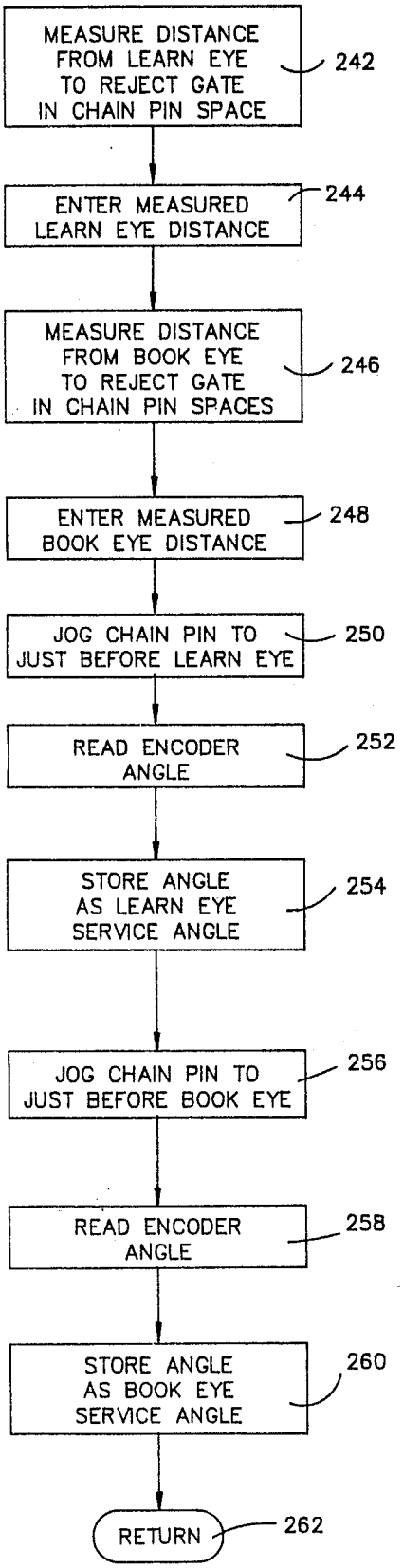

In step 240, learn eye and book eye data are entered. Referring to FIG. 5D, in step 242 of the distance from the learn eye 110 to the reject gate in chain pin spaces (feed locations) is measured by the operator. The reject gate location is taken to be the location where the distal end of the arm 100 comes up to contact signatures on the raceway 50. The measured distance is entered through the keyboard or touch display into the microcomputer's memory in step 244. The distance between the book eye 112 and the reject gate 26 is measured in chain pin spaces (feed locations) by the operator in step 246. The measured distance of the book eye 112 to the reject gate 26 is entered through the keyboard or touch display into the microcomputer's memory in step 248.

In step 250, the chain is jogged until a chain pin is positioned slightly upstream of the learn eye 110. The encoder angle is read by the microcomputer 124 in step 252 and is stored in its memory in step 254 as the learn eye service angle. In step 256, the chain is again jogged until a chain pin is positioned just upstream of the book eye 112. The encoder angle is read in step 258 and is stored in the microcomputer's memory in step 260 as the book eye service angle. The program returns, in step 262, to the routine shown in FIG. 5.

In step 270, each of the hoppers is mechanically adjusted so that a maximum size signature can be fed into a feed location on the chain 40 so that the signature extends to a maximum downstream location within the feed location, i.e., between consecutive chain pins. It is well known in the collator art that each hopper can be mechanically disconnected from the system main drive so as to permit rotation of the hopper drum by hand. Such hand rotation of the drum is known in the art as phasing the hopper. In an array of hoppers, the phase angle of a hopper is different than the phase angle of its adjacent upstream and downstream hoppers.

Figure 5E:
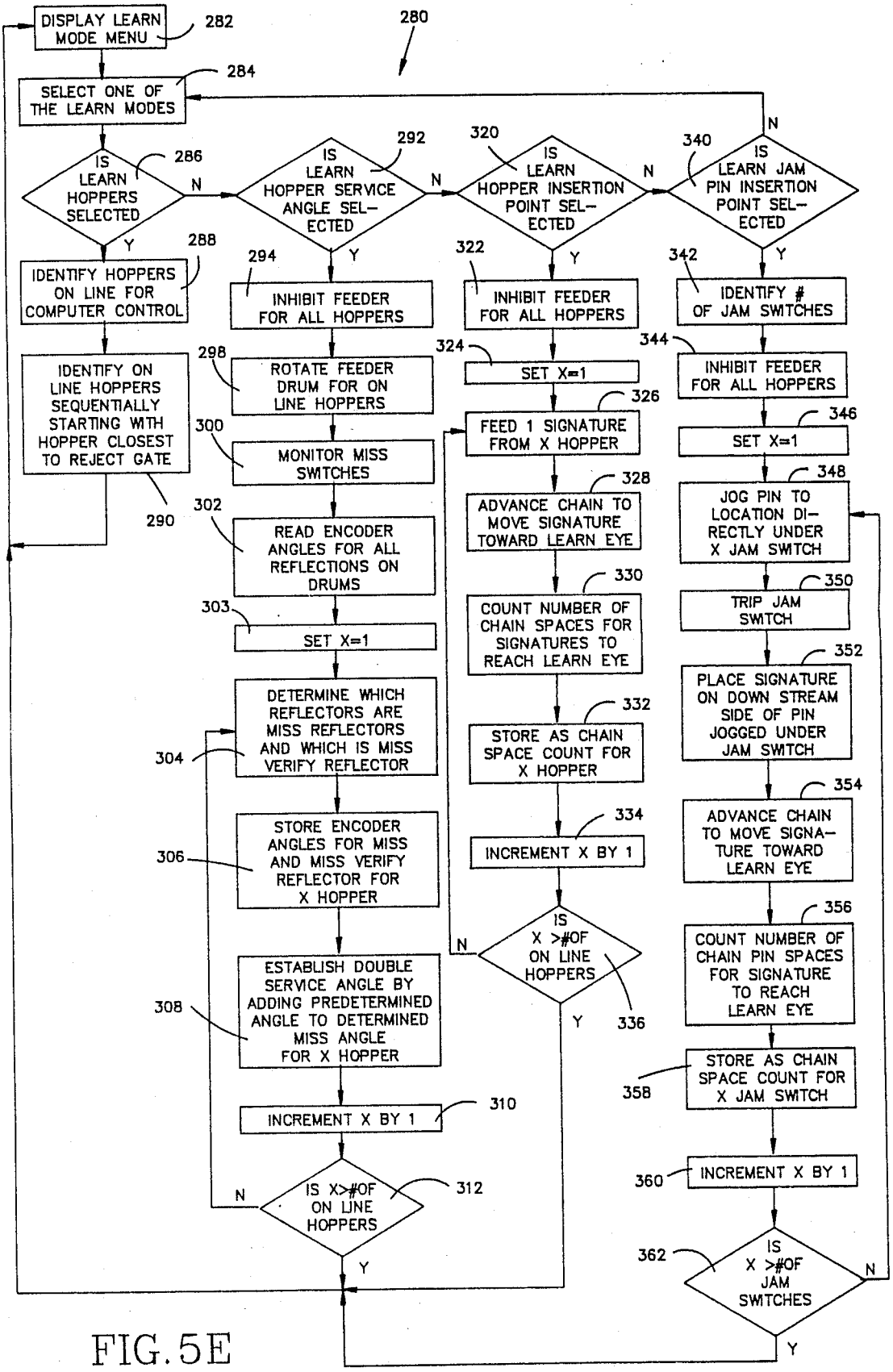

In step 280, the microcomputer performs a learn mode. Referring to FIG. 5E, the learn mode begins in step 282 with the microcomputer displaying on the operator touch display 138 a learn mode menu. The learn mode menu includes four possible learn mode selections, i.e., (i) learn hoppers, (ii) learn hopper service angle, (iii) learn hopper insertion point, and (iv) learn jam switch insertion point. In step 284, the operator, using the touch display, selects one of the learn modes displayed on the learn mode menu.

In step 286, a determination is made as to whether learn hoppers has been selected. If the determination in step 286 is affirmative, each of the hoppers on-line for computer control are identified. Each of the hoppers preferably has an associated switch (not shown) connected to the controller that in one condition will permit computer control and in another condition will not permit computer control. In step 290, each of the hoppers that are on line for computer control are sequentially numbered beginning with the on-line hopper closest to the reject gate as the number one hopper. The on-line hoppers upstream therefrom are sequentially numbered. The program then returns to the display learn mode menu in step 282.

If the determination in step 286 is negative, a determination is made in step 292 as to whether learn hopper service angle has been selected in step 284. If the determination in step 292 is affirmative, the program proceeds to step 294 where the feeder for all hoppers are inhibited. To inhibit a feeder, it is well known in the art to simply shut off the vacuum of the suction device 78 that pulls a signature downward from the bin 70 so that the fingers 74 on the drum 72 cannot grab the signature as the drum rotates. In step 298, the feeder drum for each of the hoppers is rotated. Because no signatures are on the drums 72, the sensor switch 80 for each of the hoppers will trip each time a miss reflector 82 or the miss verify reflector 84 passes thereby. In step 300, the miss sensor switch 80 for each of the on-line hoppers are monitored. In step 302, the microcomputer 124 reads the encoder angles for all reflections received from the reflectors secured to all the on-line drums. In step 303, the microcomputer establishes a value X=1.

From hopper X's monitored encoder angles, the microcomputer 124 determines, in step 304, which reflectors are miss reflectors and which one of the reflectors is a miss verify reflector. The two miss reflectors are physically positioned 180° apart on the drum 72 since the drum 72 feeds two signatures per 360° revolution of the drum, each 180° rotation of the drum is 360° of the collator machine cycle. Therefore, the miss reflectors are 360° apart in terms of the collator machine cycle. Since the two miss reflectors are 360° apart, it can be determined which are the miss reflectors and which one is the miss verify reflector. The program stores the encoder angles for the miss reflectors and the miss verify reflector for the first on-line hopper in step 306.

The program, in step 308, establishes a double service angle for the double sensor switch 90 for hopper X by adding a predetermined angle to the determined miss angle for the first on-line hopper as determined in step 304. This is done because the double sensor switch 90 is a known angular distance from the miss sensor switch 80.

In step 310, the value X is incremented by one. A determination is made in step 312 as to whether X is greater than the number of on-line hoppers determined in step 288. If the determination in step 312 is negative, the program returns to step 304 where the second on-line hopper has its service angles determined. The above loop is continued until the determination in step 312 is affirmative at which time the program returns to step 282.

If the determination in step 292 is negative, the program proceeds to step 320 where a determination is made as to whether the learn hopper insertion point has been selected in step 284. If the determination in step 320 is affirmative, each of the feeders for all the hoppers are inhibited in step 322. A value of X=1 is set in step 324 and the program proceeds to step 326 where one signature is fed from the first on-line hopper to a feed location on the chain 40.

The program proceeds to step 328 where the chain is advanced to move the signature toward the learn eye 110. The number of chain spaces (machine cycles) needed to move the signature to the learn eye is counted in step 330 and the count is stored in the microcomputer's memory in step 332 for the first hopper. From this number, the microcomputer determines how far the hopper X is from the reject gate. To do this, the microcomputer adds the learn eye to reject distance entered in step 244 (see FIG. 5D) to the number stored in memory in step 332. This distance is referred to as the hopper insertion point.

In step 334, the value of X is incremented by one. In step 336, a determination is made as to whether or not X is greater than the number of on-line hoppers as determined in step 288. If the determination in step 336 is negative, the program returns to step 326 where a signature is fed from the second on-line hopper. The above-described loop is continued until the determination in step 336 is affirmative, at which time the program returns to step 282.

If the determination in step 320 was negative, the program proceeds to step 340 where a determination is made as to whether the learn jam switch insertion point was selected in step 284. If the determination made in step 340 is affirmative, the program, in step 342, identifies the number of jam switches in the collator. In step 344, all of the feeder hoppers are inhibited. A value of X=1 is set in step 346. In step 348, a chain pin is jogged to a location directly under the first jam switch, which is the one located closest to the reject station.

Once a chain pin is aligned with the jam switch, the jam switch is mechanically tripped by the operator in step 350. The operator places a signature on the downstream side of the pin which was positioned under the jam switch in step 352. The chain is advanced in step 354 to move the signature placed on the chain toward the learn eye. The microcomputer counts the number of chain pin spaces (machine cycles) which are moved to have the signature reach the learn eye in step 356.

In step 358, the number of chain pin spaces counted in step 356 is stored as a count for the jam switch X. From this value, the microcomputer determines the location of the jam switch X from the reject gate. To do this, the microcomputer adds the learn eye to reject distance entered in step 244 (see FIG. 5D) to the number stored in memory in step 358. The distance from the jam switch to the reject gate is the jam switch insertion point. The value of X is incremented by one in step 360. A determination is made in step 362 as to whether the value X is greater than the number of jam switches identified in step 342. If the determination in step 362 is negative, the program returns to step 348 wherein a chain pin is jogged to a location directly under the second jam switch. The above-described loop is continued until a determination in step 362 is affirmative, at which time the program returns back to step 282.

If the determination in step 340 is negative, the program returns to step 284 and the above described loop is again performed. One option displayed in the learn mode menu is EXIT which the operator can select to exit from the learn mode. Once all the routines shown in FIG. 5 are completed, the collator system is ready for operation.

Figure 6A:
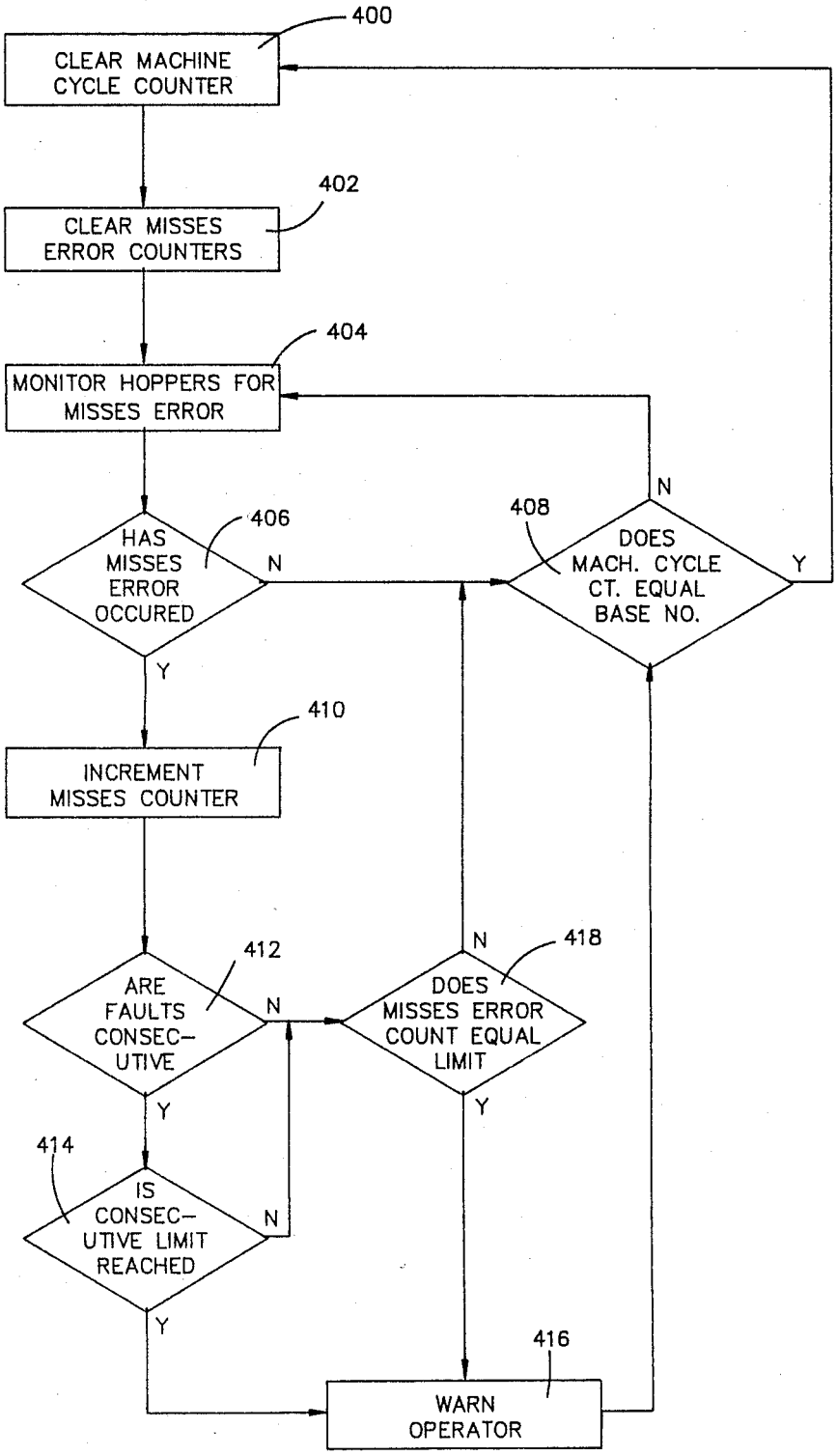

The microcomputer 124 includes a program to monitor, during operation of the collator, the number of miss faults and double feed faults for each of the hoppers. Referring to FIG. 6A, a flow chart is shown depicting a process for monitoring random miss faults for each of the hoppers in accordance with a preferred embodiment of the present invention. As mentioned above, each time a chain pin reaches the mark on the raceway, a machine cycle is completed. As the machine cycle is completed, the machine cycle angular reading is reset to zero. The microcomputer 124 includes a machine cycle counter that counts the number of machine cycles. Also included in the microcomputer is a plurality of miss counters for the hoppers, each hopper having an associated miss counter. A miss counter counts the number of missed signatures as detected by the miss sensor switch 80 for that hopper. The program in step 400 clears the machine cycle counter in the microcomputer 124. In step 402, the misses error counter for each of the hoppers is cleared. In step 404, each of the hoppers is separately monitored for a signature miss during operation. Since the microcomputer 124 has "learned" the service angle of each hopper, i.e., the angle at which the miss reflectors 82 pass the miss sensor switch 80, the microcomputer "knows" when to monitor for the miss signal for each hopper during a machine cycle.

As mentioned, the processing board 120 includes a pulse conditioner connected to the miss sensor switches. The pulse conditioner outputs a pulse to the microcomputer 124 through the interface board 122 having sufficient duration to permit the microcomputer 124 time to monitor the occurrence of a miss signal during a machine cycle.

In step 406, a determination is made as to whether or not a miss error has occurred for any of the hoppers during the machine cycle. If the determination in step 406 is negative, the program proceeds to step 408. In step 408, a determination is made as to whether or not the number of completed machine cycles is equal to the misses base number which was programmed for the hopper being considered as was entered in step 192.(see FIG. 5A). If the determination in step 408 is negative, the program returns to step 404 where the microcomputer continues to monitor the hoppers for misses. Each of the hoppers is monitored for a miss feed one time each machine cycle.

If the determination in step 406 is affirmative, the program in step 410, increments the misses counter by one for the hopper in which the miss occurred. The program then proceeds to step 412 where a determination is made as to whether or not the misses fault detected for a particular hopper is a consecutive fault, i.e., a fault has occurred in the previous machine cycle for the same hopper. If the determination in step 412 is affirmative, a determination is made in step 414 as to whether or not the consecutive fault limit for that hopper as set in step 190 (see FIG. 5A) has been reached. If the determination in step 414 is affirmative, the program proceeds to step 416 where a warning is given to the operator. The operator upon being warned decides whether to stop the collator by depressing the stop switch 134.

If the determination made in steps 412 or 414 are negative, the program proceeds to step 418 where a determination is made as to whether the number of misses error for a hopper equals the limit as set in step 194 (see FIG. 5A). If the determination in step 418 is affirmative, the program proceeds to step 416. From step 416 or from a negative determination in step 418, the program proceeds to step 408. When the determination in step 408 is affirmative, the program returns to step 400 where the machine cycle count is cleared and the program begins again. It will be appreciated that if the number of misses are consecutive and equal to the consecutive limit preset by the operator or if a number of random miss errors occurs per base number greater than the limit preset by the operator for any hopper, a warning is given to the operator. Each hopper is monitored separately and therefore can have its own consecutive limits and its own number of random limits per its own base number.

Figure 6B:
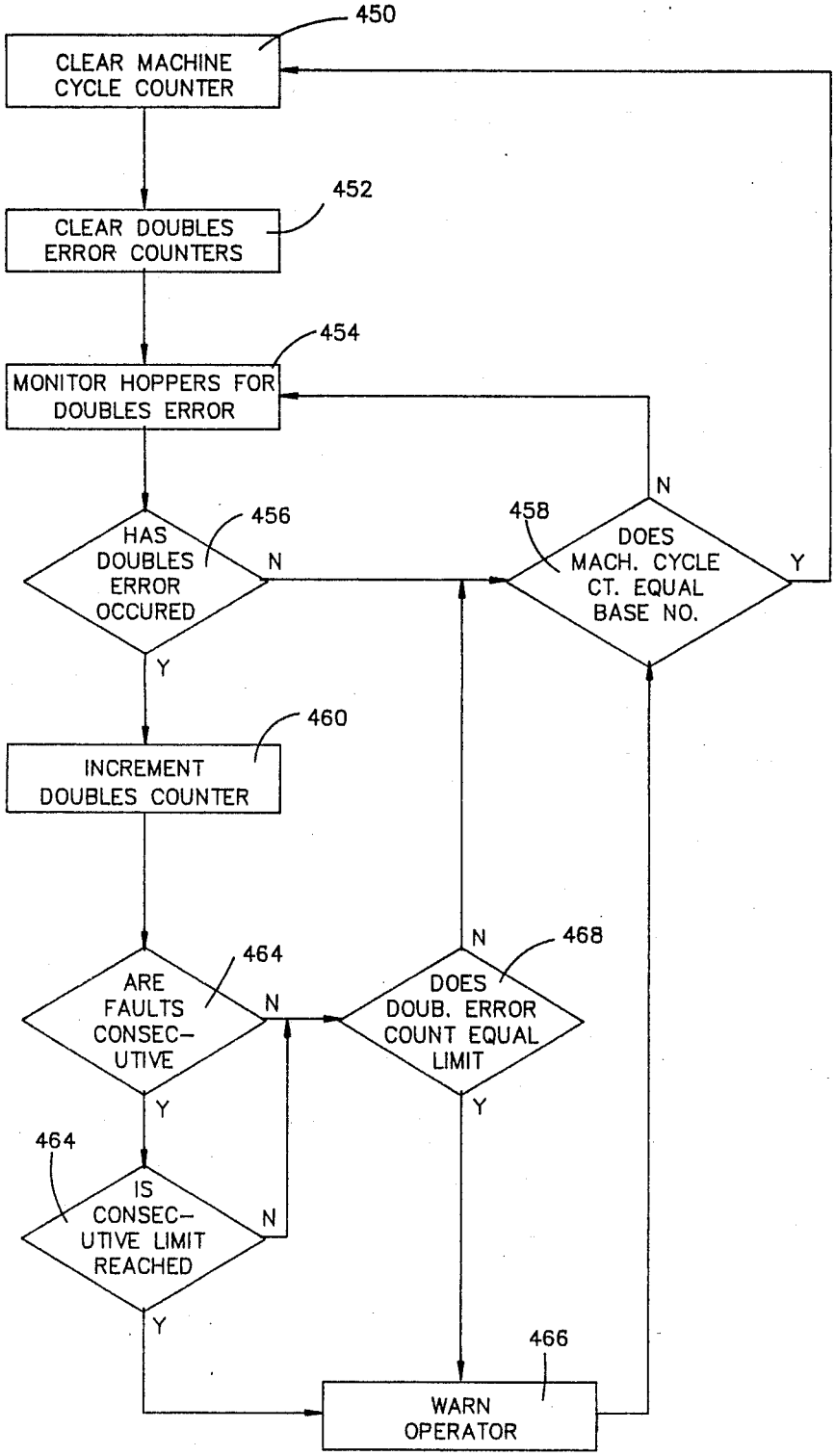

Referring to FIG. 6B, a flow chart is shown depicting a process, in accordance with the present invention, for monitoring double feed faults in each of the hoppers during operation of the collator. In step 450, the machine cycle counter is cleared. Although this step 450 is shown separately in FIG. 6B, it will be understood that this step is the same as step 400 shown in FIG. 6A. The microcomputer 124 further includes a counter for each hopper that counts the number of double feed signals that occur for their associated hopper. In step 452, each of the counters for counting the number of double feeds for each hopper is cleared. In step 454, each of the hoppers double switches 96 are monitored for a double feed fault. The double feed sensor service angle for each hopper was established by the microcomputer 124 based from the determined associated miss sensor service angle plus a predetermined angular degree. Based upon the established double feed service angle, the micrcomputer 124 knows when to monitor for a double feed during a machine cycle. The double switches are connected to the microcomputer 124 through the processing board 120 and interfacing board 122. The processing board generates a pulse when a double feed occurs having a predetermined duration sufficiently long to permit the microcomputer 124 time to monitor that a double feed has occurred during any machine cycle.

In step 456, a determination is made as to whether or not a double feed has occurred. The doubles sensor switch 90 for each of the hoppers is monitored one time each machine cycle. If the determination in step 456 is negative, the program proceeds to step 458. In step 458, a determination is made as to whether or not the machine cycle count equals the base number preprogrammed in for the monitored hopper in step 196 (see FIG. 5A). If the determination in step 458 is negative, the program returns to step 454 and the microcomputer continues to monitor the hoppers. If the determination in step 458 is affirmative, the program returns to step 450.

If the determination in step 456 is affirmative, the program proceeds to step 460 where the counter for a double feed is incremented by one for the hopper monitored to have an error. The program then proceeds to step 462 where a determination is made as to whether or not there are consecutive faults, i.e., a double fault has occurred in the previous machine cycle for the same hopper. If the determination in step 462 is affirmative, the program proceeds to step 464 where a determination is made as to whether the consecutive double fault limit for that hopper entered in step 195 (see FIG. 5A) has been reached.

If the determination in step 464 is affirmative, the program proceeds to step 466 where a warning is given to the operator. The operator, when warned, can decide whether to stop the collator using the stop switch 134. If the determination in steps 462 or 464 are negative, the program proceeds to step 468 where a determination is made as to whether the double fault count for the hopper having the error is equal to the limit established in step 198 (see FIG. 5A). If the determination in step 468 is affirmative, the program proceeds to step 466. The program proceeds from step 466 or from a negative determination in step 468 to step 458. In step 458, a determination is made as to whether the machine cycle count is equal to the base number for that hopper entered in step 196 (see FIG. 5A). Each of the hoppers can have its own consecutive fault limit, as well as its own double fault limit and its own doubles base number.

Whenever a signature miss or a double feed is detected, the controller disables downstream hoppers from feeding into the feed locations that are to be subsequently rejected. During such intentional disabling of the downstream hoppers, the controller ignores miss signals generated from such hoppers.

Figure 7:
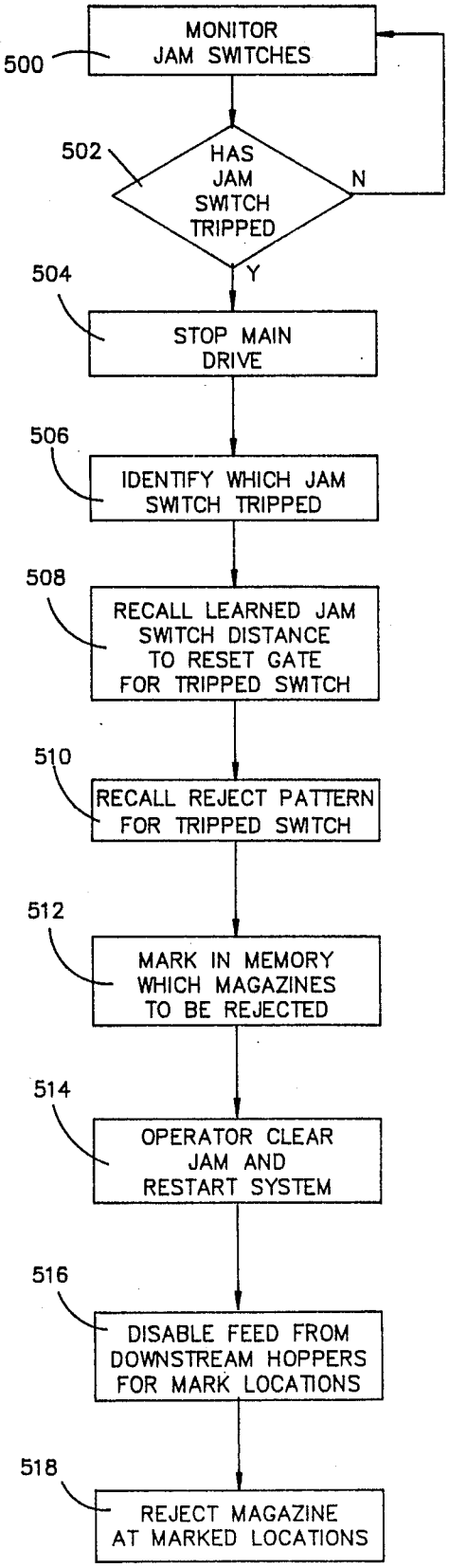

FIG. 7 shows a flow chart describing a process for controlling the collator in response to a monitored jam. In step 500, each of the jam switches within the collator are monitored. In step 502, a determination is made as to whether or not one of the jam switches has tripped. A jam occurs when a signature is fed down to the raceway and, instead of falling between chain pins, falls on and covers a chain pin. If the determination in step 502 is negative, the program returns to step 500 and continues to monitor the jam switches. The jam switches are preferably monitored continuously during each cycle. The jam switches are electrically connected to the microcomputer 124 through the processing board 120.

If the determination in step 502 is affirmative, the program proceeds to step 504 where the main drive of the collator is stopped. The location of the jam switch tripped is identified to the operator in step 506. In step 508, the learned distance from the tripped jam switch to the reject gate is recalled from the controller's memory. In step 510, the reject pattern for the tripped jam switch, which was previously entered in steps 212, 214 (see FIG. 5B), is recalled from the controller's memory. The microcomputer, in its memory, marks the feed locations to be rejected based upon the reject pattern recalled in step 510. The operator clears the jam in step 514 and restarts the collator.

The hoppers downstream from the jam location are disabled in accordance with the recalled reject pattern and the marked locations established in step 512. While the hoppers are disabled, the miss detector switches are ignored. The signatures are rejected in step 518 by the reject gate commensurate with the reject pattern marked in the microcomputer's memory in step 512. It will be appreciated that each of the jam switches can have a reject pattern different from the reject pattern of the other jam switches. The reject pattern downstream cannot exceed the number of feed locations between the jam switch and the reject gate. The book eye 112 is monitored by the controller to ensure that the proper assemblages have been rejected. Otherwise, the controller warns the operator.

Referring to FIG. 2, assume that the collator 22 has been set up such that the controller 62 has learned the hopper positions relative to the reject gate (hopper insertion points), the jam switch positions relative to the reject gate (jam switch insertion points), and the hopper service angles (miss and miss verify service angles, and doubles service angle) for each of the hoppers. The operator can, through the keyboard or a switch (not shown) elect to ripple start the collator. If ripple start is selected, when the collator is started by activating a run switch 130, the controller ripple starts the collator. During a ripple start, all hopper feeds are initially disabled and the drums are rotated. After at least one complete rotation of the drums, the hopper furthest from the reject gate is enabled so as to feed a signature from its bin to a first feed location on the chain 40 while the remainder of the hopper feeders remain disabled from feeding signatures. As the first feed location having a signature on the chain approaches each of the other downstream hoppers, the downstream hoppers are sequentially enabled so as to feed a signature into the first feed location on the chain. During a ripple start, the miss detector switches are ignored by the controller for the purpose of miss feed detection and are used solely for the purpose of monitoring the hopper service angles.

Even though the hoppers are initially disabled from feeding, their drums are driven in rotation by the main drive. During rotation of the drums of the downstream hoppers in a ripple start, the controller 62 monitors the hopper's service angle, i.e., misses angles and miss verify angles. The controller then compares the monitored ripple start service angles with the service angles that was stored in its memory during the initial set-up (learn mode) of the collator for each of the hoppers. It is necessary to monitor the miss and miss verify service angles for each of the hoppers during ripple start, because the phase of any hopper can be changed by the operator.

To change a hopper's phase, the hopper's drum is mechanically disengaged from the main drive, the drum is rotated, and is then re-engaged with the main drive. These hopper phasing adjustments are periodically made by the operator in an attempt to ensure that a signature fed by a hopper drops properly onto the chain relative to the associated upstream chain pin. An adjustment of a hopper's phase may be necessary to compensate for chain stretch that may occur over time. A hopper's phase also may need adjusting when the size of a signature it is presently feeding is different than the signature size that hopper was feeding when the collator was originally set up. As a result of these changes, the controller must automatically adjust to the new hopper timing and possible new hopper machine cycle distance to the reject gate (hopper insertion point).

Referring to FIG. 2, assume that the fifth hopper from the reject gate has a miss service angle of 350° during initial set up of the collator. This means that its miss reflectors 82 pass its associated miss sensor switch 80 when the encoder of the main drive outputs a signal indicative of the machine cycle being at 350°. Also, assume that the initial collator set up has the signature fed by the fifth hopper's drum dropping into location number 9 on chain 40. If, during a collator machine cycle a miss occurs, in the fifth hopper, the controller 62 "knows" that the signature assemblage presently in location number 9 is the assemblage which is missing a signature and is to be rejected.

Now, assume that during the operation of the collator, the operator stops the collator, mechanically phases the drum of the fifth hopper so that the service angle for a miss now occurs at 50° instead of 350°, and restarts the collator with a ripple start. During ripple start after the hopper phase adjustment, the controller monitors that the miss service angle for the fifth hopper has shifted from the 350° angle initially learned during the learn set up, to a new monitored 50° angle. Such a phase shift of the fifth hopper changes the feed location on the chain where its signatures are fed. When the phase for the fifth hopper is 350°, a signature fed therefrom drops into location number 9. When the phase is shifted to 50°, the signature is fed into location number 8. Assume a miss occurs with the fifth hopper phased to 50°. The assemblage with the missing signature is located in feed location number 8 and not in feed location number 9. The controller 62, now "knowing" that the assemblage with the missing signature is in location number 8 and not location number 9, marks location 8 for rejection instead of location 9. Such a feed location re-adjustment occurs when a hopper's phase is changed through 0°.

It is possible, that the operator can change the phase of a hopper to such an extent that the controller 62 could not compensate for such adjustment. If the microcomputer senses such a large phase adjustment during a ripple start, the main drive is disabled and an error message is displayed on the touch display for the operator. Also, the operator can phase a hopper in a wrong direction. Such an occurrence can be detected by the controller so that the controller can disable the main drive.

The miss verify reflector 84 located on each of the drums 72 for the hoppers serves several purposes. First, the miss verify reflector permits the controller to detect that the miss sensors 80 are functional. Once per revolution of the drum 72, the controller 62 should "see" a return signal from each of the sensors 80 indicative of the miss verify reflector 84 passing thereby. If the miss verify reflector is not "seen" by the controller 62, one possible fault could be an inoperative sensor switch 80. The controller would stop the collator if a miss verify sensor is not seen by its associated sensor switch 80. Also, the miss verify reflector 84 provides a way for the controller 62 to determine that the associated drum 72 of each of the hoppers is, in fact, rotating during operation of the collator. Without the miss verify reflector, the drum could otherwise set idle having been disconnected from the main drive without such occurrence being detected by the controller. The absence of a miss verify signal can, therefore, be indicative of a drum not rotating.

Also, it is possible that a signature can get "hung up" in the hopper blocking the associated miss sensor 80 and also preventing further signature feeds from the hopper. Such an occurrence would be detected by the sensor 80 not receiving a signal from the miss verify reflector 84 as it passes thereby.

Furthermore, the miss verify reflector provides a way for the controller 62 to determine whether or not a phase adjustment has been made during operation of the collator, i.e., after ripple start information has been monitored. If an operator should stop the collator during operation, adjust the phase of one of the drums, and restart the collator without a ripple start, the controller would detect the phase shift through the sensor signal received from the miss verify reflector. If the controller 62 does not "see" a return signal from a miss verify reflector when it should because of a change in hopper phase, the main drive for the system is stopped. The operator can restart the controller with a ripple start so that the new hopper service angles can be "learned".

Attached hereto as appendix A is a copy of a software program listing for controlling the touch display 138 in the learn mode. One such touch display is a Fluke 1780A InfoTouch Display. Also, attached hereto as Appendix B is a copy of a software listing for accomplishing the learn mode process described above. The software listings contemplate use of an Omnibyte OB68K1A computer which uses a Motorola 68000 microprocessor based system. It is also contemplated that an OPTO-22 PAMUX II interface be used. The program listings are but one way of accomplishing the process according to the present invention and are not to be construed as a limitation to the present invention.

Figure 8:
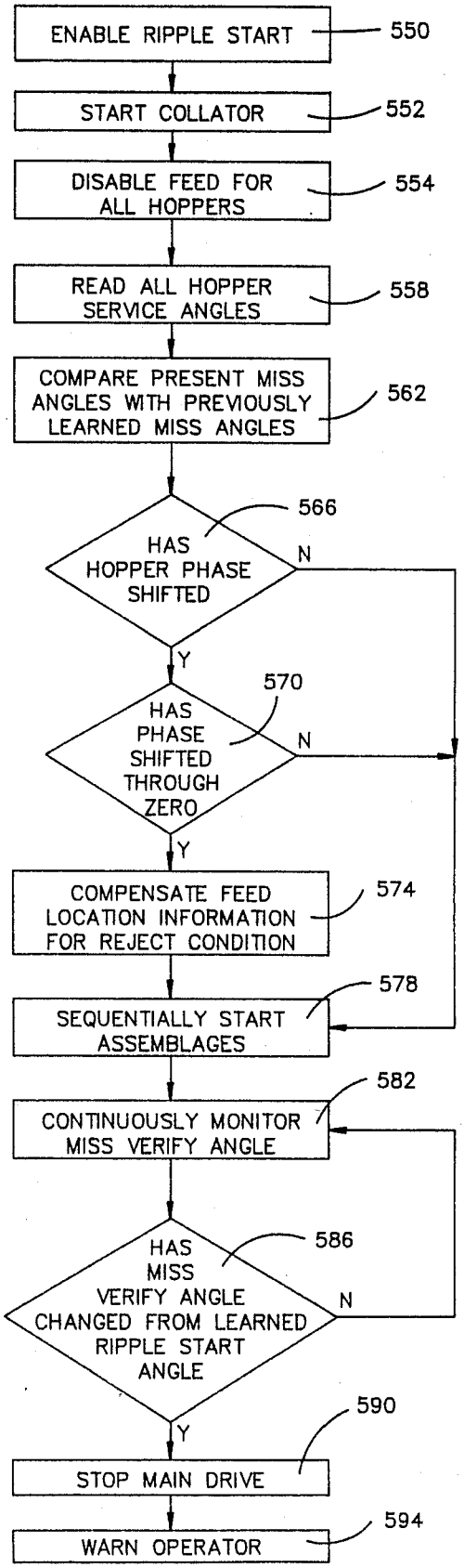

Referring to FIG. 8, a flow chart is shown depicting the control process during ripple start and subsequent monitoring for hopper phase changes that occur after ripple start. In step 550, a ripple start sequence is enabled and the collator is started in step 552. In step 554, the feeders for all the hoppers are disabled. The drums for each of the hoppers is rotated and the angles of each of the miss reflectors and the miss verify reflector is monitored in step 558. In step 562, the miss angles monitored in step 558 are compared against those learned during initial collator set up (step 306, FIG. 5E). A determination is made in step 566 as to whether a hopper phase shift has occurred. If the determination of step 566 is affirmative, the program proceeds to step 570 where a determination is made as to whether the hopper phase shift has gone through zero. If the determination in step 570 is affirmative, the program proceeds to step 574 where the controller compensates its feed location information for reject conditions to allow for the phase shift. In the example discussed above where the phase shift went from 350° to 50°, the process of step 574 changes the feed location information for the fifth hopper, i.e., that the fifth hopper now feeds location 8 instead of location 9.

The program proceeds from step 574 or from negative determinations in either step 566 or step 570 to step 578 where the signature fed from the hoppers is sequentially started. The miss verify angles are continuously monitored in step 582 during collator operation. In each machine cycle, a determination is made in step 586 as to whether the miss verify angle has changed for any hopper after the ripple start angles were monitored in step 558. If the determination in step 586 is negative, the program returns to step 582. If the determination in step 586 is affirmative, the program proceeds to step 590 where the main drive is stopped and the operator is warned in step 594.

This invention has been described with reference to preferred embodiments. For example, the present invention has been described with reference to flat-back assemblages. The method and apparatus of the present invention also applies to saddle collators and newspaper stuffing machines. Modifications and alterations may occur to others upon reading and understanding the specification. It is our intention to include all such modifications and alterations insofar as they come within the scope of the appended claims or the equivalent thereof.

APPENDIX A

```
/*****************************************************************************
                        COPYRIGHT (C)  1985
                 BY HARRIS GRAPHICS CORP., CHAMPLAIN, NY
                        ALL RIGHTS RESERVED

Project:        CABCON II

Module:         CONFGMENU.C

Version:        X1

Abstract:       Menu to call learn and configuration displays.

Author:         Steve Ent

Created:        21-Aug-85

Modified by:

        Who             Date            Description of Modification
        ---             ----            ---------------------------

*****************************************************************************/
#include <std.h>
#include <config.h>
#include <service.h>
#include <mm85rtc.h>
#include <contextsw.h>
#include <msglog.h>


SECTION( TEXT, 4);              /* prom */
SECTION( DATA, 1);              /* onboard ram */
IDNT( 1,1,"menu to call configuration displays");

IMPORT UTINY config_bits;
IMPORT MSG_TBL key_locked;
IMPORT UTINY  i_config_mask[];

        confgmenu()
        {


ULONG   cnt;
TINY    in;


                        /*- +++++++++1111111111222222222233333333334444444444555555555556
                          1012345678901234567890123456789012345678901234567890123456789012345678901234567890*/
LOCAL char buttons[] =  {"hXXXXXXXXXXXXAAXXKKXXBBXXXXXXXXXXCCXDDEEXFFXXXXXXXXXXGGXHHIIXJJ"};


    again:

        flush_outq();

        ini_fluke();

                /* Set up the buttons and the text. */


                /* Row 2 */
        display ("\33[1;36HCONFIGURATION");
```

```
        /* Row 3 */
display ("\33[3;46H\33[m\33[3;33H\33[8m`dda dudd1");

        /* Row 4 */
display ("\33[4;24H\33[m\33[4;46H\33[m\33[4;73H\33[m");
display ("\33[4;9H\33[8mkddddddddddddd1");
display ("\33[4;33H\33[3me  bddc  e");
display ("\33[4;58H\33[3mkddddddddddddd1");

        /* Row 5 */
display ("\33[5;10H\33[3p9\33[2p   SET UP   \33[3p9\33[2p");
display ("\33[5;46H\33[m\33[5;33H\33[8me  `dda .e");
display ("\33[5;59H\33[3p9\33[2p  ENCODER   \33[3p9\33[2p");

        /* Row 6 */
display ("\33[6;10H\33[3p9\33[2p   HEADER   \33[3p9\33[2p");
display ("\33[6;46H\33[m\33[6;33H\33[8mmddtd bddc");
display ("\33[6;59H\33[3p9\33[2p    ZERO    \33[3p9\33[2p");

        /* Row 7 */
display ("\33[7;24H\33[m\33[7;73H\33[m");
display ("\33[7;9H\33[8mmddddddddddddd1");
display ("\33[7;58H\33[8mmddddddddddddd1");


        /* Row 8 */
display ("\33[8;73H\33[m");
display ("\33[8;9H\33[8mkddddddddddddd1  kddddddddddddd1  ");
display ("kddddddddddddd1   kddddddddddddd1");


        /* Row 9 */
display ("\33[9;10H\33[3p9\33[2p   SET SYS  \33[3p9\33[2p");
display ("\33[9;26H\33[3p9\33[2p  CONFIGURE \33[3p9  9\33[2p");
display (" SET SYSTEM \33[3p9\33[2p");
display ("\33[9;59H\33[3p9\33[2p   LEARN    \33[3p9\33[2p");


        /* Row 10 */
display ("\33[10;10H\33[3p9\33[2p   CLOCK    \33[3p9\33[2p");
display ("\33[10;26H\33[3p9\33[2p SERIAL I/O \33[3p9  9\33[2p");
display (" PARAMETERS \33[3p9\33[2p");
display ("\33[10;59H\33[3p9\33[2p  HOPPERS   \33[3p9\33[2p");


        /* Row 11 */
display ("\33[11;73H\33[m");
display ("\33[11;9H\33[8mmddddddddddddn  mddddddddddddn  ");
display ("mddddddddddddn   mddddddddddddn");


        /* Row 12 */
display ("\33[12;73H\33[m");
display ("\33[12;9H\33[8mkddddddddddddd1  kddddddddddddd1  ");
display ("kddddddddddddd1   kddddddddddddd1");


        /* Row 13 */
display ("\33[13;10H\33[3p9\33[2p   LEARN    \33[3p9\33[2p");
display ("\33[13;26H\33[3p9\33[2p   LEARN    \33[3p9  9\33[2p");
display ("   LEARN    \33[3p9\33[2p");
display ("\33[13;59H\33[3p9\33[2p   LEARN    \33[3p9\33[2p");


        /* Row 14 */
display ("\33[14;10H\33[3p9\33[2pREJECT ANGS \33[3p9\33[2p");
display ("\33[14;26H\33[3p9\33[2pHOPPER ANGS \33[3p9  9\33[2p");
display (" INS POINTS \33[3p9\33[2p");
display ("\33[14;59H\33[3p9\33[2pJAM SWITCHES\33[3p9\33[2p");


        /* Row 15 */
display ("\33[15;73H\33[m");
display ("\33[15;9H\33[8mmddddddddddddn  mddddddddddddn  ");
display ("mddddddddddddn   mddddddddddddn");

clear_resp();


FOREVER
        {

ini_touch();

prt_time();

dismsgline();

/* Read in botton. */
```

```
in = response();

switch ((in >= -1 && in <= 60) ? buttons[in+1] : in )
                {
        case 'A':       /* call display to set the header. */
                beep_ack();

                if( config_bits & i_config_mask[1] )
                        utimemsg( 400, 5, &key_locked, NULL);
                else
                        {
                        display ("\33[2J");

                        confghd();

                        goto  again;
                        }
                break;


        case 'B':
                beep_ack();

                if( config_bits & i_config_mask[1] )
                        utimemsg( 400, 5, &key_locked, NULL);
                else
                        {
                        display ("\33[2J");

                        enczero();

                        goto  again;
                        }

                break;

        case 'C':
                beep_ack();

                if( config_bits & i_config_mask[1] )
                        utimemsg( 400, 5, &key_locked, NULL);
        else
                {
                display ("\33[2J");

                set_rtc();

                goto  again;
                }

        break;

case 'D':
        beep_ack();

        if( config_bits & i_config_mask[1] )
                utimemsg( 400, 5, &key_locked, NULL);
        else
                {
                display("\33[2J");

                confgio();

                goto again;
                }

        break;

case 'E':
        beep_ack();

        if( config_bits & i_config_mask[1] )
                utimemsg( 400, 5, &key_locked, NULL);
        else
                {
                display ("\33[2J");

                confgsys();

                goto  again;
                }

        break;

case 'F':
        beep_ack();
```

```
        if( config_bits & i_config_mask[1] )
                utimemsg( 400, 5, &key_locked, NULL);
        else
            {
                display ("\33[2J");

                confghop();

                goto  again;
            }

        break;
 case 'G':
        beep_ack();

        if( config_bits & i_config_mask[1] )
                utimemsg( 400, 5, &key_locked, NULL);
        else
            {
                display ("\33[2J");

                confgrjct();

                goto  again;
            }

        break;


 case 'H':
        beep_ack();

        if( config_bits & i_config_mask[1] )
                utimemsg( 400, 5, &key_locked, NULL);
        else
            {
                display ("\33[2J");

                confgang();

                goto  again;
            }

        break;

 case 'I':
        beep_ack();

        if( config_bits & i_config_mask[1] )
                utimemsg( 400, 5, &key_locked, NULL);
        else
            {
                display ("\33[2J");

                confgins();

                goto again;
            }

        break;


 case 'J':
        beep_ack();

        if( config_bits & i_config_mask[1] )
                utimemsg( 400, 5, &key_locked, NULL);
        else
            {
                display ("\33[2J");
                confgjams();

                goto again;
            }

        break;

 case 'K':
        beep_ack();

        ini_cpr();

        display ("\33[2J");

        return;

        break;
```

```
        case 'X':  /* not a botton */
                break;

        case 'h': /* error */
                goto again;
                break;

        default:
                break;
                } /* End switch */

        } /* End forever */


} /* End confgmenu*/
/*****************************************************************************

                        COPYRIGHT (C)  1985
                BY HARRIS GRAPHICS CORP., CHAMPLAIN, NY
                        ALL RIGHTS RESERVED


Project:        CABCON II

Module:         CONFGSYS.C

Version:        X1

Abstract:       Fluke display to setup system configuration.

Author:         Steve Ent

Created:        11-Sep-85

Modified by:

        Who             Date            Description of Modification
        ---             ----            ---------------------------


*****************************************************************************/
#include <std.h>
#include <config.h>
#include <service.h>
#include <mm85rtc.h>
#include <contextsw.h>
#include <msglog.h>

SECTION( TEXT, 4);              /* prom */
SECTION( DATA, 1);              /* onboard ram */
IDNT( 1,1,"");

IMPORT  TIME_DAY daytime;
IMPORT  TIME_DAY d_sys;
IMPORT  VOID ini_angles();

IMPORT  TBOOL   set_encod;
IMPORT  TBOOL   enc_move;       /* set if encoder is turning */
IMPORT  TBOOL   no_prt_check;
IMPORT  UCOUNT  enc_deg;        /* decimal degrees */
IMPORT  UCOUNT  enc_zero;       /* encoder zero offset */
IMPORT  UCOUNT  cal_offset;     /* caliper offset */
IMPORT  UCOUNT  rot_dir;        /* 0 for CCW rotation or 360 for CW rotation */
IMPORT  UCOUNT  le_to_rg;       /* # of pins from learn eye to reject gate */
IMPORT  UCOUNT  be_to_rg;       /* # of pins from book eye to reject gate */
IMPORT  UCOUNT  hi_cam_off;     /* cam hi offset */
IMPORT  UCOUNT  lo_cam_off;     /* cam lo offset */
IMPORT  TBOOL   cycle_rej;      /* flag to cycle or latch reject gate */
IMPORT  TBOOL   rapid_fire;     /* flag for single or multiple manual reject */
IMPORT  UCOUNT  bk_eye_angle;
IMPORT  UCOUNT  lw_eye_angle;
IMPORT  UCOUNT  lb_eye_angle;
IMPORT  MSG_TBL calof_msg;      /* caliper offset set message */
IMPORT  MSG_TBL hicam_msg;      /* cam hi dwell offset set message */
IMPORT  MSG_TBL rotdir_msg;     /* rotation direction changed message */
IMPORT  MSG_TBL lerg_msg;       /* learn eye to reject gate set message */
IMPORT  MSG_TBL locam_msg;      /* cam lo dwell offset set message */
IMPORT  MSG_TBL berg_msg;       /* book eye to reject gate set message */
IMPORT  MSG_TBL numcp_msg;      /* # of chain pins set message */

IMPORT  UCOUNT          gray_degs[];    /* Table to convert gray_code to degrees */
IMPORT  UCOUNT          enc_inp_deg;    /* Input encoder gray degrees */
IMPORT  UCOUNT          last_enc_deg;
IMPORT  TBOOL           two_up;         /* system in 1up or 2up. */
IMPORT  TBOOL           dsble_2up;
```

```
IMPORT   UTINY  printing;
IMPORT  CONTEXTI  mainstrip;
IMPORT  MSG_TBL  prt_used;
IMPORT  MSG_TBL  prt_err;

IMPORT  HOP_STATION hop_table[];
IMPORT  STAT_TMPLT  sta_stat[];
IMPORT  UCOUNT  num_hoppers;
IMPORT  UCOUNT  num_stations;
IMPORT  UCOUNT  f_i_offset;
IMPORT  TBOOL  start_at_zero;

confgsys()
        {
FAST STAT_TMPLT *p_stat;          /* pointer to station status table. */

COUNT in;                 /* char from fluke input que */
ULONG cnt;                /* flag to update screen */
UCOUNT old_caloff;        /* holds the old value of cal_offset. */
UCOUNT oldletorg;         /* holds the old value of le_to_rg. */
UCOUNT oldbetorg;         /* holds the old value of be_to_rg. */
COUNT n;
                           /*- +++++++++1111111111222222222233333333344444444455555555556
                             1012345678901234567890123456789012345678901234567890123456789 0*/
LOCAL char buttons[] =    {"hXXXXXXXXXXXXAAXXBBXXCCXXXXXXXXXXDDXXEEXXFFXXXXXXXXXXGGXXHHXXII"};

old_caloff = cal_offset;
oldletorg = le_to_rg;
oldbetorg = be_to_rg;

                /* Set up the buttons and the text. */

    again:

        flush_outq();

        ini_fluke();


                /* Row 2 */
        display("\33[2;31HSYSTEM CONFIGURATION");


                /* Row 3 */
        display("\33[3;35HPRESENT ANGLE-");


                /* Row 4 */
        display("\33[4;24H\33[m\33[4;48H\33[m\33[4;72H\33[m");
        display("\33[4;9H\33[8mkdddddddddddd1");
        display("\33[4;33H\33[8mkdddddddddddd1");
        display("\33[4;57H\33[8mkdddddddddddd1");


                /* Row 5 */
        if( !dsble_2up )
                display("\33[5;10H\33[3p9\33[2p    GOTO    \33[3p9\33[2p");
        else
                display("\33[5;10H\33[3p9\33[2p            \33[3p9\33[2p");
        display("\33[5;34H\33[3p9\33[2pLE SERV ANG \33[3p9\33[2p");
        display("\33[5;58H\33[3p9\33[2p   PRINT    \33[3p9\33[2p");


                /* Row 6 */
        display("\33[6;10H\33[3p9\33[2p            \33[3p9\33[2p");
        display("\33[6;34H\33[3p9\33[2p            \33[3p9\33[2p");
        display("\33[6;58H\33[3p9\33[2p LEARN DATA \33[3p9\33[2p");


                /* Row 7 */
        display("\33[7;24H\33[m\33[7;48H\33[m\33[7;72H\33[m");
        display("\33[7;9H\33[8mmddddddddddddn");
display("\33[7;33H\33[8mmddddddddddddn");
display("\33[7;57H\33[8mmddddddddddddn");

        /* Row 8 */
display("\33[8;24H\33[m\33[8;48H\33[m\33[8;72H\33[m");
display("\33[8;9H\33[8mkdddddddddddd1");
display("\33[8;33H\33[8mkdddddddddddd1");
display("\33[8;57H\33[8mkdddddddddddd1");

        /* Row 9 */
display("\33[9;10H\33[3p9\33[2p  LE TO RG  \33[3p9\33[2p");
display("\33[9;34H\33[3p9\33[2p RJCT CYCLE\33[m\33[3p9\33[2p");
display("\33[9;58H\33[3p9\33[2pBE SERV ANG \33[3p9\33[2p");
```

```
        /* Row 10 */
display("\33[10;10H\33[3p9\33[2p              \33[3p9\33[2p");
display("\33[10;34H\33[3p9\33[2p RJCT LATCH\33[m\33[3p9\33[2p");
display("\33[10;58H\33[3p9\33[2p              \33[3p9\33[2p");


        /* Row 11 */
display("\33[11;24H\33[m\33[11;48H\33[m\33[11;72H\33[m");
display("\33[11;9H\33[8mmddddddddddddn");
display("\33[11;33H\33[8mmddddddddddddn");
display("\33[11;57H\33[8mmddddddddddddn");

        /* Row 12 */
display("\33[12;24H\33[m\33[12;48H\33[m\33[12;72H\33[m");
display("\33[12;9H\33[8mkddddddddddddl");
display("\33[12;33H\33[8mkddddddddddddl");
display("\33[12;57H\33[8mkddddddddddddl");

        /* Row 13 */
display("\33[13;10H\33[3p9\33[2p BE TO RG  \33[3p9\33[2p");
display("\33[13;34H\33[3p9\33[2p MULT MANUL\33[m\33[3p9\33[2p");
display("\33[13;58H\33[3p9\33[2p  EXIT     \33[3p9\33[2p");


        /* Row 14 */
display("\33[14;10H\33[3p9\33[2p              \33[3p9\33[2p");
display("\33[14;34H\33[3p9\33[2p SNGL MANUL\33[m\33[3p9\33[2p");
display("\33[14;58H\33[3p9\33[2p              \33[3p9\33[2p");


        /* Row 15 */
display("\33[15;24H\33[m\33[15;48H\33[m\33[15;72H\33[m");
display("\33[15;9H\33[3mmddddddddddddn");
display("\33[15;33H\33[8mmddddddddddddn");
display("\33[15;57H\33[8mmddddddddddddn");

clear_resp();

cnt = 0;                /* flag to update */

FOREVER
        {

if( printing == 6 )
        display( "\33[5;70H\33[m\33[5;59H\33[7m" );
        display( "\33[6;70H\33[m\33[5;59H\33[7m" );
        }
else
        {
        display( "\33[5;70H\33[m\33[5;59H\33[m" );
        display( "\33[6;70H\33[m\33[6;59H\33[m" );
        }


prt_time();

dismsgline();


if(cnt == 0)                            /* update ? */
    {
        up_sys_data();                  /* up date screen */
        cnt = 1;
    }

dspnum( enc_deg, 3, 49, 3);


        /* Read in botton. */

in = response();

switch ((in >= -1 && in <= 60) ? buttons[in+1] : in )
                {
        case 'A':                       /* change 1up/2up */
                if ( dsble_2up )
                        break;
                beep();
                if( enc_move )
                        {
                        display("\33[3;10HYOUR RUNNING!!!");
                        beep();
                        sleep( 25 );
                        beep();
                        sleep( 25 );
                        beep();
                        sleep( 25 );
                        beep();
```

```
        sleep( 25 );
        beep();
        sleep( 50 );
        beep();
        sleep( 50 );
        beep();
        display("\33[3;10H                    ");
        break;
        }
 if(two_up)
        {
        two_up = NO;
        p_stat = &sta_stat[1];
        for(n = 1;n <= num_stations;n++)
                {
                p_stat->odd_even = 0;
   p_stat->flt_offset = p_stat->cpr_1up_off * 2 + p_stat->odd_even;
   p_stat->inh_offset = p_stat->flt_offset + f_i_offset;          /* inhibit offset in # of en
   if( p_stat->ser_2up_angle < p_stat->ver_2up_ang )
           p_stat->inh_offset += 2;
   p_stat++;
   }
        ini_splits();
        schedule( ini_angles, NULL );
        }
else
        {
        two_up = YES;
        for(n = 1;n <= num_stations;n++)
                {
                p_stat = &sta_stat[n];
                p_stat->odd_even = (n + 1) % 2; /* for 2 up set up odd/even stations */
                                                /* must be 1 for even offset. */
                p_stat->flt_offset = p_stat->cpr_2up_off * 2 + p_stat->odd_even;
                p_stat->inh_offset = p_stat->flt_offset + f_i_offset;/* inhibit offset in # of en
                if( p_stat->ser_2up_angle < p_stat->ver_2up_ang )
                        p_stat->inh_offset += 2;
                }
        ini_splits();
        schedule( ini_angles, NULL );
        }
start_at_zero = NO;
cnt = 0;
break;

 case '3':                /* set learn eye angle */
beep();

display("\33[15p");       /* turn off auto repeat */
lw_eye_angle = enc_deg; /* set offset */

cnt = 0;                  /* flag to update */

cpybuf( &d_sys, &daytime, sizeof(daytime));

break;

  case 'C':       /* print the learn data */
beep();
if( !no_prt_check )
        if( !test_printer() )
            {
                utimemsg( 400, 5, &prt_err, NULL);
                break;
            }

if(printing == 6)
    {
        printing = 0;
        break;
    }
if((printing != 0) && (printing != 6))
    {
        utimemsg( 400, 5, &prt_used, NULL);
        break;
    }
         printing = 6;
         start_bg( &mainstrip );

         break;

 case 'D':                /* set learn eye to reject */
         beep();

         display("\33[15p");              /* turn off auto repeat */
         le_to_rg++;                      /* set # of pins */
         if( le_to_rg > 5 )
                 le_to_rg = 0;
         re_ini_tables();                 /* reinitialize angles */
         cnt = 0;                         /* flag for update */
```

```
        cpybuf( &d_sys, &daytime, sizeof(daytime));

        break;

case 'E':                                   /* set reject cycle or latch */
        beep();
        display("\33[15p");                 /* turn off auto repeat */

        cycle_rej = !cycle_rej;

        cnt = 0;
        break;

case 'F':                           /* set good book verify service angle */
        beep();

        display("\33[15p");                 /* turn off auto repeat */
        bk_eye_angle = enc_deg;             /* set offset */

        schedule ( ini_angles,NULL );       /* rebuild service table */

        sleep( 2 );

        cnt = 0;                            /* flag for update */

        cpybuf( &d_sys, &daytime, sizeof(daytime));


        break;

case 'G':                   /* set # of chain pins from book eye to reject gate */
        beep();

        display("\33[15p");         /* turn off auto repeat */
        be_to_rg++;                 /* set # of pins */
        if( be_to_rg > 5 )
                be_to_rg = 0;
        re_ini_tables();                    /* reinitialize angles */
        cnt = 0;                    /* flag to update */

        break;

case 'H':                   /* set multiple or single emanual reject. */
                        beep();
                        display("\33[15p");     /* turn off auto repeat */

                        rapid_fire = !rapid_fire;

                        cnt = 0;                /*.flag to update */

                        break;

                case 'I':
                        beep_ack();
                        if( old_caloff != cal_offset )
                                usys_msg( 0, &calof_msg, NULL);   /* put message in log */
                        if( oldletorg != le_to_rg )
                                usys_msg( 0, &lerg_msg, NULL);   /* put message in log */
                        if( oldbetorg != be_to_rg )
                                usys_msg( 0, &berg_msg, NULL);   /* put message in log */

                        display("\33[15p");

                        display("\33[2J");

                        return;

                        break;


                case 'X':  /* not a botton */
                        break;

                case 'h':  /* error */
                        goto again;
                        break;

                default:
                        break;
                        } /* End switch */


                } /* End forever */


        } /* End confgsys */
```

```
up_sys_data()   /* routine to update screen */
    {

        dspnum(lw_eye_angle,6,39,3);     /* display hi cam offset */

        dspnum(le_to_rg,10,15,3);        /* dispaly # of pins from learn eye to reject gate */

        dspnum(bk_eye_angle,10,64,3);

        if( cycle_rej )
            {
                display("\33[9;35H\33[7m");
                display("\33[10;35H ");
          else
              {
                  display("\33[10;35H\33[7m");
                  display("\33[9;35H ");
              }

          dspnum(be_to_rg,14,15,3);        /* dispaly # of pins from book eye to reject gate */


          if( rapid_fire )
              {
                  display("\33[13;35H\33[7m");
                  display("\33[14;35H ");
              }
          else
              {
                  display("\33[14;35H\33[7m");
                  display("\33[13;35H ");
              }


          if ( !dsble_2up )
              {
                  if( !two_up )
                          display("\33[6;15H2 UP");
                  else
                          display("\33[6;15H1 UP");
              }

          return;

      }


 move_mesage()   /* message for encoder turning */
     {

          display("\33[3;75H\33[m");       /* turn off enhancements */

          display("\33[3;40H\33[5;7mNO CHANGE WHILE ENCODER IS TURNING"); /* dlash message */

          sleep(200);              /* delay */

          display("\33[3;35H\33[OK");      /* clear message */

          return;
  /*****************************************************************************

                          COPYRIGHT (C)  1985
                  BY HARRIS GRAPHICS CORP., CHAMPLAIN, NY
                          ALL RIGHTS RESERVED


  Project:        CABCON II

  Module:         CONFGHOP.C

  Version:        X1

  Abstract:       Fluke display to learn the physical hoppers.

  Author:         Steve Ent

  Created:        16-Sep-85

  Modified by:

          Who             Date            Description of Modification
          ---             ----            ---------------------------


  *****************************************************************************/
```

```
#include <std.h>
#include <config.h>
#include <service.h>


SECTION( TEXT, 4);                /* prom */
SECTION( DATA, 1);                /* onboard ram */
IDNT( 1,1,"display to learn the hoppers.");


        confghop()
        {

IMPORT  HOP_STATION hop_table[];        /* hopper station table */
IMPORT  UCOUNT  num_hoppers;            /* number of hoppers */
HOP_STATION *p_hop;
COUNT in;
ULONG hop_num,sta_num;
UTINY n;

                        /*- +++++++++1111111111222222222233333333334444444444555555555556
                          1012345678901234567890123456789012345678901234567890123456789012345678901234567890*/
LOCAL char buttons[] =  {"hXXXXXXXXXXAAXXXXXXXXXXAAXXXXXXXXXX
```

```
clear_resp();

FOREVER
        {


prt_time();     /* Read in botton. */

dismsgline();

in = response();

switch ((in >= -1 && in <= 60) ? buttons[in+1] : in )
                {
        case 'A':               /* learn hoppers */
                beep();
                display("\33[8;55H\33[1K");     /* clear message */
                display("\33[8;20HLEARNING HOPPERS");   /* flash message */
                lrn_hops();                     /* learn hopper table */
                sleep(200);                     /* delay */
                display("\33[8;55H\33[1K");     /* clear message */
                p_hop = &hop_table[1];          /* set pointer */
                display("\33[8;20HHOPPER     IS AT STATION     "); /* display message */
                for(n = 1;n <= num_hoppers;n++) /* loop through hopper table */
                    {
                        dspnum(p_hop->hopper,8,27,3);   /* display hopper # */
                        dspnum(p_hop->station,8,45,3);  /* display station # */
                        sleep(100);                     /* delay */
                        p_hop++;                        /* increment pointer */
                        if( buttons[response()] == 'B' )
                                break;
                    }
                display("\33[8;55H\33[1K");             /* clear screen */
                display("\33[8;15HHOPPERS LEARNED, EITHER RELEARN OR EXIT."); /* flash  message */
                clear_resp();
                break;

        case 'B':               /* exit */
                beep_ack();

                display("\33[2J");

                return;

                break;

        case 'X':  /* not a botton */
                break;

        case 'h':  /* error */
                goto again;
                break;

        default:
                break;
                } /* End switch */


        } /* End forever */


} /* End confghop */
/*****************************************************************************

                        COPYRIGHT (C)  1985
                BY HARRIS GRAPHICS CORP., CHAMPLAIN, NY
                        ALL RIGHTS RESERVED


Project:        CABCON II

Module:         CONFGRJCT.C

Version:        X1

Abstract:       Fluke display to learn the reject gate service angles.

Author:         Steve Ent

Created:        13-Sep-85

Modified by:

        Who             Date            Description of Modification
        ---             ----            ---------------------------

*****************************************************************************/
```

```
#include <std.h>
#include <config.h>
#include <service.h>
#include <mm85rtc.h>
#include <msglog.h>

SECTION( TEXT, 4);                /* prom */
SECTION( DATA, 1);                /* onboard ram */
IDNT( 1,1,"display to learn reject gate service angles.");


IMPORT  TBOOL  enc_move;          /* set if encoder is turning */
IMPORT  TBOOL  two_up;            /* set if in two up */
IMPORT  TBOOL  rj_lrn_flg;        /* set to learn angles */
IMPORT  TBOOL  rj_done_flg;       /* set when done learning */
IMPORT  UCOUNT num_rj_angles;     /* number of angles (1 up - 2, 2 up - 4) */
IMPORT  UCOUNT rj_num_tries;      /* number of tries before error */
IMPORT  UCOUNT prev_learn[];      /* hold the reject angles while learning. */
IMPORT  RJ_TMPLT rj_one_angles[];/*reject gate angles for 1 up. */
IMPORT  RJ_TMPLT rj_two_angles[];/*reject gate angles for 2 up. */
IMPORT  UCOUNT out_table[];       /* output table */
IMPORT  UCOUNT chg_table[];       /* change table */
IMPORT  UCOUNT i_rjld_mask, i_rjhd_mask;
IMPORT  TBOOL rjstartz;           /* have we passed zero once. */
IMPORT  TBOOL exitdis;                    /* used to exit during learn mode. */
IMPORT  TIME    noexit;                   /* calls exitno after 10sec. */
IMPORT  MSG_TBL abortlrn;                 /* message to operator. */
IMPORT  LONG    exitno();                 /* clears exitdis after 10sec. */
IMPORT  VOID    ini_angles();
IMPORT  TBOOL   fault_flag;

        confgrjct()
        {


COUNT in;
ULONG row;
UTINY n,loop_end;
UCOUNT *p_chgtbl;
RJ_TMPLT *prej_angles;  /* pointer to 1up or 2up angles. */

                        /*- +++++++++111111111122222222223333333333444444444455555555556
                          1012345678901234567890123456789012345678901234567890123456789 0*/
LOCAL char buttons[] =   {"hXXXXXXXXXXAAXXXXXXXXXAAXXXXXXXXXXXXXXXXXXXXXXXXXXXXXBBXXXXXXXXBB"};

settime( &noexit , &exitno, NULL, 900 );
exitdis = 0;

    again:

        flush_outq();

        ini_fluke();

        paint_crt();

        row = 7;
        if( two_up )
        prej_angles = rj_two_angles;
        loop_end = 4;
        }
else
        {
        prej_angles = rj_one_angles;
        loop_end = 2;
        }
for(n = 0;n < loop_end;n++)             /* loop to display angles */
    {
        dspnum(prej_angles->angle,row,31,3);
        prej_angles++;
        row++;
    }

clear_resp();

FOREVER
        {


prt_time();

dismsgline();


        /* Read in button. */

in = response();

switch ((in >= -1 && in <= 60) ? buttons[in+1] : in )
                {
```

```
case 'A':                    /* learn angles */
        beap();
        display("\33[12;55H\33[1K");     /* clear message */
        display("\33[12;18HSTOPPING GATHERER"); /* flash message */
        stop_gath();                              /* stop gatherer  */
        num_rj_angles = 0;                        /* clear # of angles */
        rj_num_tries = 2;                         /* give 2 tries before error */
        prev_learn[0] = 0;
        prev_learn[1] = 0;
        if( !two_up )
                rj_one_angles[0].angle = 0;
        else
                rj_two_angles[0].angle = 0;
        chg_table[0] &= ~i_rjld_mask & ~i_rjhd_mask;/* clear low & high dwell from input */
        rjstartz = 0;                             /* don't start learning until you reach zero. */
        rj_done_flg = NO;                         /* clear done flag */
        rj_lrn_flg = YES;                         /* set learn flag */
        if( !fault_flag )
                fstart_gath();                    /* start gatherer */
        display("\33[12;55H\33[1K");              /* clear message */
        display("\33[12;18HLEARNING ANGLES");     /* flash message */
        while(!rj_done_flg)      /* while learning */
                {
                prt_time();
                dismsgline();

                /* Read in button. */

        in = response();

        switch ((in >= -1 && in <= 60) ? buttons[in+1] : in )
                {
                case 'B':
                        if( exitdis )
                                {
                                if( !fault_flag )
                                        fstop_regath(); /* stop gatherer */
                                rj_done_flg = YES;
                                rj_lrn_flg = NO;
                                ini_ver_angle();
                                uclearline( 5 );
                                return;
                                }
                        else
                                {
                                exitdis = YES;
                                utimemsg( 1000, 5, &abortlrn, NULL );
                                startime( &noexit );
                                }
                        break;

                case 'h':
                        paint_crt();
                        row = 7;
                        if( two_up )
                                prej_angles = rj_two_angles;
                        else
                                prej_angles = rj_one_angles;
                        for(n = 0;n < loop_end;n++)              /* loop to display angles */
                            {
                                dspnum(prej_angles->angle,row,31,3);
                                prej_angles++;
                                row++;
                            }
                        display("\33[12;18HLEARNING ANGLES");    /* flash message */
                        break;

                default:
                        break;
                }
        }
display("\33[12;55H\33[1K");              /* clear message */
display("\33[12;18HSTOPPING GATHERER"); /* flash message */
stop_gath();                              /* stop gatherer */
schedule( ini_angles, NULL );             /* enter angles */
display("\33[12;55H\33[1K");              /* clear message */
row = 7;
if( two_up )
        prej_angles = rj_two_angles;
else
        prej_angles = rj_one_angles;
for(n = 0;n < loop_end;n++)               /* loop to display angles */
    {
        dspnum(prej_angles->angle,row,31,3);
        prej_angles++;
        row++;
```

```
                chg_table[0] &= 0xFF9F;                 /* clear book & learn eye. */
                if( !fault_flag )
                        fstart_gath();                  /* start gatherer */
                display("\33[12;55H\33[1K");            /* clear message */
                display("\33[12;18HANGLES LEARNED! EITHER EXIT OR RELEARN");
                                                /* flash message */
                flush_inq();
                break;

        case 'B':               /* exit */
                beep_ack();

                display("\33[2J");

                return;

                break;

        case 'X':  /* not a botton */
                break;

        case 'h':  /* error */
                goto again;
                break;

        default:
                break;
                } /* End switch */


        } /* End forever */


} /* End confgrjct */
stop_gath()             /* routine to stop the gatherer */
{

IMPORT  UCOUNT  out_table[];


        out_table[0] |= 0x0002;         /* stop the gatherer */
        sleep(200);                     /* delay */


        return;

}

start_gath()            /* routine to start gatherer */
{
IMPORT  UCOUNT  out_table[];

        out_table[0] &= 0xFFFD;         /* start gatherer */
        sleep(200);                     /* message delay */

        return;
fstop_gath()            /* routine to stop the gatherer */
{

IMPORT  UCOUNT  out_table[];
        out_table[0] |= 0x0002;         /* stop the gatherer */
        return;

}

fstart_gath()           /* routine to start gatherer */
{
IMPORT  UCOUNT  out_table[];
        out_table[0] &= 0xFFFD;         /* start gatherer */
        return;

}

fstop_regath()          /* routine to stop the reenable the gatherer. */
{

IMPORT TIME stop_start;

fstop_gath();
startime( &stop_start );
return;
}
```

```
paint_crt()
{
                /* Set up the buttons and the text. */

                /* Row 1 */
        display("\33[1;21HLEARN THE REJECT GATE SERVICE ANGLES");


                /* Row 2 */
        display("\33[2;72H\33[m\33[2;57H\33[8mkddddddddddddl");


                /* Row 3 */
        display("\33[3;58H\33[3p9\33[2p   LEARN    \33[3p9\33[2p");


                /* Row 4 */
        display("\33[4;58H\33[3p9\33[2p    THE     \33[3p9\33[2p");


                /* Row 5 */
        display("\33[5;58H\33[3p9\33[2p   ANGLES   \33[3p9\33[2p");


                /* Row 6 */

        display("\33[6;58H\33[3p9\33[2p            \33[3p9\33[2p");


                /* Row 7 */
        display("\33[7;72H\33[m\33[7;57H\33[8mmddddddddddddn");


                /* Row 10 */
        display("\33[10;72H\33[m\33[10;57H\33[8mkddddddddddddl");


                /* Row 11 */
        display("\33[11;58H\33[3p9\33[2p            \33[3p9\33[2p");


                /* Row 12 */
        display("\33[12;58H\33[3p9\33[2p   EXIT    \33[3p9\33[2p");


                /* Row 13 */
        display("\33[13;58H\33[3p9\33[2p            \33[3p9\33[2p");


                /* Row 14 */
        display("\33[14;58H\33[3p9\33[2p            \33[3p9\33[2p");


                /* Row 15 */
        display("\33[15;72H\33[m\33[15;57H\33[8mmddddddddddddn");


        if(two_up)                      /* if 2 up allow for 4 angles */
                display("\33[6;23H2 UP");

                display("\33[7;20HLATCH UP -     WHITE");

                display("\33[8;18HLATCH DOWN -     WHITE");

                display("\33[9;20HLATCH UP -     BLACK");

                display("\33[10;18HLATCH DOWN -     BLACK");

            }

        else            /* if 1 up allow for 2 angles */
            {
                display("\33[6;23H1 UP");

                display("\33[7;20HLATCH UP - ");

                display("\33[8;18HLATCH DOWN - ");

            }
return;
/*****************************************************************************

                        COPYRIGHT (C)  1985
                BY HARRIS GRAPHICS CORP., CHAMPLAIN, NY
                        ALL RIGHTS RESERVED


Project:        CABCON II
```

```
Module:         CONFGINS.C

Version:        X1

Abstract:       routine to call routine to learn the hopper insertion points.

Author:         Steve Ent

Created:        18-Sep-85

Modified by:

        Who             Date            Description of Modification
        ---             ----            ---------------------------


*****************************************************************************/
#include <std.h>
#include <service.h>
#include <config.h>
#include <mm85rtc.h>
#include <msglog.h>

SECTION( TEXT, 4);              /* prom */
SECTION( DATA, 1);              /* onboard ram */
IDNT( 1,1,"menu to call configuration displays");


        confgins()
        {

IMPORT  LRN_TMPLT  lrn_table[];         /* learn table */
IMPORT  HOP_STATION  hop_table[];       /* hopper to station table */
IMPORT  UCOUNT  out_table[];            /* output table */
IMPORT  UCOUNT  chg_table[];            /* change table */
IMPORT  UCOUNT hop_in_learn;            /* station presently being learned */
IMPORT  UCOUNT num_stations;            /* number of stations */
IMPORT  UCOUNT num_hoppers;             /* number of hoppers */
IMPORT  TBOOL  enc_move;                /* set if encoder is moving */
IMPORT  TBOOL  two_up;                  /* flag, set if in 2up cleared if in 1up */
IMPORT  UCOUNT  fst_hop;                /* first station to be learned */
IMPORT  UCOUNT  lst_hop;                /* last station to be learned */
IMPORT  UCOUNT  fst_stat;
IMPORT  UCOUNT  lst_stat;
IMPORT  TBOOL  strt_counting;
IMPORT  STAT_TMPLT  sta_stat[];
IMPORT  UCOUNT  enc_deg;
IMPORT  TBOOL exitdis;                  /* used to exit during learn mode. */
IMPORT  TIME    noexit;                 /* calls exitno after 10sec. */
IMPORT  MSG_TBL abortlrn;               /* message to operator. */
IMPORT  LONG    exitno();               /* clears exitdis after 10sec. */
IMPORT TIME_DAY     d_1up_lins;         /* time when insertion points were learned of 1up .*/
IMPORT TIME_DAY     d_2up_lins;         /* time when insertion points were learned of 2up .*/
IMPORT TIME_DAY     daytime;
IMPORT VOID     ini_angles();
IMPORT VOID     ini_lrn_cpr();
IMPORT TBOOL    fault_flag;
IMPORT MSG_TBL  rusure;                 /* ARE YOU SURE HIT AGAIN, HIT ANY OTHER BUTTON TO ABORT.

LRN_TMPLT  *p_lrn,*p_lrn2;
HOP_STATION *p_hop;
STAT_TMPLT  *p_stat;
COUNT in;
ULONG cnt;
LOCAL TBOOL firsthit = 0;

                        /*- +++++++++111111111122222222223333333333444444444455555555556
                          1012345678901234567890123456789012345678901234567890123456789*/
LOCAL char buttons[] =  {"hXXXXXbbXXaaXXXXbbXXaaXXXXXXXXXXXXAAXXBBXXCCXXXXXXXXXXDDXXEEXXFF"};


settime( &noexit , &exitno, NULL, 900 );
exitdis = 0;
firsthit = 0;

p_hop = &hop_table[1];
fst_hop = p_hop->hopper;                /* display hopper 1 for first */
fst_stat = p_hop->station;      /* station for hopper 1 */
p_hop = &hop_table[num_hoppers];
lst_hop = p_hop->hopper;                /* display last hopper for last station */
lst_stat = p_hop->station;              /* last station */

p_hop = &hop_table[1];


                /* Set up the buttons and the text. */
    again:
```

```
flush_outq();

ini_fluke();

paintcrt();

cnt = 0;

clear_resp();

dspnum(p_hop->hopper,7,19,3);            /* display hopper number */

FOREVER
        {


prt_time();

dismsgline();

dspnum( enc_deg, 1, 20, 3);

if(cnt == 0)     /* if update flag */
    {
        up_con_hop();    /* update screen */
        cnt = 1;
    }


/* Read in botton. */

in = response();

switch ((in >= -1 && in <= 60) ? buttons[in+1] : in )
            {
        case 'a':                /* station diagnostic display */
                beep();
                if( firsthit )
                        {
                        firsthit = 0;
                        uclearline( 5 );
                        display("\33[5;36H\33[m");
                        display("\33[6;36H\33[m");
                        break;
                        }
                uclearline( 5 );
        diagstat();
        goto again;
        break;

case 'b':                /* auto learn insertions */
        beep();

        display("\33[5;44H\33[m\33[5;36H\33[7m");
        display("\33[6;44H\33[m\33[6;36H\33[7m");
        if( firsthit )
                {
                auto_ins();
                firsthit = 0;
                uclearline( 5 );
                display("\33[5;36H\33[m");
                display("\33[6;36H\33[m");
                break;
                }
        else
                {
                usys_msg( 5, &rusure, NULL );
                firsthit = 1;
                }
        break;

case 'A':                /* increment number */
        beep();
        if( firsthit )
                {
                firsthit = 0;
                uclearline( 5 );
                display("\33[5;36H\33[m");
                display("\33[6;36H\33[m");
                break;
                }
        display("\33[14p");                     /* turn on auto repeat */
        if(p_hop == &hop_table[num_hoppers])    /* if last number */
                p_hop = &hop_table[1];                  /* number is zero */
        else                                    /* if not */
                p_hop++;                /* increment number */
        dspnum(p_hop->hopper,7,19,3);   /* display new number */
        break;
```

```
case 'B':                /* set first hopper */
        beep();
        if( firsthit )
                {
                firsthit = 0;
                uclearline( 5 );
                display("\33[5;36H\33[m");
                display("\33[6;36H\33[m");
                break;
                }
        display("\33[15p");      /* turn off auto repeat */

        fst_hop = p_hop->hopper;         /* save display number */
        fst_stat = p_hop->station;       /* load station number */
        cnt = 0;                         /* flag to update */

        break;
case 'C':                /* learn hopper insertion points */
        beep();
        if( firsthit )
                {
                firsthit = 0;
                uclearline( 5 );
                display("\33[5;36H\33[m");
                display("\33[6;36H\33[m");
                break;
                }
        display("\33[15p");      /* turn off auto repeat */
        if(lst_stat < fst_stat)
            {
                display("\33[3;23HINVALID FIRST TO LAST");
                sleep(200);
                display("\33[3;1H\33[2K");
                break;
            }
        p_lrn = &lrn_table[0];
        display("\33[3;1H\33[2K");       /* clear message area */
        display("\33[3;3HSTOPPING GATHERER");   /* flash message */
        stop_gath();                             /* stop gatherer */
        strt_counting = NO;                      /* clear # done */
        chg_table[0] &= 0XFF9F;                  /* clear learn & book eyes. */
        semaphore();
        ini_lrn_cpr();                           /* initialize the hop_serv_table for learn */
        end_semaphore();
        if( !fault_flag )
                fstart_gath();                   /* start gatherer */
        display("\33[3;1H\33[2K");               /* clear message */
        display("\33[3;3HHOPPER    IS BEING LEARNED"); /* display message */
        display("\33[4;3H     CHAIN PINS FROM LE.");
        while( !p_lrn->set_ins_pt )      /* while learning */
            {
                p_stat = &sta_stat[hop_in_learn];
                dspnum(p_stat->hopper,3,10,3);  /* display hopper number being learned */
                p_lrn2 = &lrn_table[hop_in_learn];
                if( two_up )
                        dspnum(p_lrn2->num_2up_pins,4,3,3);
                else
                        dspnum(p_lrn2->num_1up_pins,4,3,3);
                dismsgline();
                dspnum( enc_deg, 1, 20, 3);
                prt_time();

                /* Read in botton. */

                in = response();

                switch ((in >= -1 && in <= 60) ? buttons[in+1] : in )
                        {
                        case 'F':
                                if( exitdis )
                                        {
                                        if( !fault_flag )
                                                fstop_regath();          /* stop gatherer */
                                        schedule( ini_angles, NULL );    /* setup the service table */
                                        p_lrn->set_ins_pt = YES;/* indicate all completed */
                                        hop_in_learn = 0;
                                        strt_counting = NO;
                                        re_ini_tables();         /* re initialize tables (sta.stat) */
                                        if( two_up )
                                                cpybuf( &d_2up_lins, &daytime, sizeof(daytime));
                                        else
                                                cpybuf( &d_1up_lins, &daytime, sizeof(daytime));
                                        uclearline( 5 );
                                        return;
                                        }
                                else
                                        {
                                        exitdis = YES;
```

```
                                utimemsg( 1000, 5, &abortlrn, NULL );
                                startime( &noexit );
                                }
                        break;

                case 'h':
                        paintcrt();
                        display("\33[3;3HHOPPER     IS BEING LEARNED"); /* display message */
                        display("\33[4;3H     CHAIN PINS FROM LE.");
                        up_con_hop();   /* update screen */
                        dspnum(p_hop->hopper,7,19,3);   /* display new number */
                        break;

                default:
                        break;
                }
        }
    schedule( ini_angles, NULL );   /* setup the service table */
    sleep( 200 );
    if( !fault_flag )
            fstart_gath();                  /* start gatherer */
    display("\33[3;1H\33[2K");              /* clear message */
    display("\33[4;32H\33[1K");             /* clear message */
    display("\33[3;3HLEARN MORE INSERTION POINTS OR EXIT"); /* flash message */
    clear_resp();           /* clear any touches made while learning */
    break;

case 'O':               /* decrement number */
    beep();
    if( firsthit )
            {
            firsthit = 0;
            uclearline( 5 );
            display("\33[5;36H\33[m");
            display("\33[6;36H\33[m");
            break;
            }
    display("\33[14p");                             /* turn on auto repeat */
    if(p_hop == &hop_table[1])                      /* if num is zero */
            p_hop = &hop_table[num_hoppers];        /* set to last hopper number */
    else                    /* if not */
            p_hop--;        /* decrement */
    dspnum(p_hop->hopper,7,19,3);   /* display new number */
    break;

case 'E':               /* set last hopper to be learned */
    beep();
    if( firsthit )
            {
            firsthit = 0;
            uclearline( 5 );
            display("\33[5;36H\33[m");
            display("\33[6;36H\33[m");
            break;
            }
            display("\33[15p");     /* turn off auto repeat */

            lst_hop = p_hop->hopper;        /* save number to be displayed */
            lst_stat = p_hop->station;      /* enter station number */
            cnt = 0;                        /* flag to update */

            break;

    case 'F':               /* exit */
            beep_ack();
            uclearline( 5 );
            display("\33[15p");     /* turn off auto repeat */
            display("\33[2J");      /* clear the screen */

            return;                 /* return to confgmenu */

            break;

    case 'X':  /* not a botton */
            break;

    case 'h':  /* error */
            goto again;
            break;

    default:
            break;
            } /* End switch */


    } /* End forever */


} /* End confgang */
```

```
LOCAL paintcrt()
{

            /* Row 1 */
        display("\33[1;1HENCODER ANGLE - \33[1;26HLEARN HOPPER INSERTION POINTS");

            /* Row 4 */
        display("\33[4;72H\33[m");
        display("\33[4;33H\33[8mkddddddddddddl");
        display("\33[4;57H\33[8mkddddddddddddl");


            /* Row 5 */
        display("\33[5;34H\33[3p9\33[2p   AUTO     \33[3p9\33[2p");
        display("\33[5;58H\33[3p9\33[2p  STATION   \33[3p9\33[2p");


            /* Row 6 */
        display("\33[6;34H\33[3p9\33[2p   LEARN    \33[3p9\33[2p");
        display("\33[6;58H\33[3p9\33[2p DIAGNOSTIC \33[3p9\33[2p");


            /* Row 7 */
        display("\33[7;72H\33[m");
        display("\33[7;11HNUMBER-[   ]");
        display("\33[7;33H\33[8mmddddddddddddn");
        display("\33[7;57H\33[8mmddddddddddddn");


            /* Row 8 */
        display("\33[8;24H\33[m\33[8;48H\33[m\33[8;72H\33[m");
        display("\33[8;9H\33[8mkddddddddddddl");
        display("\33[8;33H\33[8mkddddddddddddl");
        display("\33[8;57H\33[8mkddddddddddddl");


            /* Row 9 */
        display("\33[9;10H\33[3p9\33[2p    INC     \33[3p9\33[2p");
        display("\33[9;34H\33[3p9\33[2p FIRST HOP  \33[3p9\33[2p");
        display("\33[9;58H\33[3p9\33[2p   LEARN    \33[3p9\33[2p");


            /* Row 10 */
        display("\33[10;10H\33[3p9\33[2p    NUM     \33[3p9\33[2p");
        display("\33[10;34H\33[3p9\33[2p            \33[3p9\33[2p");
        display("\33[10;58H\33[3p9\33[2p   POINTS   \33[3p9\33[2p");


            /* Row 11 */
        display("\33[11;24H\33[m\33[11;48H\33[m\33[11;72H\33[m");
        display("\33[11;9H\33[8mmddddddddddddn");
        display("\33[11;33H\33[8mmddddddddddddn");
        display("\33[11;57H\33[8mmddddddddddddn");


            /* Row 12 */
        display("\33[12;24H\33[m\33[12;48H\33[m\33[12;72H\33[m");
        display("\33[12;9H\33[8mkddddddddddddl");
        display("\33[12;33H\33[8mkddddddddddddl");
        display("\33[12;57H\33[8mkddddddddddddl");
            /* Row 13 */
        display("\33[13;10H\33[3p9\33[2p    DEC     \33[3p9\33[2p");
        display("\33[13;34H\33[3p9\33[2p  LAST HOP  \33[3p9\33[2p");
        display("\33[13;58H\33[3p9\33[2p    EXIT    \33[3p9\33[2p");
            /* Row 14 */
        display("\33[14;10H\33[3p9\33[2p    NUM     \33[3p9\33[2p");
        display("\33[14;34H\33[3p9\33[2p            \33[3p9\33[2p");
        display("\33[14;58H\33[3p9\33[2p            \33[3p9\33[2p");
            /* Row 15 */
        display("\33[15;24H\33[m\33[15;48H\33[m\33[15;72H\33[m");
        display("\33[15;9H\33[8mmddddddddddddn");
        display("\33[15;33H\33[8mmddddddddddddn");
        display("\33[15;57H\33[8mmddddddddddddn");
return;
}       /* end paintcrt. */
/*****************************************************

        function noexit()

*****************************************************/

exitno()

{
exitdis = 0;
return;
```

```
auto_ins()
{
IMPORT  LRN_TMPLT  lrn_table[];
IMPORT  STAT_TMPLT  sta_stat[];
IMPORT  UCOUNT be_to_rg, le_to_rg;
IMPORT  TBOOL   two_up;
IMPORT  VOID    iniangles();
IMPORT  UCOUNT  fst_hop;                /* first station to be learned */
IMPORT  UCOUNT  lst_hop;                /* last station to be learned */
IMPORT  MSG_TBL bad_entry;

LRN_TMPLT  *p_learn;
LONG    difspace;       /* differance in spaces between fst_jam and lst_jam */
LONG    difangle;       /* differance in angles between fst_jam and lst_jam */
LONG    deg_stat;       /* number of degrees of encoder rotation between jams. */
LONG    totaldeg;       /* number of degrees between jam 1 and jam j. */
LONG    numspace;       /* number of spaces between jam 1 and jam j. */
LONG    diff;           /* difference between learned angle and calculated angle */
LONG    statangle;      /* angle that jam j should be service at. */
COUNT   j;
COUNT   temp_offset;


if( fst_hop >= lst_hop )
        {
        utimemsg( 400, 6, &bad_entry, NULL );
        return;
        }

temp_offset = be_to_rg + le_to_rg;

if( !two_up )
        {
        difspace = lrn_table[lst_stat].num_1up_pins - lrn_table[fst_stat].num_1up_pins;
        difangle = lrn_table[lst_stat].init_1up_angle - lrn_table[fst_stat].init_1up_angle;
        deg_stat = ((difspace * 360) - difangle) / ( lst_stat - fst_stat );

        for( j = lst_stat - 1; j > fst_stat ; j-- )
                {
                totaldeg = ((lst_stat - j ) * deg_stat) + lrn_table[lst_stat].init_1up_angle;
                numspace = totaldeg / 360;
                statangle = totaldeg % 360;
                diff = statangle - lrn_table[j].init_1up_angle;
                if (diff > 0 )
                        {
                        if( diff > 180 )
                                numspace++;
                        }
                else
                        {
                        if( diff < -180 )
                                numspace--;
                        }
                p_learn = &lrn_table[j];
                p_learn->num_1up_pins = lrn_table[lst_stat].num_1up_pins - numspace;
/*              sta_stat[j].ser_1up_angle = p_learn->init_1up_angle = statangle;*/
                }
        }
else
        {
        difspace = lrn_table[lst_stat].num_2up_pins - lrn_table[fst_stat].num_2up_pins;
        difangle = lrn_table[lst_stat].init_2up_angle - lrn_table[fst_stat].init_2up_angle;
        deg_stat = ((difspace * 360) - difangle) / ( lst_stat - fst_stat );

        for( j = lst_stat - 1; j > fst_stat ; j-- )
                {
                totaldeg = ((lst_stat - j ) * deg_stat) + lrn_table[lst_stat].init_2up_angle;
                numspace = totaldeg / 360;
                statangle = totaldeg % 360;
                diff = statangle - lrn_table[j].init_2up_angle;
                if (diff > 0 )
                        {
                        if( diff > 180 )
                                numspace++;
                        }
                else
                        {
                        if( diff < -180 )
                                numspace--;
                        }
                p_learn = &lrn_table[j];
                p_learn->num_2up_pins = lrn_table[lst_stat].num_2up_pins - numspace;
/*              sta_stat[j].ser_2up_angle = p_learn->init_2up_angle = statangle;*/
                }
        }
schedule( ini_angles, NULL );
re_ini_tables();
return;
}
```

```
/*****************************************************************************

                    COPYRIGHT (C)  1985
            BY HARRIS GRAPHICS CORP., CHAMPLAIN, NY
                    ALL RIGHTS RESERVED


Project:        CABCON II

Module:         CONFGANG.C

Version:        X1

Abstract:       routine to call routine to learn the hopper service angles.

Author:         Steve Ent

Created:        18-Sep-85

Modified by:

        Who             Date            Description of Modification
        ---             ----            ---------------------------

*****************************************************************************/
#include <std.h>
#include <service.h>
#include <config.h>
#include <mm85rtc.h>
#include <msglog.h>


SECTION( TEXT, 4);              /* prom */
SECTION( DATA, 1);              /* onboard ram */
IDNT( 1,1,"menu to call configuration displays");



        confgang()
        {

IMPORT  LRN_TMPLT  lrn_table[];         /* learn table */
IMPORT  STAT_TMPLT sta_stat[];          /* station status table. */
IMPORT  HOP_STATION  hop_table[];       /* hopper to station table */
IMPORT  UCOUNT  out_table[];            /* output table */
IMPORT  TBOOL  ang_lrn_flg;             /* flag to learn hopper service angles */
IMPORT  UCOUNT num_hoppers;             /* number of hoppers */
IMPORT  TBOOL  enc_move;                /* set if encoder is moving */
IMPORT  UCOUNT  enc_deg;                /* the angle of the encoder. */
IMPORT  TBOOL  two_up;                  /* flag set if in 2up cleared if in 1up */
IMPORT  UCOUNT  fst_hop;                /* first station to be learned */
IMPORT  UCOUNT  lst_hop;                /* last station to be learned */
IMPORT  UCOUNT  fst_stat;
IMPORT  UCOUNT  lst_stat;
IMPORT  UCOUNT  num_completed;          /* number of stations learned */
IMPORT TIME_DAY d_1up_langles;          /* when the 1up angles were learned. */
IMPORT TIME_DAY d_2up_langles;          /* when the 2up angles were learned. */
IMPORT TIME_DAY     daytime;
IMPORT  TBOOL exitdis;                  /* used to exit during learn mode. */
IMPORT  TIME    noexit;                 /* calls exitno after 10sec. */
IMPORT  MSG_TBL abortlrn;               /* message to operator. */
IMPORT  LONG    exitno();               /* clears exitdis after 10sec. */
IMPORT  TBOOL   fault_flag;

LRN_TMPLT  *p_lrn;
HOP_STATION *p_hop;
COUNT in;
ULONG cnt;
UTINY  n;


                        /*- +++++++++1111111111222222222233333333334444444444555555555556
                          1012345678901234567890123456789012345678901234567890123456789O*/
LOCAL char buttons[] =  {"hXXXXXXXXXaaXXXXXXXXXaaXXXXXXXXXAAXXBBXXCCXXXXXXXXXXDDXXEEXXFF"};

settime( &noexit , &exitno, NULL, 900 );
exitdis = 0;

p_hop = &hop_table[1];
fst_hop = p_hop->hopper;                        /* display hopper 1 for first */
fst_stat = p_hop->station;                      /* station for hopper 1 */
```

```
p_hop = &hop_table[num_hoppers];
lst_hop = p_hop->hopper;                    /* display last hopper for last station */
lst_stat = p_hop->station;                  /* last station */
p_hop = &hop_table[1];

            /* Set up the buttons and the text. */
    again:

        paintcrt();

        cnt = 0;


        clear_resp();

        dspnum(p_hop->hopper,7,19,3);       /* display number */

        FOREVER
            {


        dismsgline();

        dspnum( enc_deg, 1, 20, 3);         /* display encoder angle. */

        prt_time();

        if(cnt == 0)                                /* if update flag */
            {
                up_con_hop();                       /* update screen */
                cnt = 1;
            }


            /* Read in botton. */

        in = response();

        switch ((in >= -1 && in <= 60) ? buttons[in+1] : in )
                {
            case 'a':               /* station diagnostic display */
                beep();
                diagstat();
                goto again;
                break;

            case 'A':                                       /* increment number */
                beep();
                display("\33[14p");                         /* turn on auto repeat */
                if(p_hop == &hop_table[num_hoppers])        /* if last number */
                        p_hop = &hop_table[1];              /* number is zero */
                else                                        /* if not */
                        p_hop++;                            /* increment number */
                dspnum(p_hop->hopper,7,19,3);               /* display new number */
                break;

            case 'B':                                       /* set first hopper */
                beep();
                display("\33[15p");                         /* turn off auto repeat */

        fst_hop = p_hop->hopper;        /* save display number */
        fst_stat = p_hop->station;      /* load station number */
        cnt = 0;                        /* flag to update */

        break;

case 'C':                               /* learn hopper service angles */
        beep();
        display("\33[15p");                     /* turn off auto repeat */
        display("\33[3;1H\33[2K");              /* clear message area */
        p_lrn = &lrn_table;                     /* set up learn table pointer */
        display("\33[3;23HSTOPPING GATHERER");  /* flash message */
        stop_gath();                            /* stop gatherer */
        p_lrn->set_angle = NO;                  /* clear done flag */
        num_completed = 0;                      /* clear # done */
        set_ang_table();                        /* setup angle table */
        ang_lrn_flg = YES;                      /* set learn flag */
        if( !fault_flag )
                fstart_gath();                  /* start gatherer */
        display("\33[3;1H\33[2K");              /* clear message */
        display("\33[3;23HLEARNING HOPPER SERVICE ANGLES");     /* display message */
        while( ang_lrn_flg ) /* while learning */
                {
                dismsgline();
                prt_time();
                dspnum( enc_deg, 1, 20, 3);             /* display encoder angle. */
                /* Read in botton. */
```

```
                in = response();

                switch ((in >= -1 && in <= 60) ? buttons[in+1] : in )
                        {
                        case 'F':
                                if( exitdis )
                                        {
                                        if( !fault_flag )
                                                fstop_regath(); /* stop gatherer */
                                        lrn_table[0].set_angle = YES;
                                        ang_lrn_flg = NO;
                                        ini_angles();
                                        uclearline( 5 );
                                        return;
                                        }
                                else
                                        {
                                        exitdis = YES;
                                        utimemsg( 1000, 5, &abortlrn, NULL );
                                        startime( &noexit );
                                        }
                                break;

                        case 'h':
                                paintcrt();
                                up_con_hop();   /* update screen */
                                dspnum(p_hop->hopper,7,19,3);   /* display new number */
                                break;

                        default:
                                break;
                        }
        display("\33[3;1H\33[2K");              /* clear message */
        display("\33[3;27HHOPPERS LEARNED");    /* flash message */
        dspnum(num_completed,3,23,3);           /* display number */
        fstop_gath();
        dismsgline();
        prt_time();
        if( two_up )
                for ( n = fst_stat; n <= lst_stat; n++ )
                        {
                        lrn_table[n].init_2up_angle = sta_stat[n].ser_2up_angle;
                        lrn_table[n].ver_2up_angle = sta_stat[n].ver_2up_ang;
                        cpybuf( &d_2up_langles, &daytime, sizeof(daytime));
                        }
        else
                for ( n = fst_stat; n <= lst_stat; n++ )
                        {
                        lrn_table[n].init_1up_angle = sta_stat[n].ser_1up_angle;
                        lrn_table[n].ver_1up_angle = sta_stat[n].ver_1up_ang;
                        cpybuf( &d_1up_langles, &daytime, sizeof(daytime));
                        }
        if( !fault_flag )
                start_gath();                   /* start gatherer */

        display("\33[3;1H\33[2K");
        display("\33[3;23HEITHER LEARN MORE ANGLES OR EXIT"); /* flash message */
        clear_resp();           /* clear any touches made while learning */
        break;

case 'D':               /* decrement number */
        beep();
        display("\33[14p");                     /* turn on auto repeat */
        if(p_hop == &hop_table[1])              /* if num is zero */
                p_hop = &hop_table[num_hoppers];                /* set to last hopper number */
        else                                    /* if not */
                p_hop--;                        /* decrement */
        dspnum(p_hop->hopper,7,19,3);           /* display new number */
        break;

case 'E':                                       /* set last hopper to be learned */
        beep();
        display("\33[15p");                     /* turn off auto repeat */

        lst_hop = p_hop->hopper;                /* save number to be displayed */
        lst_stat = p_hop->station;              /* enter station number */
        cnt = 0;                                /* flag to update */

        break;

case 'F':               /* exit */
        beep_ack();
        display("\33[15p");                     /* turn off auto repeat */
        display("\33[2J");                      /* clear the screen */

        return;                                 /* return to confgmenu */

        break;

case 'X':                                       /* not a botton */
        break;
```

```
                case 'h':                                        /* error */
                        goto again;
                        break;

                default:
                        break;
                        }                                        /* End switch */

                }                                                /* End forever */


        }                                                        /* End confgang */

up_con_hop()                                /* update screen */
{

IMPORT UCOUNT fst_hop;                                           /* first hopper */
IMPORT UCOUNT lst_hop;                                           /* last hopper */

        dspnum(fst_hop,10,39,3);                                 /* display first */

        dspnum(lst_hop,14,39,3);                                 /* display last */

        return;

}


LOCAL  paintcrt()
{
        flush_outq();

        ini_fluke();


                /* Row 1 */
        display("\33[1;1HENCODER ANGLE - \33[1;26HLEARN HOPPER SERVICE ANGLES");

                /* Row 4 */
        display("\33[4;72H\33[m");
        display("\33[4;57H\33[8mkdddddddddddd1");

                /* Row 5 */
        display("\33[5;58H\33[3p9\33[2p  STATION   \33[3p9\33[2p");

                /* Row 6 */
        display("\33[6;58H\33[3p9\33[2p DIAGNOSTIC \33[3p9\33[2p");

                /* Row 7 */
        display("\33[7;72H\33[m");
        display("\33[7;11HNUMBER-[   ]");
        display("\33[7;57H\33[8mmddddddddddddn");
                /* Row 8 */
        display("\33[8;24H\33[m\33[8;48H\33[m\33[8;72H\33[m");
        display("\33[8;9H\33[8mkdddddddddddd1");
        display("\33[8;33H\33[8mkdddddddddddd1");
        display("\33[8;57H\33[8mkdddddddddddd1");


                /* Row 9 */
        display("\33[9;10H\33[3p9\33[2p     INC      \33[3p9\33[2p");
        display("\33[9;34H\33[3p9\33[2p FIRST HOP  \33[3p9\33[2p");
        display("\33[9;58H\33[3p9\33[2p   LEARN    \33[3p9\33[2p");


                /* Row 10 */
        display("\33[10;10H\33[3p9\33[2p     NUM      \33[3p9\33[2p");
        display("\33[10;34H\33[3p9\33[2p              \33[3p9\33[2p");
        display("\33[10;58H\33[3p9\33[2p   ANGLES    \33[3p9\33[2p");


                /* Row 11 */
        display("\33[11;24H\33[m\33[11;48H\33[m\33[11;72H\33[m");
        display("\33[11;9H\33[8mmddddddddddddn");
        display("\33[11;33H\33[8mmddddddddddddn");
        display("\33[11;57H\33[8mmddddddddddddn");


                /* Row 12 */
        display("\33[12;24H\33[m\33[12;48H\33[m\33[12;72H\33[m");
        display("\33[12;9H\33[8mkdddddddddddd1");
        display("\33[12;33H\33[8mkdddddddddddd1");
        display("\33[12;57H\33[8mkdddddddddddd1");
```

```
        /* Row 13 */
display("\33[13;10H\33[3p9\33[2p     DEC      \33[3p9\33[2p");
display("\33[13;34H\33[3p9\33[2p  LAST HOP  \33[3p9\33[2p");
display("\33[13;58H\33[3p9\33[2p     EXIT     \33[3p9\33[2p");


        /* Row 14 */
display("\33[14;10H\33[3p9\33[2p     NUM      \33[3p9\33[2p");
display("\33[14;34H\33[3p9\33[2p              \33[3p9\33[2p");
display("\33[14;58H\33[3p9\33[2p              \33[3p9\33[2p");


        /* Row 15 */
display("\33[15;24H\33[m\33[15;48H\33[m\33[15;72H\33[m");
display("\33[15;9H\33[8mmddddddddddddn");
display("\33[15;33H\33[8mmddddddddddddn");
display("\33[15;57H\33[8mmddddddddddddn");

/*****************************************************************************

                    COPYRIGHT (C)  1985
            BY HARRIS GRAPHICS CORP., CHAMPLAIN, NY
                    ALL RIGHTS RESERVED


Project:        CABCON II

Module:         CONFGJAMS.C

Version:        X1

Abstract:       routine to call routine to learn the jam switches.

Author:         Steve Ent

Created:        23-Sep-85

Modified by:

        Who             Date            Description of Modification
        ---             ----            ---------------------------


*****************************************************************************/

#include <std.h>
#include <config.h>
#include <service.h>
#include <mm85rtc.h>
#include <msglog.h>

SECTION( TEXT, 4);              /* prom */
SECTION( DATA, 1);              /* onboard ram */
IDNT( 1,1,"menu to call configuration displays");


IMPORT  UCOUNT  lst_jam;
IMPORT  UCOUNT  fst_jam;

        confgjams()
        {

IMPORT  UCOUNT  out_table[];            /* output table */
IMPORT  JAM_TMPLT  jam_table[];
IMPORT  TBOOL  jam_lrn_flg;             /* flag to learn hopper service angles */
IMPORT  UCOUNT jam_in_learn;            /* station presently being learned */
IMPORT  UCOUNT num_stations;            /* number of stations */
IMPORT  UCOUNT num_hoppers;             /* number of hoppers */
IMPORT  TBOOL  enc_move;                /* set if encoder is moving */
IMPORT  UCOUNT num_completed;
IMPORT  UCOUNT  active_sections;
IMPORT  UCOUNT  enc_deg;
IMPORT  TBOOL exitdis;                  /* usad to exit during learn mode. */
IMPORT  TIME    noexit;                 /* calls exitno after 10sec. */
IMPORT  MSG_TBL abortlrn;               /* message to operator. */
IMPORT  LONG    exitno();               /* clears exitdis after 10sec. */
IMPORT  VOID    ini_angles();           /* sets up hopserv table. */
IMPORT  TBOOL   fault_flag;             /* turn when a hopper is faulted. */
IMPORT  MSG_TBL rusure;         /* ARE YOU SURE HIT AGAIN, HIT ANY OTHER BOTTON TO ABORT. */

JAM_TMPLT  *p_jam;
JAM_TMPLT  *p_jam2;
COUNT in;
ULONG cnt,num;
UTINY  n;
UCOUNT  last_swi;
LOCAL  TBOOL    firsthit = 0;

                        /*- +++++++++1111111111222222222233333333334444444444555555555556
                          1012345678901234567890123456789012345678901234567890123456789012345678901234567890*/
LOCAL char buttons[] =  {"hXXXXXbbXXaaXXXXbbXXaaXXXXXXXXXXAAXXBBXXCCXXXXXXXXXXDDXXEEXXFF"};
```

```
settime( &noexit , &exitno, NULL, 900 );
exitdis = 0;
firsthit = 0;

num = 0;
fst_jam = 1;
last_swi = (active_sections - 1) * 2;   /* display last hopper for last station */
lst_jam = last_swi;


            /* Set up the buttons and the text. */
again:

    paintcrt();

    cnt = 0;

    clear_resp();

    dspnum(num,7,19,3);              /* display number */

    FOREVER
            {


    prt_time();

    dismsgline();

    dspnum( enc_deg, 1, 20, 3);

    if(cnt == 0)    /* if update flag */
        {
            up_con_jam();   /* update screen */
            cnt = 1;
        }


    /* Read in botton. */

    in = response();

    switch ((in >= -1 && in <= 60) ? buttons[in+1] : in )
                {
            case 'a':                /* jam diagnostic display */
                    beep();
                    if( firsthit )
                            {
                            firsthit = 0;
                            uclearline( 5 );
                            display("\33[5;36H\33[m");
                            display("\33[6;36H\33[m");
                            break;
                            }
                    uclearline( 5 );
                    diagjams();
                    goto again;
                    break;

            case 'b':                /* Auto learn */
                    beep();
                    display("\33[5;44H\33[m\33[5;36H\33[7m");
                    display("\33[6;44H\33[m\33[6;36H\33[7m");
                    if( firsthit )
                            {
                            cal_jams();
                            firsthit = 0;
                            uclearline( 5 );
                            display("\33[5;36H\33[m");
                            display("\33[6;36H\33[m");
                            }
        else
                {
                usys_msg( 5, &rusure, NULL );
                firsthit = 1;
                }
        break;

case 'A':               /* increment number */
        beep();
        if( firsthit )
                {
                firsthit = 0;
                uclearline( 5 );
                display("\33[5;36H\33[m");
                display("\33[6;36H\33[m");
                break;
                }
```

```
        display("\33[14p");      /* turn on auto repeat */
        if(num == last_swi)      /* if last number */
                num = 0;         /* number is zero */
        else                     /* if not */
                num++;           /* increment number */
        dspnum(num,7,19,3);      /* display new number */
        break;

case 'B':                /* set first jam switch */
        beep();
        if( firsthit )
                {
                firsthit = 0;
                uclearline( 5 );
                display("\33[5;36H\33[m");
                display("\33[6;36H\33[m");
                break;
                }
        display("\33[15p");      /* turn off auto repeat */
        if(num == 0)             /* if hopper # is zero */
                cj_no_jam();     /* flash error mesage */
        else                     /* if not */
            {
                fst_jam = num;                  /* save display number */
                cnt = 0;                        /* flag to update */
            }
        break;

case 'C':                /* learn jam switches */
        beep();
        if( firsthit )
                {
                firsthit = 0;
                uclearline( 5 );
                display("\33[5;36H\33[m");
                display("\33[6;36H\33[m");
                break;
                }
        display("\33[15p");

        display("\33[3;1H\33[2K");      /* clear message area */
        if(lst_jam < fst_jam)
            {
```

APPENDIX B

```
/*****************************************************************************

                    COPYRIGHT (C)  1985
            BY HARRIS GRAPHICS CORP., CHAMPLAIN, NY
                    ALL RIGHTS RESERVED

Project:        CABCON II

Module:         initables

Version:        X1

Abstract:       Initialize pointers, offsets, and parameters of operation tables

Author:         T. Rowe

Created:        23-Apr_85

Modified by:

        Who         Date        Description of Modification
        ---         ----        ---------------------------
        S.E.        14-May-85   addition of scan routine loop counters

        T.R.        7-JUN-85    change gray_degs table for 0 deg reading
                                if encoder is rotating reverse.

        S.E.        23-July-85  Added inisplits(); to initialize the
                                split table and used hopper data.
*****************************************************************************/
```

```
/*****************************************************************

Function:       ini_tables()

        This rountine is called from the setup routine at power up
        and it sets all the offsets, addresses, and mk-rdy default
        parameters.

    1.  The table sta_stat (typedef defined in SERVICE.H) contains enough
        room for 124 hoppers. Each type is 40 words long. The first station
        starts in the second set, making indexing a multiple of the
        station number. The first structure is for the offset and will be
        used for any sytstm flags needed later on during development.

        Index into the CPR table is based on the number of chain pin
        spaces from the fault insertion for a particular hopper to
        the good book eye location. This distance is first learned at
        initial learn mode (or learn after stretch) and stored in a table
        pins_to_eye[]. The CPR offset is then calculated on the basis
        of number of pins times the structure type of the CPR table.

        Offset into any of the I/O tables is on the boundries of a
        Pamux board. Therefore the following formula makes all four
        stations in a four box section the same offset:

                offset = (station - 1)/4 + 1

    2.  The timers will be initialized for a 1 second flash of the
        miss and double lights. There are 124 miss and 124 double
        timers. One for each miss and double for each hopper.
        The timer address for each hopper is initialized in the
        STA_STAT table as miss_timer and dbl_timer.


    3.  The section outside the loop is to initalize the scan routines
        loop counters. The first loop loads the input table one word at
        a time. The loop that loads the change table works on long words.
        So the value of the second loop counter is one half the first loop
        counter if it is even or one half plus one the first loop counter
        if it is odd.

*****************************************************************/


#include <std.h>
#include <config.h>
#include <service.h>


SECTION( TEXT, 4);              /* onboard ram */
SECTION( DATA, 1);              /* onboard ram */
IONT( 1,1,"");

IMPORT UCOUNT num_stations;     /* total number of possible stations */


VOID ini_tables()

{

IMPORT  STAT_TMPLT sta_stat[];                          /* station status table */
IMPORT  UCOUNT  chg_table[], out_table[], inp_table[];  /* I-O tables */

IMPORT  TIME    miss1_timer;                            /* first miss light timer */
IMPORT  TIME    dbl1_timer;                             /* first double light */
IMPORT  TIME    conv_timer, eff_light_timer, horn_timer, stop_start;

IMPORT  VOID    clr_miss_lite(), clr_dbl_lite();        /* light end action routines */
IMPORT  VOID    clr_horn(), clr_eff_lite(), clr_conveyor(), fstart_gath();

IMPORT  UCOUNT  service_angles[];                       /* table of service angles */
IMPORT  UCOUNT  active_sections;
IMPORT  UCOUNT  change_counter;
IMPORT  UCOUNT  pins_to_bkeye[];
IMPORT  TBOOL   two_up;
IMPORT  TBOOL   ang_lrn_flg, rj_lrn_flg, jam_lrn_flg;
IMPORT  UCOUNT  cal_offset;                             /* caliper offset from learned angle */
IMPORT  TBOOL   fault_flg;

FAST UCOUNT i, j;
FAST STAT_TMPLT *p_stat;
TIME *pm_timer, *pd_timer;

pm_timer = &miss1_timer;
pd_timer = &dbl1_timer;

p_stat = sta_stat;
p_stat->clp_fail = 0;                           /* clear caliper failure flag */
p_stat->flt_stop = 0;                           /* clear fault stop flag */
```

```
num_stations = (active_sections - 1)*4;                          /* maxium number of hoppers */

for (i=1, j=0; i <= num_stations;   i++ , j++)
        {

p_stat = &sta_stat[i];                                           /* pointer for this hopper */

p_stat->station = i;                                             /* station number */
p_stat->chg_address = (ULONG)&chg_table[(j/4) + 1];  /* change table address for each station */
p_stat->out_address = (ULONG)&out_table[(j/4) + 1];  /* output table address */
p_stat->inp_address = (ULONG)&inp_table[(j/4) + 1];  /* input table address for each station */

p_stat->pmux_hop = j % 4;                                  /* station number of each pamux */
p_stat->miss_timer = pm_timer;                             /* miss lite timer for this hopper */
p_stat->dbl_timer = pd_timer;                              /* double lite timer for this hopper */
p_stat->clp_fail = 0;                                      /* clear caliper failure flag */
p_stat->flt_stop = 0;                                      /* clear fault stop flag */

/*************************************************************************

        initialize all the miss and double light timers

*************************************************************************/

        settime (pm_timer, clr_miss_lite, i, ONE_SEC);      /* initialize miss light timers */
        settime (pd_timer, clr_dbl_lite, i, ONE_SEC);       /* initialize double light timers */

         pm_timer++;
         pd_timer++;
        }

/*************************************************************************

        Initialize scaners loop counters.

*************************************************************************/

if (active_sections % 2)
        change_counter = (active_sections + 1 ) / 2;
else
        change_counter = active_sections / 2;

/*************************************************************************

        set timers for conveyors, lights and horn

*************************************************************************/

settime (&conv_timer, clr_conveyor, 0, (ONE_SEC*2));    /* conveyor timer */

settime (&eff_light_timer, clr_eff_lite, 0, (ONE_SEC*60));              /* efficiency timer */

settime (&horn_timer, clr_horn, 0 , (ONE_SEC*3));               /* horn timer */

settime (&stop_start, fstart_gath, 0, 5 );              /* reenable the gatherer. */

/*************************************************************
 temp. clear out learn mode paramaters..later it should be in ram
 and be cleared on power up
*************************************************************/

fault_flg = NO;
ang_lrn_flg = NO;
rj_lrn_flg = NO;
jam_lrn_flg = NO;

return;
}

 /*************************************************************
 *                                                           *
 *   Routine to initalize the split table                    *
 *                                                           *
 *************************************************************/

 ini_splits()

 {
 IMPORT  UTINY used[];
 IMPORT  UTINY usedcnt;
 IMPORT  SPLIT_TMPLT  splits[];
 IMPORT  TBOOL  two_up;
 IMPORT  UTINY  last_page;
 SPLIT_TMPLT  *p_split;
```

```
UTINY n,i;

last_page = 3;                                  /* number of pages in split make-ready */

p_split = &splits;
for(n = 0;n <= 13;n++)
    {
        for (i = 0; i <= 8;i++)
            {
                p_split->split_hops[i] = 0;     /* clear all hoppers. */
            }
        p_split->feed = &p_split->split_hops[1];  /* reset split feed pointer */
        if(two_up)
                p_split->num_books = 4;         /* set no. of book split */
        else
                p_split->num_books = 2;
        p_split++;
    }

for(n = 0;n <= 23;n++)
        used[n] = 0;                    /* clear used hopper list */

usedcnt = 0;

return;

}


/*****************************************************
*                                                    *
*       routine to clear the output table            *
*                                                    *
*****************************************************/

IMPORT UCOUNT o_miss_mask[];                    /* output station miss light mask table */
IMPORT UCOUNT o_dbl_mask[];                     /* output double light mask table */
IMPORT UCOUNT o_inh_mask[];                     /* output hopper inhibit mask table */
IMPORT UCOUNT o_stop_mask;
IMPORT  STAT_TMPLT sta_stat[];                  /* station status table */
IMPORT  UCOUNT  out_table[];                    /* I-O tables */

clr_outable()

{

UTINY n;                                        /* station status pointer for this hopper */
FAST STAT_TMPLT *p_stat;
FAST UCOUNT hop;
UCOUNT *p_outtbl;

                                                /* alow start of gatherer */
out_table[0] &= ~o_stop_mask;                   /* maxium number of hoppers */
num_stations = (active_sections - 1)*4;

for(n = 1; n <= num_stations; n++)
        {                                       /* address of status table for this hopper */
        p_stat = &sta_stat[n];
        hop = p_stat->pmux_hop;                 /* pamux output address */
        p_outtbl = p_stat->out_address;         /* turn off dbl light */
        *p_outtbl &= ~o_dbl_mask[hop];          /* turn off miss light */
        *p_outtbl &= ~o_miss_mask[hop];         /* enable hop to feed */
        *p_outtbl &= ~o_inh_mask[hop];
        }
return;
}

/*****************************************************************************

                        COPYRIGHT (C)  1985
                BY HARRIS GRAPHICS CORP., CHAMPLAIN, NY
                        ALL RIGHTS RESERVED


Project:        CABCON II

Module:         inilearn

Version:        X1

Abstract:       Initialize schedule list for learn mode

Author:         T. Rowe

Created:        31-JUL_85

Modified by:
```

```
        Who             Date            Description of Modification
        ---             ----            ---------------------------

        T.R.            2-DEC-85        change fst_hop to fst_stat and lst_hop to lst_stat

*****************************************************************************/

/*****************************************************************
        set_ang_table()

 this routine will prime the lrn_table[] for the appropiate values
 to be used when we want to learn insertion points

*****************************************************************/

#include <std.h>
#include <config.h>
#include <service.h>

SECTION( TEXT, 4);              /* prom */
SECTION( DATA, 1);              /* onboard ram */
IDNT( 1,1,"");

IMPORT UCOUNT       num_stations;               /* last possible hopper */
IMPORT STAT_TMPLT   sta_stat[];
IMPORT UCOUNT       fst_stat, lst_stat;
IMPORT UCOUNT       active_sections;
IMPORT UCOUNT       chg_table[], inp_table[];
IMPORT LRN_TMPLT    lrn_table[];
IMPORT UCOUNT       i_swi_mask[];               /* hopper select select mask table */
IMPORT  COUNT       numtolrn;                   /* number of hoppers to learn. */

VOID set_ang_table()
{

FAST STAT_TMPLT *p_stat;
FAST LRN_TMPLT *p_lrn_table;
FAST UCOUNT i;
UCOUNT hop, *p_inptbl;                          /* input table pointer for appropiate station */

numtolrn = 0;

p_stat = &sta_stat[fst_stat];
p_lrn_table = &lrn_table[fst_stat];
for ( i=fst_stat; i <= lst_stat; i++, p_stat++, p_lrn_table++ )
        {
        p_inptbl = p_stat->inp_address; /* input table address for this hopper */
        hop = p_stat->pmux_hop;         /* this stations pamux hopper number (0,1,2,3). */

        if ( ( p_stat->physical ) && (*p_inptbl & i_swi_mask[hop] ) &&
                p_stat->active )
                {
                numtolrn++;
                p_lrn_table = &lrn_table[i];
                p_lrn_table->station = i;
                p_lrn_table->lrn_srv_ang = YES;
                p_lrn_table->num_tries = 5;
                }
        else
                {
                p_lrn_table->lrn_srv_ang = NO;
                }
        p_lrn_table->set_angle = NO;
        }

ini_ver_angle();

/*
        allow learning of the hopper service angles to begin.
*/
lrn_table[0].set_angle = NO;
lrn_table[0].lrn_srv_ang = NO;

return;
}
/*****************************************************************************

        Function:       INILRNTABLE()

        This routine will set all hoppers init_1up_angle and init_2up_angle
        to 999. This will be used so we can tell which hoppers have not
        learned their service angles yet.

*****************************************************************************/

inilrntable()
```

```
{
COUNT i;

for( i = 1 ; i <= num_stations; i++ )
        lrn_table[i].init_1up_angle = lrn_table[i].iñit_2up_angle = 999;
return;
}

/*****************************************************************************

                        COPYRIGHT (C)  1985
                BY HARRIS GRAPHICS CORP., CHAMPLAIN, NY
                        ALL RIGHTS RESERVED


Project:        CABCON II

Module:         lrnhops.c

Version:        X1

Abstract:       learn the phyisical hoppers.

Author:         S. ENT  (Parts cloned from T. Rowe)

Created:        23-Apr_85

Modified by:

        Who             Date            Description of Modification
        ---             ----            ---------------------------

*****************************************************************************/
#include <std.h>
#include <config.h>
#include <service.h>
#include <mm35rtc.h>

SECTION( TEXT, 4);              /* prom */
SECTION( DATA, 1);              /* onboard ram */
IONT( 1,1,"");


IMPORT UCOUNT num_hoppers;                      /* total # of physical hoppers */
IMPORT TIME_DAY d_stat;
IMPORT TIME_DAY daytime;
IMPORT TBOOL    stat_nums;


lrn_hops()
{

IMPORT  BOOK_TYPE books[];                      /* Bookmaker hopper array */
IMPORT  STAT_TMPLT sta_stat[];                  /* station status table */
IMPORT  UCOUNT  inp_table[];
IMPORT  UCOUNT  num_stations;
IMPORT  UCOUNT  i_swi_mask[];                   /* cabcon input switch masks */
STAT_TMPLT  *p_stat;
UCOUNT *p_inptbl;                               /* input table address for hopper */
UCOUNT  i,j;
BOOK_TYPE  *p_book;
BOOK_TYPE  *p_book2;

        cpybuf ( &d_stat, &daytime, sizeof(daytime) );

        p_stat = &sta_stat[1];
        num_hoppers = 0;
        j = 1;
        for(i = 1;i <= num_stations;i++)
            {

    p_inptbl = p_stat->inp_address;                     /* input address */

    if (*p_inptbl & i_swi_mask[p_stat->pmux_hop])
            {
            p_stat->cb_sw = YES;                        /* hopper present */
            p_stat->physical = YES;                     /* for now make hoppr physical */
            p_stat->active = YES;                       /* default to active */
            if( stat_nums )
                    p_stat->hopper = p_stat->station;
            else
                {
                    p_stat->hopper = j;                         /* actual hopper # */
                    j++;
                }
            num_hoppers++;

            }
```

```
 else
        {
        p_stat->cb_sw = NO;
        p_stat->physical = NO;                    /* temp.. later learn mode does this */
        p_stat->active = NO;                       /* default to active */
                        p_stat->hopper = 0;
                        }
                p_stat++;
            }


/*****************************************************
*                                                    *
*       Initialize the bookmaker array.              *
*                                                    *
*****************************************************/
        p_book = books;
        p_stat = &sta_stat[1];

        for (i = 1; i<=124; i++)
            {

                if (p_stat->physical)
                    {
                        if (p_stat->active)
                                p_book->book[i] = p_stat->station;
                        else
                                p_book->book[i] = 0;
                    }
                else
                        p_book->book[i] = 255;
                p_stat++;
            } /* end for */

        p_book = &books[0];
        p_book2 = &books[1];


        for (i = 1;i < 16;i++)
            {
                cpybuf (p_book2, p_book, sizeof(BOOK_TYPE));
                p_book2++;
            } /* end for */


        clear_hops();
        ini_hoppers();
        re_ini_tables();

        return;
}


/*************************************************************
*                                                            *
*       routine to set up physical hopper list               *
*                                                            *
*************************************************************/


clear_hops()
{
IMPORT  HOP_STATION  hop_table[];

HOP_STATION *p_hop;
UTINY n;

        p_hop = &hop_table;

        for(n = 0;n <= 124;n++)
            {
                p_hop->hopper = p_hop->station = 0;
            }

        return;
}

ini_hoppers()
{
IMPORT HOP_STATION hop_table[];
IMPORT STAT_TMPLT sta_stat[];
IMPORT UCOUNT  num_stations;
IMPORT TBOOL  two_up;
UCOUNT i,n;
HOP_STATION *p_hop;
STAT_TMPLT *p_stat;
```

```
p_hop = hop_table;
p_hop->hopper = p_hop->station = 0;


p_hop = &hop_table[1];

if( stat_nums )
    {
        for( i = 1; i <= num_stations; i++ )
            {
                p_stat = &sta_stat[i];
                if( p_stat->hopper != 0 )
                    {
                        p_hop->hopper = p_stat->station;
                        p_hop->station = p_stat->station;
                        p_hop++;
                    }
            }
    }
else
    {
        for (i = 1;i <= num_stations;i++)
            {
                p_stat = &sta_stat[1];
                p_hop = &hop_table[i];
                p_hop->hopper = i;
                        for(n = 1;n <= num_stations;n++)
                            {
                                if(p_stat->hopper == i)
                                    {
                                        p_hop->station = n;
                                        break;
                                    }
                                else
                                        p_stat++;
                            }
            }
    }

if( two_up )
    {
        for(i = 1;i <= num_stations;i++)
            {
                p_stat = &sta_stat[i];
                p_stat->odd_even = (i + 1) % 2;          /* for 2 up set up odd/even stations */
            }
    }


return;
}
/*****************************************************************************

                        COPYRIGHT (C)  1985
                BY HARRIS GRAPHICS CORP., CHAMPLAIN, NY
                        ALL RIGHTS RESERVED.


Project:        CASCON II

Module:         rjlearn.c

Version:        X1

Abstract:       Learn reject service angles

Author:         T. ROWE

Created:        10-Sept-85

Modified by:

        Who             Date            Description of Modification
        ---             ----            ---------------------------

        T.R.            2-DEC-85        don't check or stop for both arm positions if present
*****************************************************************************/

#include <std.h>
#include <config.h>
#include <service.h>
#include <mm35rtc.h>
#include <msglog.h>
```

```
SECTION( TEXT, 0);                /* onboard ram */
SECTION( DATA, 1);                /* onboard ram */
IONT( 1,1,"");

/*************************************************************************

 ROUTINE rj_learn();


This routine is to be scheduled from the 10 msec interrupt routine whenever
the reject angles are to be learned. It will scan to see when the latch
inputs are present. That angle plus any offset will then be the new service
angle for the latch_up or latch_down. Two up operation will have one for
each 14 in chain pin space, which will be 180 degrees apart.

The background routine that initiales this routine will be required to
initialize the correct paramaters and display angles as learnad. The
sequence of events are as follows:

        1. Stop gatherer
        2. When no movement sensed (enc_move = NO) then jsr to ini_cpr()
           this will put ripples in the entire raceway.
        3. Clear required parameters:
                num_rj_angles (ucount = 0)
                prev_learn (ucount[4] = 0)
                chg_table -- i_rjld_mask and i_rjhd_mask
        4. Set rj_lrn_flg, enable restart of gatherer and tell operator
        5. Display dwell angles as learned, they are put in prev_learn[4] as:
                prev_learn[0] -> low dwell (1up, odd pin 2up)
                pre_learn[1] ->  high dwell (1up, odd pin 2up)
                prev_learn[2] -> low dwell (even pin 2up)
                prev_learn[3] -> high dwell (even pin 2up)
        6. When all angles are learned:
                gatherer stopped
                rj_done_flg set
        7. When no movement and rj_done_flg set; the display routine should:
                jsr to ini_angles()
                clear all miss and doubles in chg_table for all hoppers
                clear learn and good book verify in chg_table
                clear rj_learn_flg
                enable gatherer to run (clr stop bit)
                prompt operator of success
                wait for furtherer instructions


Error test will consists of:

        if no latch signal in alloted # of tries then system stop
        if either up or down latch missing then system stop

Appropiate error messages are displayed in message logger for each

*************************************************************************/

rj_learn()
{

IMPORT TIME_DAY          daytime;
IMPORT TIME_DAY          d_l1reject;
IMPORT TIME_DAY          d_l2reject;
IMPORT VOID              rej_up(), rej_down();
IMPORT RJ_TMPLT          rj_one_angles[2];
IMPORT RJ_TMPLT          rj_two_angles[4];
IMPORT UCOUNT            prev_learn[2];
IMPORT UCOUNT            num_rj_angles;
IMPORT UCOUNT            rj_num_tries;
IMPORT TBOOL             rj_lrn_flg;
IMPORT TBOOL             rj_done_flg,strt_lrn;
IMPORT UCOUNT            chg_table[];
IMPORT UCOUNT            i_rjld_mask, i_rjhd_mask;
IMPORT MSG_TBL           rjld_msg;
IMPORT MSG_TBL           rjhd_msg;
IMPORT MSG_TBL           norj_msg;          /* reject low dwell angle allready learned error */
IMPORT MSG_TBL           brjs_msg;          /* reject high dwell allready learned error */
IMPORT MSG_TBL           rejl_msg;          /* no dwell signals at all error */
IMPORT MSG_TBL           rejin1up;          /* both dwell signals at same time error*/
IMPORT MSG_TBL           rejin2up;          /* completed reject learn angles */
                                            /* the reject is in 1up but controls in 2up.*/
IMPORT TBOOL             two_up;            /* the reject is in 2up but controls in 1up.*/
IMPORT UCOUNT            enc_deg;
IMPORT TBOOL             enc_move;
IMPORT TBOOL             rjcrossz;
IMPORT TBOOL             rjstartz;

IMPORT UCOUNT fst_hop;                  /* First phyical hopper number. */
IMPORT UCOUNT lst_hop;                  /* Last phyical hopper number. */
IMPORT UCOUNT fst_stat;          /* First phyical station number. */
IMPORT UCOUNT num_completed;     /* Number of hoppers learned. */
```

```
IMPORT TBOOL ang_lrn_flg;       /* When true hopper service angles will be learned. */
IMPORT  UCOUNT    lst_stat;
IMPORT  HOP_STATION  hop_table[];
IMPORT UCOUNT num_hoppers;      /* Number to hoppers in the system. */
IMPORT TBOOL start_at_zero;

FAST UCOUNT *p_chgtbl;                          /* pointer to inputs change table */
RJ_TMPLT *p_rj_one;                             /* pointer to reject gate angle table */
RJ_TMPLT *p_rj_two;                             /* used to tmp hold differents between angles. */
COUNT tmpang;

if (rj_done_flg || !enc_move || !rjstartz )
        return;

p_chgtbl = chg_table;

/* check if both latch up and latch down are on at the same time. */

if ( (*p_chgtbl & i_rjld_mask) && (*p_chgtbl & i_rjnd_mask) )
        {
        *p_chgtbl &= ~i_rjld_mask;
        *p_chgtbl &= ~i_rjhd_mask;
        sys_msg ( 0, &brjs_msg, NULL );
        enable_restart();

        return;
        }


if ( !two_up )                  /* get pointer for correct table */
        {
/*
        1up LATCH UP .
*/
        if ( *p_chgtbl & i_rjld_mask )
                {
                *p_chgtbl &= ~i_rjld_mask;                              /* clear out bit */
                if ( prev_learn[0] )
                        {
                        sys_msg( 0, &rjhd_msg, NULL);
                        enable_restart();
                        return;
                        }
                prev_learn[0] = enc_deg;
                num_rj_angles++;
                }
/*
        1up LATCH DOWN.
*/
        if ( *p_chgtbl & i_rjhd_mask )
                {
                *p_chgtbl &= ~i_rjhd_mask;                              /* clear out bit */
                prev_learn[1] = enc_deg;
                if ( !prev_learn[0] || (prev_learn[0] > prev_learn[1]) )
                        {
                        sys_msg ( 0, &rjld_msg, NULL);
                        enable_restart();
                        return;
                        }
                num_rj_angles++;
                }

        if (num_rj_angles == 2)
                {
                timemsg ( 500, 4, &rejl_msg, NULL );
/*
        check if learned angle has changed by more than 5 degrees.
*/
                p_rj_one = &rj_one_angles[0];
                tmpang = abs( p_rj_one->angle - prev_learn[0] );
                if( !p_rj_one->angle || tmpang > 5 )
                        {
                        p_rj_one->angle = prev_learn[0];
                        p_rj_one->routine = (ARGINT)rej_up;
                        p_rj_one->tcw = 0;
                        p_rj_one++;
                        p_rj_one->angle = prev_learn[1];
                        p_rj_one->routine = (ARGINT)rej_down;
                        p_rj_one->tcw = 0;
                        cpybuf( 3d_l1reject, &daytime, sizeof(daytime) );
                        }
                if( prev_learn[0] < 120 )
                        {
                        sys_msg( 0, &rejin2up, NULL );
                        fstop_ragath();
                        }
                rj_done_flg = YES;
                rj_lrn_flg = NO;
                if( strt_lrn )          /* if in ripple start set up for learning hop angs */
                        {
```

```
                fst_hop = hop_table[1].hopper;
                fst_stat = hop_table[1].station;
                lst_hop = hop_table[num_hoppers].hopper;
                lst_stat = hop_table[num_hoppers].station;

                num_completed = 0;              /* no hoppers have been learned yet. */

                /*!!!
```

```
                    /*!!!
```

.(service routine will be lrn_srv).
call ini_lrn_cpr ( global -- first hop & last hop)

2. Clear strt_counting; which will be set once a hopper has recorded its first feed.

3. Clear learn eye and bood book verify eye change table values.

4. Clear out LRN_TABLE[0]->set_ins_pt

When the fed book gets to the learn eye the sta_stat table will be updated with the appropiate value. The next hopper to be learned will be placed in the flag hop_in_learn. When all stations have been learned the learn diaplay routine should re_establish all service angles via INI_ANGLES after the gatherer has come to a stop.

When all hoppers have learned their insertion points then a completion flag will be set... which is LRN_FLAG[0]->set_ins_pt Variables used are:

strt_counting - set (in lrn_serv) when a hopper has feed and counting of chain spaces is to commence.

hop_in_learn - contains the station number under test so all others are bypassed.

pins_offset - number of pins from learn eye to reject gate ( as initially set up in a previous config display )

A table will be set up that indicates which hoppers are to be learnad, the learned value, and the number of tries to learn it. It isformatted as follows:

```
LRN_TMPLT
        {
        UCOUNT  station                 station number
        TBOOL   lrn_ins_pt              yes if to learn  insertion pt
        TBOOL   lrn_srv_ang             yes if to learn service angle
        UCOUNT  num_1up_pins            number of pins to learn eye..1 up
        UCOUNT  init_1up_angle          service angle for this hopper
        UCOUNT  num_tries               no. tries to get a miss
        TBOOL   set_angle               hop has learned angle
        TBOOL   set_ins_pt              hop has learned insertion pt
        UCOUNT  num_2up_pins            number of pins to learn eye..2 up
        UCOUNT  init_2up_angle          service angle for this hopper
        }
*************************************************************************/

IMPORT TBOOL        two_up;
IMPORT TIME_DAY     d_1up_lins;         /* time when insertion points were learned of 1up .*/
IMPORT TIME_DAY     d_2up_lins;         /* time when insertion points were learned of 2up .*/
IMPORT TIME_DAY     daytime;
IMPORT LRN_TMPLT    lrn_table[125];
IMPORT TBOOL        strt_counting, learn, enc_move;
IMPORT UCOUNT       i_leye_mask, i_gvfy_mask, o_conv_mask, o_tape_mask;
IMPORT STAT_TMPLT   sta_stat[];
IMPORT UCOUNT       chg_table[], out_table[];
IMPORT UCOUNT       o_stop_mask, o_miss_mask[];
IMPORT MSG_TBL      l_nrj_msg;                          /* learn book not rejected */
IMPORT MSG_TBL      inpl_msg;                           /* insertion points learned message */
IMPORT UCOUNT       *p_next_hop;
IMPORT UCOUNT       hop_in_learn;
IMPORT UCOUNT       fst_stat;
IMPORT UCOUNT       lst_stat;
IMPORT TBOOL        fault_flag;
IMPORT UCOUNT       le_to_rg, be_to_rg;
IMPORT   TIME           conv_timer;
IMPORT TBOOL        jam_lrn_flg;
IMPORT TBOOL    in_start,strt_lrn;

learn_cpr( inc_noinc )
   UCOUNT inc_noinc;

{

UCOUNT *p_chgtbl;
LRN_TMPLT *p_lrn_table;                         /* point to present tested hoppers entry */
STAT_TMPLT *p_stat;
UCOUNT  *p_outtbl;

if (lrn_table[0].set_ins_pt )                   /* if all finished just get out */
        return;
out_table[0] |= o_tape_mask;                    /* turn on tapes */

if (strt_counting)                              /* don't do anyting till we have a good feed */
        {
```

```
p_lrn_table = &lrn_table[hop_in_learn];
p_cngtbl = chg_table;                                   /* book not rejected ? */

if ( *p_chgtbl & i_gvfy_mask )
        {
        *p_chgtbl &= ~i_gvfy_mask;                      /* clear out bit in table */
        out_table[0] |= o_stop_mask;                    /* stop gatherer */
        sys_msg( 0, &l_nrj_msg, NULL );
        }


if ( *p_chgtbl & i_leye_mask )                          /* at the learn eye yet */
        {
        *p_chgtbl &= ~i_leye_mask;                      /* clear out bit in table */
        strt_counting = NO;                             /* allow next hopper to be set up */
        p_lrn_table->set_ins_pt = YES;
        p_lrn_table++;                                  /* get next hopper info */
        out_table[0] |= o_conv_mask;                    /* turn on conveyor */
        startime(&conv_timer);                          /* for a sec */

        while (p_lrn_table <= &lrn_table[lst_stat] )
                        {
                        if (p_lrn_table->lrn_ins_pt && sta_stat[p_lrn_table->station].physical )
                                {
                                hop_in_learn = p_lrn_table->station;
                                if (two_up)
                                        p_lrn_table->num_2up_pins = 0;
                                else
                                        p_lrn_table->num_1up_pins = 0;

                                return;
                                }
                        p_lrn_table++;
                        }
                out_table[0] |= o_stop_mask;            /* stop gatherer */
                timemsg (1000, 4, &inpl_msg, NULL);     /* completed learn mode mseeage */
                lrn_table[0].set_ins_pt = YES;          /* indicate all completed */
                hop_in_learn = 0;
                strt_counting = NO;
                re_ini_tables();                        /* re initialize tables (sta.stat) */
                if( two_up )
                        cpybuf( &d_2up_lins, &daytime, sizeof(daytime));
                else
                        cpybuf( &d_1up_lins, &daytime, sizeof(daytime));

                }

        }
}
/*****************************************************************

Function:       re_ini_tables()
                ---------------

        This routine replaces the portion of initables that
used to set up the sta_stat tables. Now that it is put in novram
we can do it only once after a learn and not again, till a relearn
that is.

    1.  The table sta_stat (typedef defined in SERVICE.H) contains enough
        room for 124 hoppers. Each type is 40 words long. The first station
        starts in the second set, making indexing a multiple of the
        station number. The first structure is for the offset and will be
        used for any sytstm flags needed later on during development.

*****************************************************************/

IMPORT  STAT_TMPLT sta_stat[];                          /* station status table */
IMPORT  UCOUNT  num_stations;
IMPORT  UCOUNT  cal_offset;                             /* caliper offset from learned angle */
IMPORT UCOUNT  f_i_offset;                              /* fault to inhibit offset */

re_ini_tables()
{


FAST UCOUNT i;
FAST STAT_TMPLT *p_stat;
COUNT temp_offset;

p_stat = &sta_stat[1];                          /* pointer to first hopper */

temp_offset =  be_to_rg + le_to_rg;

for (i=1;  i <= num_stations;   i++ , p_stat++ )
        {
        if (two_up)
```

```
                {
                p_stat->cpr_2up_off = lrn_table[i].num_2up_pins + temp_offset;
                p_stat->flt_offset = p_stat->cpr_2up_off * 2 + p_stat->odd_even;
                p_stat->inh_offset = p_stat->flt_offset + f_i_offset;
                if( p_stat->ser_2up_angle < p_stat->ver_2up_ang )
                        p_stat->inh_offset += 2;
                }
        else
                {
                p_stat->cpr_1up_off = lrn_table[i].num_1up_pins + temp_offset;
                p_stat->flt_offset = p_stat->cpr_1up_off * 2 + p_stat->odd_even;
                p_stat->inh_offset = p_stat->flt_offset + f_i_offset;
                if( p_stat->ser_1up_angle < p_stat->ver_1up_ang )
                        p_stat->inh_offset += 2;
                }
        }
}
/*****************************************************************************

Function:       lrn_serv()
                ----------

     This function is scheduled via ENCODER for each hopper under learn
mode test at their appropiate service angle.

        It performs the following test:

        1. starts test at first station of list (fst_stat to lst_stat)
           and sets that station number in hop_in_learn.

        2. bypasses all other during this hopper in test. if they
           indicate a feed the gatherer is stopped since it would screw
           up the number of pins counter when it gets to the learn eye

        3. checks for only one feed for the hopper under test and if so
           stops the gatherer since this would also screw up the test

        4. give each hopper under test to "get it on" in four tries and
           and again stops gatherer if it doesen't

Variables and tables used are:

        station      --- station number at this angle (passed as tcw)
        hop_in_learn --- station that is presently in test for learn
        strt_counting -- set when a hopper is in test

*****************************************************************************/

IMPORT TBOOL fault_flag;                        /* flag set for reset routine for any hopper stops */
IMPORT STAT_TMPLT sta_stat[];                   /* station configuration and run data */
IMPORT UCOUNT cpr_len;                          /* length of cpr resigter */
IMPORT CPR_TMPLT cpr[];                         /* chain pin register - contains  book maker and fault info */
IMPORT CPR_TMPLT *cpr_ptr;                      /* present cpr pointer */
IMPORT CPR_TMPLT *cpr_end;                      /* end address of CPR table */

IMPORT UCOUNT out_table[];                      /* output table */
IMPORT UCOUNT inp_table[];
IMPORT UCOUNT i_miss_mask[];                    /* input station miss mask table */
IMPORT UCOUNT i_swi_mask[];
IMPORT UCOUNT o_miss_mask[];                    /* output station miss light mask table */
IMPORT UCOUNT o_stop_mask;                      /* output gatherer stop mask */
IMPORT UCOUNT o_inh_mask[];                     /* output hopper inhibit mask table */
IMPORT MSG_TBL lfeed_msg, lmiss_msg, wrng_feed;
IMPORT UCOUNT hop_in_learn;

lrn_serv(station)

ULONG station;

{

UCOUNT *p_chgtbl;                               /* change table pointer for appropiate station */
UCOUNT *p_outtbl;                               /* output table pointer for appropiate station */
UCOUNT *p_inptbl;
FAST UCOUNT hop;                                /* hopper number of each pamux ( 1 - 4 ) */
FAST STAT_TMPLT *p_stat;                        /* station status pointer for appropiate station */
FAST LRN_TMPLT *p_lrn_table;

if (lrn_table[0].set_ins_pt && !jam_lrn_flg )           /* if all finished just get out */
        return;

p_stat = &sta_stat[station];                    /* station status for this hopper */
p_chgtbl = p_stat->chg_address;                 /* change table address for this hopper */
p_outtbl = p_stat->out_address;                 /* output table address for this hopper */
p_inptbl = p_stat->inp_address;
hop = p_stat->pmux_hop;                         /* pamux offset for this hopper */

if ( (station != hop_in_learn) || jam_lrn_flg )
        {

/* if the select switch is not in cabcon then dont fault this hopper.. this allows
   easier setup with the simulator.. beware on the real machine !!!!
   if selected and a feed sensed and its physical then error this hopper */
```

```
        if (!( *p_chgtbl & i_miss_mask[hop] ) && (*p_inptbl & i_sel_mask[hop]) &&
                p_stat->physical && p_stat->fstverify)
                {
                out_table[0] |= o_stop_mask;
                fault_flag = YES;                       /* indicate to reset routine hop caused fault */
                p_stat->flt_stop = YES;                 /* and which hopper */
                *p_outtbl |= o_miss_mask[hop];          /* light failing hopper light */
                killtime(p_stat->miss_timer);
                sys_msg ( 0, &wrng_feed, p_stat->hopper );
                return;
                }
        *p_chgtbl &= ~i_miss_mask[hop];                 /* clear the miss. */
        return;

if (*p_chgtbl & i_miss_mask[hop])                       /* if no miss then see test started */
        {
        *p_chgtbl &= ~i_miss_mask[hop];                 /* clear out miss in chg table */
                                                        /* fault cpr for reject and book eye control */
        if (strt_counting)                              /* see if started in three tries? */
                {
                *p_outtbl |= o_miss_mask[hop];          /* turn on miss light */
                startime(p_stat->miss_timer);           /* set timer to turn off light */
                return;
                }
        p_lrn_table = &lrn_table[station];

        if (!(--p_lrn_table->num_tries))                /* dec number of tries */
                {
                *p_outtbl |= o_miss_mask[hop];          /* turn on miss light for this hopper */
                out_table[0] |= o_stop_mask;            /*  stop gatherer */
                fault_flag = YES;                       /* fault flag for reset routine */
                p_stat->flt_stop = YES;                 /* indicate to reset shich hop stoped gatherer */
                p_lrn_table->num_tries = 8;
                killtime(p_stat->miss_timer);           /* stop timer for miss light */
                sys_msg ( 0, &lmiss_msg, p_stat->hopper );      /* multiple misses before setup */
                return;
                }
        else
                {
                *p_outtbl |= o_miss_mask[hop];          /* turn on miss light */
                startime(p_stat->miss_timer);           /* set timer to turn off light */
                return;
                }
        }
/*********************************************************************
        hopper has fed product...but only allow once per learn
*********************************************************************/

else  if( p_stat->fstverify )
        {
        if (strt_counting)
                {
                *p_outtbl |= o_miss_mask[hop];          /* too many feeds stop gatherer */
                out_table[0] |= o_stop_mask;
                fault_flag = YES;                       /* to enable reset routine to restart gatherer at hopper *
                p_stat->flt_stop = YES;                 /* indicate to reset shich hop stoped gatherer */
                killtime(p_stat->miss_timer);           /* stop timer for miss light */
                sys_msg ( 0, &lfeed_msg, p_stat->hopper )       /* more than one pin has a feed */
                }
        else

/* spr #5 */
                {
                strt_counting = YES;                    /* we have begun to learn this hopper */
                chg_table[0] &= ~i_leye_mask;           /* clear out bit in table */
                }
        }
return;
}

/*********************************************************************

        Function: lrn_veri()

        This routine is call once every 360 degress for every hopper
        on a service angle learned in learnangle.  This routine check
        to make sure that the miss verify reflector is present or not
        present on the correct cycles of the machine.  THis is also when
        the inhibiting of the hopper is done.

*********************************************************************/


VOID lrn_veri(station)

ULONG station;                                          /* station number to be serviced */

{
UCOUNT *p_chgtbl;               /* change table pointer for appropiate station */
UCOUNT *p_inptbl;               /* input table pointer for appropiate station */
UCOUNT *p_outtbl;               /* output table pointer for appropiate station */
FAST UCOUNT hop;                /* hopper number of each pamux ( 1 - 4 ) */
FAST STAT_TMPLT *p_stat;        /* station status pointer for appropiate station */
IMPORT MSG_TBL nmver_msg;       /* no miss verify present message. */
IMPORT MSG_TBL mver_msg;        /* miss verify present message. */
IMPORT  TINY numgrips;          /* The number of grippers on the hoppers. */
IMPORT VOID chg_light();        /* end action for flashing miss & dbl lights. */
CPR_TMPLT *p_inh_cpr;           /* pointer to the inhibit point for this hopper. */
IMPORT TBOOL ang_lrn_flg;
IMPORT TBOOL rj_lrn_flg;
```

```
IMPORT SYS_RUN_TMPLT    sys_run_data;
IMPORT TBOOL no_missver;                /* used to disable miss verifies. */

p_stat = &sta_stat[station];    /* status address for this hopper */
hop = p_stat->pmux_hop;         /* this stations pamux hopper number (0,1,2,3). */
p_chgtbl = p_stat->chg_address; /* change table address for this hopper */
p_outtbl = p_stat->out_address; /* output table address for this hopper */
p_inptbl = p_stat->inp_address; /* input table address for this hopper */

/*
        if where learning service angles just exit.
*/
if( ang_lrn_flg || rj_lrn_flg )
        {
        *p_outtbl |= o_inh_mask[hop];                   /* inhibit hop from feeding */
        return;
        }

/*
        setup the inhibit pointer.
*/
p_inh_cpr = cpr_ptr + (p_stat->inh_offset);
if ( p_inh_cpr >= cpr_end )
        p_inh_cpr -= cpr_len;                           /* cpr is circular */


/*
        Check if this hopper should be inhibited.
*/
if ( !p_stat->physical || station != hop_in_learn ||
     strt_counting || !(*p_outtbl & o_inh_mask[hop]) ||
       jam_lrn_flg )
        *p_outtbl |= o_inh_mask[hop];                   /* inhibit hop from feeding */
else
        *p_outtbl &= ~o_inh_mask[hop];                  /* enable hop to feed */

p_stat->seeverify--;    /* decrement this hoppers seeverify counter. */

/*
        Check if the hopper is in cabcon.
*/
if( *p_inptbl & i_swi_mask[hop] )
        {
/*
        Check if the hopper is active.
*/
        if ( p_stat->active && !no_missver )
                {

                if (*p_chgtbl & i_miss_mask[hop])
                        {
        /*
                If there was a miss verify check to see if it was suppose to be there.
        */
                        if( !p_stat->seeverify || !p_stat->fstverify )
                                {
                                p_stat->seeverify = numgrips;
                                p_stat->fstverify = 1;
                                }
        /*
                If not light miss & double then stop the system.
        */
                        else
                                {
                                killtime(p_stat->miss_timer);           /* stop timer for miss light */
                                killtime(p_stat->dbl_timer);            /* stop timer for miss light */
                                p_stat->seeverify = numgrips + 2;
                                p_stat->fstverify = 0;
                                out_table[0] |= o_stop_mask;            /*  stop gatherer */
                                fault_flag = YES;                       /* fault flag for reset routine */
                                p_stat->flt_stop = YES;
                                *p_outtbl |= o_miss_mask[hop];          /* turn on miss light for this hopper */
                                settime (p_stat->dbl_timer, &chg_light, p_stat->station, 40 );
                                startime( p_stat->dbl_timer );
                                sys_run_data.sys_stops++;               /* one more stop */
                                sys_msg( 0, &nmver_msg, p_stat->hopper ); /* enter error to message log */
                                }
                        }
                else
                        {
        /*
                If no miss verify then check to see if there was suppose to be.
                If not light miss & double then stop the system.
        */
                        if( !p_stat->seeverify )
                                {
                                killtime(p_stat->miss_timer);           /* stop timer for miss light */
                                killtime(p_stat->dbl_timer);            /* stop timer for miss light */

                p_stat->seeverify = numgrips + 2;
                p_stat->fstverify = 0;
                out_table[0] |= o_stop_mask;            /*  stop gatherer */
                fault_flag = YES;                       /* fault flag for reset routine */
                p_stat->flt_stop = YES;
                *p_outtbl |= o_miss_mask[hop];          /* turn on miss light for this hopper */
                settime (p_stat->dbl_timer, &chg_light, p_stat->station, 40 );
                startime( p_stat->dbl_timer );
                sys_run_data.sys_stops++;               /* one more stop */
                sys_msg( 0, &nmver_msg, p_stat->hopper ); /* enter error to message log */
                }
```

```
            }
        }

        {
        p_stat->seeverify = numgrips + 2;
        if( no_missver )
        /* if no miss verifies are used this tells me if i have
                been in here once. */
                p_stat->fstverify = 1;
        else
                p_stat->fstverify = 0;
        }


at->seeverify = numgrips + 2;
at->fstverify = 0;
uttbl &= ~o_inh_mask[hop];          /* enable hop to feed */


~i_miss_mask[hop];                  /* clear out miss in chg table */

/*****************************************************************************

        Routine learn_angle()

    This routine will learn the present service angle at either:

                1.learn initial angle (config time)
                2. ripple start

    To initiate this routine:

            clear LRN_TABLE[0]->set_angle
            clear NUM_COMPLETED
            set ANG_LRN_FLG flag
            set FST_HOP to first hopper to be tested
            set LST_HOP to last hopper to be tested (same as FST_HOP if only one to be done )
            set FST_STAT to first station to be tested
            set LST_STAT to last station to be tested (same as FST_STAT if only one to be done )
            call SET_LRN_TBL()

    Upon completion of learn angles the flag LEARN will be set, then:

            re_initialize service list..call ini_angles()
            clear CPR for initial angle...call rip_start()
            when encoder no longer moving...clear SETUP flag

    Tables used are :

      LRN_TMPLT
            {
            UCOUNT  station                 station number
            TBOOL   lrn_ins_pt              yes if to learn  insertion pt
            TBOOL   lrn_srv_ang             yes if to learn service angle
            UCOUNT  num_1up_pins            number of pins to learn eye
            UCOUNT  num_2up_pins            number of pins to learn eye
            UCOUNT  srv_angle               service angle for this hopper
            UCOUNT  num_tries               no. tries to get a miss
            TBOOL   set_angle               hop has learned angle
            TBOOL   set_ins_pt              hop has learned insertion point
            }

*****************************************************************************/

IMPORT UCOUNT hop_in_learn;
IMPORT UCOUNT num_completed;
IMPORT UCOUNT fst_hop;
IMPORT UCOUNT lst_hop;
IMPORT UCOUNT fst_stat;
IMPORT UCOUNT lst_stat;
IMPORT TBOOL  ang_lrn_flg;
IMPORT UCOUNT   active_sections;                    /* last active station */

IMPORT UCOUNT enc_deg, last_enc_deg;                        /* encoder degree reading */
IMPORT UCOUNT cng_table[], out_table[];
IMPORT UCOUNT i_miss_mask[], o_stop_mask;
IMPORT STAT_TMPLT sta_stat[];                               /* station configuration and run data */
IMPORT UCOUNT max_rotation;
IMPORT TBOOL  enc_move, start_at_zero;
IMPORT MSG_TBL flan_msg;                    /* hop failed to learn angle in 3 tries */
IMPORT MSG_TBL angl_msg;                    /* all angles learned message */
IMPORT TBOOL   cross_zero;
IMPORT REFLECT hopangle[];                  /* table holding service angles learned. */

IMPORT COUNT numtolrn;                  /* number of hoppers to learn. */

learn_angle()
{

IMPORT TBOOL no_missver;                /* used to disable miss verifies. */
FAST UCOUNT *p_cngtbl;                                      /* pointer to change miss change table */
FAST STAT_TMPLT *p_stat;
```

```
FAST LRN_TMPLT *p_learn;
REFLECT *phopangle;
UCOUNT *p_outtbl;
UCOUNT i, hop;

if (lrn_table[0].set_angle || !enc_move )
        return;                                         /* done but waiting for re_initializition */
                                                        /* no encoder movement..or haven't crossed zero first time */

p_stat = &sta_stat[fst_stat];                                   /* get status address */
p_learn = &lrn_table[fst_stat];
for ( i=fst_stat; i <= lst_stat; i++, p_stat++, p_learn++ )     /* check for all hoppers */
        {
        hop = p_stat->pmux_hop;                                 /* # of pamux hopper */
        p_chgtbl = p_stat->chg_address;                         /* change address for this hopper */
        if ((!p_learn->set_angle) && (*p_chgtbl & i_miss_mask[hop]) && (p_learn->lrn_srv_ang ))
                {
                phopangle = &hopangle[i];
                *p_chgtbl &= ~i_miss_mask[hop];                         /* clear out miss */

                phopangle->angle[phopangle->maxtangle--] = enc_deg;

                if( phopangle->maxtangle < 0 )
                        {
                        p_learn->set_angle = YES;       /* completed setting this hopper */

                        if (**num_completed == numtolrn )       /* if all done ..so indicate */
                                {
                                if( findangle() )
                                        {
                                        lrn_table[0].set_angle = YES;

                                         ang_lrn_flg = NO;
                                         strt_lrn = NO;
                                         ini_angles();          /* enter angles */
                                         timemsg (1000, 4, &angl_msg, NULL );         /* angle learn completed msg */
                                         return;
                                         }
                                }
                        }
                }
        }

/*****************************************************************
******* see if zero crossed and if so decrement # tries ***********
*****************************************************************/

if ( cross_zero )
        {
        cross_zero = NO;
        p_stat = &sta_stat[fst_stat];
        p_learn = &lrn_table[fst_stat];
        for ( i=fst_stat; i <= lst_stat; i++, p_stat++, p_learn++ )
                {
                if ( p_learn->lrn_srv_ang && !p_learn->set_angle &&
                 !(--(p_learn->num_tries )) )
                        {
                        p_outtbl = p_stat->out_address;
                        p_learn->num_tries = 4;                 /* reset number of tries */
                        out_table[0] |= o_stop_mask;            /* stop gatherer */
                        fault_flag = YES;
                        p_stat->flt_stop = YES;                 /* allow reset to do its thing */
                        killtime (p_stat->miss_timer );
                        *p_outtbl |= o_miss_mask[p_stat->pmux_hop];
                        sys_msg ( 0, &flan_msg, p_stat->hopper );       /* error message */
                        }
                }
        }
return;

/*********************************************************************


findangle():
                This routine is used to sort out the 4 angles found in
        learn_angle, and get the miss & miss verify sevice angles.

        returns a True if all angles where learned correctly.
                False if any one angle was not correct.
                those angles will have p_learn->set_angle = no;

*********************************************************************/

IMPORT REFLECT hopangle[125];   /* table used to save miss angles. */

TBOOL findangle()
{
IMPORT REFLECT  hopangle[];     /* the hopper angle table. */
IMPORT STAT_TMPLT stat_sta[];   /* the station status table.*/
IMPORT LRN_TMPLT lrn_table[];   /* the learn table. */

FAST    REFLECT *phopangle;     /* pointer into the hopper angle table. */
STAT_TMPLT * p_stat;    /* pointer into the station status table.*/
LRN_TMPLT *p_learn;     /* pointer into the learn table. */

FAST COUNT miss;        /* Holds the value found for the miss angle. */
FAST COUNT vmiss;       /* holds the value found for the miss verify angle. */
COUNT tmp_ang;          /* holds the value first angle found on hopper. */
COUNT  diffangle;       /* holds difference between tmp_ang and other angles. */
```

```
COUNT  min_ang;          /* The minimum angle the hopper can be before it must*/
                         /* have gone past the shift point. */
COUNT i,k;               /* Counts. */
COUNT temp_offset;       /* offset for rejectgate to bookeye.*/
TBOOL ret_val;           /* This is the return value.
                                 True if all hoppers learned.
                                 False for failure on any one hopper.  */

ret_val = 1;
temp_offset = be_to_rg + le_to_rg;

/*      Check all hopper that have to be learned.*/
p_stat = &sta_stat[fst_stat];
p_learn = &lrn_table[fst_stat];
for( i=fst_stat; i <= lst_stat; i++, p_stat++, p_learn++ )
        {
        if( p_learn->lrn_srv_ang )      /* only do those which are set. */
                {
                phopangle = &hopangle[i];
                tmp_ang = phopangle->angle[0];
                miss = 0;
                vmiss = 0;
/*
        Check if miss verify checking is disabled.
*/
                if( !no_missver )
                        {
/*
        compare the first angle to the rest.
*/
                        for( k=1; k <= 3; k++ )
                                {
                                diffangle = tmp_ang - phopangle->angle[k];
                                if( abs( diffangle ) > 130 )
                                        {
                                        if( diffangle > 0 )
                                                {
                                                vmiss = phopangle->angle[0];
                                                miss = phopangle->angle[k];
                                                }
                                        else
                                                {
                                                vmiss = phopangle->angle[k];
                                                miss = phopangle->angle[0];
                                                }
                                        break;
                                        }
                                else if( abs( diffangle ) > 10 )
                                        {
                                        if( diffangle > 0 )
                                                {
                                                vmiss = phopangle->angle[k];
                                                miss = phopangle->angle[0];
                                                }
                                        else
                                                {
                                                vmiss = phopangle->angle[0];
                                                miss = phopangle->angle[k];
                                                }
                                        break;
                                        }
        /*
                If all the angles are the same the service angle where not read
                correctly in learn_angles.
        */
                                else if( k == 3 )
                                        {
                                        num_completed--;
                                        phopangle->nextangle = 3;
                                        p_learn->set_angle = NO;
                                        ret_val = 0;
                                        }
                                }
                        }
                else
                        {
                        miss = phopangle->angle[0];
                        vmiss = (miss + 250) % 360;
                        }
/*
        set the angles in station status for 1up or 2up.
*/
                if( vmiss > miss )
                        vmiss = (vmiss + ((360 - vmiss) + miss) / 2) % 360;
                else
                        vmiss = (vmiss + (miss - vmiss) / 2) % 360;

                if( two_up )
                        {
```

```
                p_stat->ser_2up_angle = ( miss + cal_offset ) % 360;
                p_stat->ver_2up_ang = vmiss;
                if( in_start && p_learn->set_ins_pt )
                        {
                        min_ang = ( p_learn->init_2up_angle + 340 ) % 360;
                        if( (min_ang > p_stat->ser_2up_angle) &&
                            (min_ang < 340) )
                                {
                                p_stat->cpr_2up_off = p_learn->num_2up_pins + temp_offset - 1;
                                }
                        else if( (p_learn->init_2up_angle < 20) &&
                                 (min_ang < p_stat->ser_2up_angle) )
                                {
                                p_stat->cpr_2up_off = p_learn->num_2up_pins + temp_offset + 1;
                                }
                        else
                                {
                                p_stat->cpr_2up_off = p_learn->num_2up_pins + temp_offset;
                                }
                        p_stat->flt_offset = (p_stat->cpr_2up_off * 2) + p_stat->odd_even;
                        p_stat->inh_offset = p_stat->flt_offset + f_i_offset;
                        if( p_stat->ser_2up_angle < p_stat->ver_2up_ang )
                                p_stat->inh_offset += 2;
                        }
                }
        else
                {
                p_stat->ser_1up_angle = ( miss + cal_offset ) % 360;
                p_stat->ver_1up_ang = vmiss;
                if( in_start && p_learn->set_ins_pt )
                        {
                        min_ang = ( p_learn->init_1up_angle + 340 ) % 360;
                        if( (min_ang > p_stat->ser_1up_angle) &&
                            (min_ang < 340) )
                                {
                                p_stat->cpr_1up_off = p_learn->num_1up_pins + temp_offset - 1;
                                }
                        else if( (p_learn->init_1up_angle < 20) &&
                                 (min_ang < p_stat->ser_1up_angle) )
                                {
                                p_stat->cpr_1up_off = p_learn->num_1up_pins + temp_offset + 1;
                                }
                        else
                                {
                                p_stat->cpr_1up_off = p_learn->num_1up_pins + temp_offset;
                                }
                        p_stat->flt_offset = (p_stat->cpr_1up_off * 2) + p_stat->odd_even;
                        p_stat->inh_offset = p_stat->flt_offset + f_i_offset;
                        if( p_stat->ser_1up_angle < p_stat->ver_1up_ang )
                                p_stat->inh_offset += 2;
                                }
                        }
                }
        }

    return( ret_val );
    }

/*********************************************************************

        ini_ver_angle:  This routine is run before new hopper service angles
                are learned. It will initialize learn angle table and
                the variables for servicing the miss verify in station
                status table.  It should be called form the routine the
                initiates the learn sequence.

*********************************************************************/

VOID ini_ver_angle()
{
IMPORT REFLECT  hopangle[];     /* the hopper angle table. */
IMPORT TINY numgrips;           /* the num of grips on the hoppers. */
IMPORT UCOUNT   active_sections;                        /* last active station */
REFLECT *phopangle;     /* pointer into the hopper angle table. */
STAT_TMPLT *p_stat;     /* pointer into the station status table.*/
COUNT i;

p_stat = &sta_stat[1];
phopangle = &hopangle[1];
for( i=1; i <= num_stations; i++, p_stat++, phopangle++ )
        {
/*      variables for service routine. */
        p_stat->fstverify = 0;
        p_stat->saeverify = numgrips + 2;
/*      variables for learn mode. */
        if( no_missver )
                phopangle->nextangle = 0;
```

```
        else
                phopangle->nextangle = 3;

        phopangle->angle[0] = 0;
        phopangle->angle[1] = 0;
        phopangle->angle[2] = 0;
        phopangle->angle[3] = 0;
        }
/*
        clear out the misses and doubles.
*/
for( i = 1; i <= ( active_sections - 1 ); i++ )
        chg_table[i] &= 0x00FF;
return;
}

/*****************************************************************

        routine ini_lrn_cpr()

        Called by confgins to set up the hop_serv_table to schedule
        the insertion point learning routines.

        Initialize the service array for learn routines as:

                at shift point put on schedule list the routine
                LEARN_CPR().  this routine will count the number
                of pins from each hopper to the reject gate.

                at hopper service angle put on schedule list the
                routine LRN_SERV(). this rouitne will scan each hopper
                for feeds and enable LEARN_CPR to count the number of chain
                pins to the learn eye.

                at reject service angle put on schedule list the reject
                gate routines.

        All this is assuming that the correct order of learning things has
        been completed. ie must learn the hoppers and reject gate service points
        befor learning the hopper insertion points The order should be:

                        1. Set all config paramaters
                        2. Learn all physical hoppers
                        3. Learn reject gate service angles
                        4. Learn hoppr service angles
                        5. Learn hopper insertion points

        When all learned the config display will call the normal INI_ANGLES
        to put the nornal SHIFT and HOPSERV in the schedule list.
    Tables used are :

        LRN_TMPLT
                {
                UCOUNT  station                 station number
                TBOOL   lrn_ins_pt              yes if to learn  insertion pt
                TBOOL   lrn_srv_ang             yes if to learn service angle
                UCOUNT  num_1up_pins            number of pins to learn eye
                UCOUNT  num_2up_pins            number of pins to learn eye
                UCOUNT  ini_1up_ang             1up service angle for this hopper
                UCOUNT  ini_2up_ang             2up service angle for this hopper
                UCOUNT  num_tries               no. tries to get a miss
                TBOOL   set_angle               hop has learned angle
                TBOOL   set_ins_pt              hop has learned insertion point
                UCOUNT  ver_1up_ang             miss verify angle for 1up.
                UCOUNT  ver_2up_ang             miss verify angle for 2up.
                }

*********************************************************************/


VOID ini_lrn_cpr()
{
IMPORT  RJ_TMPLT        rj_one_angles[];
IMPORT  RJ_TMPLT        rj_two_angles[];
IMPORT  UCOUNT          num_rj_angles;
IMPORT  UCOUNT          active_sections;                /* last active station */
IMPORT  SRV_TMPLT       hop_serv_lst[];
IMPORT  STAT_TMPLT      sta_stat[];
IMPORT  UCOUNT          enc_inp_deg;                    /* Input encoder gray degrees */
IMPORT  UCOUNT          fst_stat, lst_stat;
IMPORT  SRV_TMPLT       *next_service;
IMPORT  TBOOL           two_up, start_at_zero;
IMPORT  LRN_TMPLT       lrn_table[];
IMPORT  UCOUNT          hop_in_learn;
IMPORT  UCOUNT          lw_eye_angle;
IMPORT  VOID            lrn_shift();
IMPORT  VOID            rej_cycle();
```

```
FAST    RJ_TMPLT        *p_reject;
FAST    STAT_TMPLT      *p_stat;
FAST    SRV_TMPLT       *p_serv;
LRN_TMPLT  *p_learn;
UCOUNT  i, j, tmp_angle;
UCOUNT  ver_angle;              /* temp to hold the verify angle. */

p_serv = hop_serv_lst;

p_serv->angle = 0;
p_serv->routine = (ARGINT)lrn_shift;
p_serv->tcw = NULL;
p_serv->next = ++p_serv;

/*
        putting reject routine to always reject into the service table.
*/
p_serv->angle = 0;
p_serv->routine = (ARGINT)rej_cycle;
p_serv->tcw = NULL;
p_serv->next = ++p_serv;


for ( i=0; i < 360; i++ )
        {
/*
        putting the learn eye service routines into the service table.
*/

        if( i == lw_eye_angle)
                {
                p_serv->angle = i;
                p_serv->routine = (ARGINT)learn_cpr;
                p_serv->tcw = NULL;
                p_serv->next = ++p_serv;
                }


/*
        check for miss and miss verify for all stations
*/
        p_stat = &sta_stat[1];
        p_learn = &lrn_table[1];
        for( j=1; j <= num_stations; j++, p_stat++, p_learn++ )
            {
/*
        if the hopper is present then put a service routine for the
        miss and the miss verify.
*/
                if( p_stat->physical )
                        {
                        if (two_up)
                                {
                                tmp_angle = p_learn->init_2up_angle;
                                ver_angle = p_learn->ver_2up_angle;
                                }
                        else
                                {
                                tmp_angle = p_learn->init_1up_angle;
                                ver_angle = p_learn->ver_1up_angle;
                                }

                        if( tmp_angle == i )
                            {
                                p_serv->angle = i;
                                p_serv->routine = (ARGINT)lrn_serv;
                                p_serv->tcw = p_stat->station;
                                p_serv->next = ++p_serv;
                            }

                        if( ver_angle == i )
                            {
                                p_serv->angle = i;
                                p_serv->routine = (ARGINT)lrn_veri;
                                p_serv->tcw = p_stat->station;
                                p_serv->next = ++p_serv;
                            }
                    }
            }
    }


/*
        set up the learn table for learning
*/
p_learn = &lrn_table[fst_stat];
for (j=fst_stat; j <= lst_stat; j++, p_learn++)
```

```
        {
        p_learn->lrn_ins_pt = YES;
        p_learn->set_ins_pt = NO;
        p_learn->station = j;
        p_learn->num_tries = 3;
        }

        /* point back to top of list */
--p_serv;
p_serv->next = next_service = hop_serv_lst;
        /* start at first hopper */
hop_in_learn = fst_stat;
if (two_up)
        lrn_table[hop_in_learn].num_2up_pins = 0;
else
        lrn_table[hop_in_learn].num_1up_pins = 0;

/*
        initialize the hoppers.
*/
ini_ver_angle();
start_at_zero = NO;

/*
        allow learning of the insertion points.
*/
lrn_table[0].set_ins_pt = NO;

return;
}

/*

        routine to shift for learn

*/

lrn_shift()
{
if( strt_counting )
        {
        if (two_up)
                lrn_table[hop_in_learn].num_2up_pins++;         /* one more chain space */
        else
                lrn_table[hop_in_learn].num_1up_pins++;         /* one more chain space */
        }
return;
}

/*****************************************************************************

                        COPYRIGHT (C)  1985
                BY HARRIS GRAPHICS CORP., CHAMPLAIN, NY
                        ALL RIGHTS RESERVED


Project:        CABCON II

Module:         INIJAMS.C

Version:        X1

Abstract:       Initialize all the tables used by JAMS.C

Author:         T. ROWE

Created:        2-JULY-85

Modified by:

        Who             Date            Description of Modification
        ---             ----            ---------------------------


*****************************************************************************/

#include <std.h>
#include <config.h>
#include <gpr/icd.h>

SECTION( TEXT, 4);              /* prom */
SECTION( DATA, 1);              /* onboard ram */
IDNT( 1,1,"");


/*********************************************************

        initialize jam parameters for learn mode

*********************************************************/

IMPORT TBOOL  jam_lrn_flg;
```

```
IMPORT  UCOUNT          gray_degs[];                    /* Table to convert gray_code to degrees */
IMPORT  UCOUNT          enc_ins_deg;                    /* Input encoder gray degrees */
IMPORT  UCOUNT          enc_deg, last_enc_deg, enc_zero, rot_dir;
IMPORT UCOUNT           chg_table[];
IMPORT UCOUNT           active_sections;                /* number of active pamux stations in system */
IMPORT UCOUNT           num_jams;                       /* last jam number */
IMPORT UCOUNT           fst_jam, lst_jam;
IMPORT  SRV_TMPLT       nxt_serv_lst[];
IMPORT JAM_TMPLT        jam_table[];                    /* table of jam cpr offsets, patterns and run data */
IMPORT VOID             jm_track();
IMPORT VOID             jm_count();
IMPORT VOID             rej_cycle();
IMPORT UCOUNT           jam_in_learn;
IMPORT UCOUNT           i_laye_mask,i_gvfy_mask,o_rjls_mask;
IMPORT UCOUNT           num_completed;
IMPORT UCOUNT           out_table[];
IMPORT UCOUNT           num_stations;
IMPORT STAT_TMPLT       sta_stat[];
IMPORT TBOOL            strt_counting;
IMPORT UCOUNT           lw_eye_angle;                   /* angle to service white pins for learn */
IMPORT SRV_TMPLT        *next_service;
IMPORT UCOUNT           i_jam_mask[];

set_jam_table()

{

UCOUNT          i, j,*p_chg_table;
JAM_TMPLT       *p_jam_tbl;                             /* pointer to jam table */
SRV_TMPLT       *p_serv;
STAT_TMPLT      *p_stat;

p_jam_tbl = jam_table;                                  /* initial jam table pointer */
num_jams = (active_sections-1)*2;                       /* 2 jam switches for each active section */

p_chg_table = chg_table;
*p_chg_table &= ~i_laye_mask;
*p_chg_table &= ~i_gvfy_mask;
out_table[0] &= ~o_rjls_mask;

for ( i=0; i <= num_jams; p_jam_tbl++, i++ )
        {
        p_jam_tbl->lrn_jam_pt = NO;
        p_jam_tbl->set_jam_pt = NO;

        for ( j=i+2; j<= num_stations; j++ )
                {
                p_stat = &sta_stat[j];
                if ( p_stat->physical )
                        {
                        p_jam_tbl->station = j;
                        break;
                        }
                }
        if( j == num_stations + 1 )
                {
                for ( j = num_stations; j > 0; j-- )
                        {
                        p_stat = &sta_stat[j];
                        if ( p_stat->physical )
                                {
                                p_jam_tbl->station = j;
                                break;
                                }
                        }
                }
        }


for ( i=fst_jam, j=fst_jam-1; i <=lst_jam; i++, j++ )   /* check all jam switches */
        {
        p_jam_tbl = &jam_table[i];
        p_jam_tbl->jam_number = i;                      /* jam number */
        p_jam_tbl->pamux_jam = j % 2;                   /* jam # for each pamux  (0 or 1)*/
        p_jam_tbl->chg_address = (ULONG)&chg_table[j/2 + 1];    /* change table address for this jams */
        p_jam_tbl->lrn_jam_pt =YES;
        p_jam_tbl->num_faults = 1;
        p_jam_tbl->even_offset = 2;                     /* two_up even (black) offset */
        p_jam_tbl->odd_offset = 1;                      /* two_up odd (white) offset */

        p_chg_table = p_jam_tbl->chg_address;
        *p_chg_table &= ~i_jam_mask[p_jam_tbl->pamux_jam];      /* clear out jam in chg table */

        }

num_completed = 0;
strt_counting = NO;
jam_in_learn = fst_jam;
jam_table[fst_jam].num_pins = 0;        /* restart number of pins counter */
enab_jam_restart( jam_in_learn );
jam_ang_sort();                         /* setup the service table. */
jam_lrn_flg = YES;
return;
}

/*****************************************************************************

        This routine will set up the service list for
        learning jams.

*****************************************************************************/

jam_ang_sort()
{
IMPORT  RJ_TMPLT        rj_one_angles[];
```

```
IMPORT  RJ_TMPLT        rj_two_angles[];
IMPORT  UCOUNT          num_rj_angles;
IMPORT  UCOUNT          active_sections;                    /* last active station */
IMPORT  SRV_TMPLT       hop_serv_lst[];
IMPORT  STAT_TMPLT      sta_stat[];
IMPORT  UCOUNT          fst_stat, lst_stat;
IMPORT  SRV_TMPLT       *next_service;
IMPORT  TBOOL           two_up, start_at_zero;
IMPORT  LRN_TMPLT       lrn_table[];
IMPORT  UCOUNT          hop_in_learn;
IMPORT  UCOUNT          lw_eye_angle;
IMPORT  VOID            jm_count(), jm_track();
IMPORT  VOID            lrn_serv();
IMPORT  VOID            lrn_veri();
IMPORT  VOID            rej_cycle();

FAST    STAT_TMPLT      *p_stat;
FAST    SRV_TMPLT       *p_serv;
LRN_TMPLT  *p_learn;
UCOUNT  i, j, tmp_angle;
UCOUNT  ver_angle;              /* temp to hold the verify angle. */

p_serv = hop_serv_lst;

/*
        shift point.
*/
p_serv->angle = 0;
p_serv->routine = (ARGINT)jm_count;
p_serv->tcw = NULL;
p_serv->next = ++p_serv;                                    /* point to next element */

/*
        putting reject routine to always reject into the service table.
*/
p_serv->angle = 0;
p_serv->routine = (ARGINT)rej_cycle;
p_serv->tcw = NULL;
p_serv->next = ++p_serv;


for ( i=0; i < 360; i++ )
        {
/*
        putting the learn eye service routines into the service table.
*/

        if( i == lw_eye_angle)
                {
                p_serv->angle = i;
                p_serv->routine = (ARGINT)jm_track;
                p_serv->tcw = NULL;
                p_serv->next = ++p_serv;
                }


/*
        check for miss and miss verify for all stations
*/
        p_stat = &sta_stat[1];
        p_learn = &lrn_table[1];
        for( j=1; j <= num_stations; j++, p_stat++, p_learn++ )
            {
/*
        if the hopper is present then put a service routine for the
        miss and the miss verify.
*/
                if( p_stat->physical )
                        {
                        if (two_up)
                                {
                                tmp_angle = p_learn->init_2up_angle;
                                ver_angle = p_learn->ver_2up_angle;
                                }
                        else
                                {
                                tmp_angle = p_learn->init_1up_angle;
                                ver_angle = p_learn->ver_1up_angle;
                                }

                        if( tmp_angle == i )
                            {
                                p_serv->angle = i;
                                p_serv->routine = (ARGINT)lrn_serv;
                                p_serv->tcw = p_stat->station;
                                p_serv->next = ++p_serv;
                            }

                        if( ver_angle == i )
                            {
```

```
                        p_serv->angle = i;
                        p_serv->routine = (ARGINT)lrn_veri;
                        p_serv->tcw = p_stat->station;
                        p_serv->next = ++p_serv;
                    }
                }
            }
        }

        /* point back to top of list */
    --p_serv;
    p_serv->next = next_service = hop_serv_lst;
        /* start at first hopper */

    /*
        initialize the hoppers.
    */
    ini_ver_angle();

/*****************************************************************************

                    COPYRIGHT (C)  1985
            BY HARRIS GRAPHICS CORP., CHAMPLAIN, NY
                    ALL RIGHTS RESERVED

Project:        CABCON II

Module:         LRNJAMS.C

Version:        X1

Abstract:       Learn jams insertion points

Author:         T. ROWE

Created:        30-SEP-85

Modified by:

        Who             Date            Description of Modification
        ---             ----            ---------------------------

*****************************************************************************/

#include <std.h>
#include <service.h>
#include <config.h>
#include <mm35rtc.h>
#include <msglog.h>

SECTION( TEXT, 0);              /* onboard ram */
SECTION( DATA, 1);              /* onboard ram */
IDNT( 1,1,"");

/*****************************************************************************
        Function:       jm_track()

        Scheduled via ENCODER at the learn eye angle for a white pin.

        The purpose of this routine is to learn the insertion points
for each jam. To accomplish this the following must be done to start
the learn process:

                1. Put this routine on the schedule list at its angle at jam signal
                    from jam (every 10 msec) ,, set_jam_table (inijams.c) will
                    initially put rej_cycle and no jams on list..

                2. Clear strt_counting; which will be set once a jam has
                   recorded its first occurance.

                3. Clear learn eye and bood book verify eye change table values.

        When the marked jam pin gets to the learn eye the JAM_TABLE will be
updated with the appropiate number of pins value. The jam to be learned
will be indicated on the tube and # of pins traveled. When all jams are learned
the learn diaplay routine should re_establish all service angles via INI_ANGLES
after the gatherer has come to a stop.

        When all jams have learned their insertion points then a completion
flag will be set... which is JAM_TABLE[0]->set_jam_pt

        Variables used are:

                strt_counting - set (in GET_JAM) when a jam has marked a chain pin
                                for tracking
```

jam_in_learn - contains the jam number under test so all others are bypassed. (starts at fst_jam and increments to lst_jam )

be_to_rg - number of pins from book eye to reject gate le_to_rg - number of pins from learn eye to reject gate ( as initially set up in a previous config display )

jam_lrn_flg - indicates to start learn test and enables servicing of of get_jam routine (via JAM.C). when cleared no more learning..

A table will be set up that indicates which hoppers are to be learned, the learned value, and the number of pins to reject gate. It is formatted as follows:

```
typedef struct  JAM_TMPLT
        {
        UCOUNT  jam_number;                     jam ID number
        ULONG   ind_jams;                       individual jams for this jam switch
        UCOUNT  init_offset;                    initial CPR offset
        UCOUNT  num_pins;                       number of pins to reject gate
        UCOUNT  num_faults;                     number of faults to be inserted into CPR
        UCOUNT  pamux_jam;                      pamux # for this jam
        ULONG   chg_address;                    address of change table for jam
        TBOOL   lrn_jam_pt;                     jam to be learned  flag
        TBOOL   set_jam_pt;                     jam has been learned flag
 UCOUNT  station;                       station closest to jam switch
 UCOUNT  even_angle;                    encoder angle when white pin is at jam switch
 UCOUNT  odd_angle;                     encoder angle when black pin is at jam switch
 UCOUNT  even_offset;                   offset into cpr for even chainpin
 UCOUNT  spare[2];                      make it two lines per jam
 } JAM_TMPLT;
*****************************************************************/

IMPORT TIME_DAY  o_ljams;
IMPORT TIME_DAY  daytime;

IMPORT UCOUNT   jam_in_learn;
IMPORT TBOOL    strt_counting;
IMPORT UCOUNT   le_to_rg, be_to_rg;
IMPORT UCOUNT   i_leye_mask, i_gvfy_mask, o_conv_mask, o_tape_mask;
IMPORT UCOUNT   chg_table[], out_table[];
IMPORT UCOUNT   o_stop_mask, o_miss_mask[], o_dbl_mask[];
IMPORT MSG_TBL  l_nrj_msg;                      /* learn book not rejected */
IMPORT MSG_TBL  jaml_msg;                       /* insertion points learned message */
IMPORT JAM_TMPLT jam_table[];
IMPORT UCOUNT   lst_jam;
IMPORT UCOUNT   anc_deg;
IMPORT UCOUNT   num_completed;
IMPORT TBOOL    two_up;
IMPORT   TIME           conv_timer;

jm_track()

{

UCOUNT *p_chgtbl;
FAST JAM_TMPLT *p_and_lrn;
JAM_TMPLT *p_jam;
UCOUNT i, jam, temp_offset, tmp_jam;

if (jam_table[0].set_jam_pt )                   /* if all finished just get out */
        return;
out_table[0] |= o_tape_mask;                    /* turn on tapes */

if (strt_counting)                              /* don't do anyting till we have a good feed */
        {
        p_jam = &jam_table[jam_in_learn];
        p_chgtbl = chg_table;

        if ( *p_chgtbl & i_gvfy_mask )
                {
                *p_chgtbl &= ~i_gvfy_mask;      /* clear out bit in table */
                jam = 1;
                enab_jam_restart(jam);          /* stop at first hopper closest to rej gate */
                                                /* routine found in rjlearn.c */
                tmp_jam = jam_in_learn - 1;     /* last jam didn't rej*/
                sys_msg(0, &l_nrj_msg, tmp_jam);  /* did not reject learn product */
                }

        if ( *p_chgtbl & i_leye_mask )          /* at the learn eye yet */
                {
                *p_chgtbl &= ~i_leye_mask;      /* clear out bit in table */
                strt_counting = NO;             /* allow next hopper to be set up */
                out_table[0] |= o_conv_mask;    /* turn on conveyor */
                starttime(&conv_timer);         /* for a sec */
                num_completed++;                /* one more jam completed counter */
                p_jam = &jam_table[jam_in_learn];
                temp_offset = be_to_rg + le_to_rg;
                p_jam->init_1up_offset = p_jam->init_2up_offset = ( p_jam->num_pins + temp_offset ) * 2;

                if ( lst_jam >= jam_in_learn + 1 )
                        {
```

```
                for ( i = jam_in_learn + 1; i <= lst_jam; i++ )
                        {
                        p_jam = &jam_table[i];
                        if (p_jam->lrn_jam_pt )
                                {
                                jam_in_learn = p_jam->jam_number;
                                p_jam->num_pins = 0;
                                enab_jam_restart(jam_in_learn); /* flash next jam to do*/
                                return;
                                }
                        }

                }
        out_table[0] |= o_stop_mask;            /* stop gatherer */
        timemsg (1000, 4, &jam1_msg, NULL);     /* completed learn mode message */
        jam_table[0].set_jam_pt = YES;          /* indicate all completed */
        jam_in_learn = 0;
        cpybuf( &d_1jams, &daytime, sizeof(daytime));
        }
    }
}

/*****************************************************************

        increment the number of pins for this jam..it stops
        counting via jm_track which is serviced at the learn eye
        service point.

        this routine is serviced at the shift angle of 0 deg

*****************************************************************/
IMPORT UCOUNT num_stations;
IMPORT STAT_TMPLT sta_stat[];


jm_count()

{
JAM_TMPLT *p_jam;
UCOUNT i, hop, stat, *p_outtbl;
STAT_TMPLT *p_stat;

if ( strt_counting )
        {
        p_jam = &jam_table[jam_in_learn];
        p_jam->num_pins++;
        if ( stat = p_jam->station )
                p_stat = &sta_stat[stat];
        else
                {
                for ( i=1; i <= num_stations; i++ )
                        {
                        p_stat = &sta_stat[i];
                        if (p_stat->physical)
                                break;
                        }
                }
        p_outtbl = p_stat->out_address;
        hop = p_stat->pmux_hop;
        *p_outtbl |= o_miss_mask[hop];
        *p_outtbl |= o_dbl_mask[hop];
        startime(p_stat->dbl_timer);            /* and set timer to turn off light */
        startime(p_stat->miss_timer);           /* set timer to turn off light */
        }

/*****************************************************************

Function:       get_jam()
                ---------

        Scheduled via JAM routine every 10 msec scan.

        It scans the jam inputs starting at the FST_JAM and when one occurs
it enables pin tracking via STRT_COUNTING flag. JM_TRACK routine will update
the next hopper to be learned (jam_in_learn global)
        It then puts on the hop_serv_list this jam at its angle (as read from encoder)

        jam_in_learn --- jam that is presently in test for learn
        strt_counting -- set when a jam is in test

        When all jam swithces have been learned the set_jam-pt in JAM_TABLE[0]
will be set then the calling display routine will set learn initializing
flag (jam_lrn_flag). With this done no longer will this routine or any learn
routines be called.

*****************************************************************/
```

```
IMPORT UCOUNT chg_table[];                          /* change table of input transitions */
IMPORT UCOUNT i_jam_mask[];                         /* input jam_number jam mask table */
IMPORT UCOUNT o_stop_mask;                          /* output gatherer stop mask */
IMPORT MSG_TBL mjam_msg;
IMPORT UCOUNT jam_in_learn, num_jams;
IMPORT TBOOL  end_move;
IMPORT SRV_TMPLT        *next_service;
IMPORT  SRV_TMPLT       map_serv_lst[];

get_jam()
{

UCOUNT i, *p_chgtbl;                                /* change table pointer for appropriate jam_number */
FAST JAM_TMPLT *p_jam;                              /* jam_number status pointer for appropriate jam_number */

if (jam_table[0].set_jam_pt )                       /* if all finished just get out */
        return;

p_jam = &jam_table[jam_in_learn];                   /* jam_number status for this jam */
p_chgtbl = p_jam->chg_address;                      /* change table address for this jam */

if ( *p_chgtbl & i_jam_mask[p_jam->pamux_jam] )     /* if no jam then see if test started */
        {
        *p_chgtbl &= ~i_jam_mask[p_jam->pamux_jam]; /* clear out jam in chg table */

        if (strt_counting && end_move)
                {
                sys_msg(0, &mjam_msg, jam_in_learn );   /* more than one pin has a jam */
                enab_jam_restart(jam_in_learn);
                }
        else if ( !strt_counting )
                {
                strt_counting = YES;                /* we have begun to learn this jam */
                p_jam->even_angle = end_deg;        /* on white pin so set angle */
                p_jam->odd_angle = (end_deg + 180) % 360;
                chg_table[0] &= ~i_leve_mask;       /* clear out bit in table */
                }
        }

for ( i=1; i <= num_jams; i++ )                 /* check all jam switches */
        {
        p_jam = &jam_table[i];                  /* jam_number status for this jam */
        p_chgtbl = p_jam->chg_address;                  /* change table address for this jam */
        if (( i != jam_in_learn ) && (*p_chgtbl & i_jam_mask[p_jam->pamux_jam]))
                {
                *p_chgtbl &= ~i_jam_mask[p_jam->pamux_jam];     /* clear out jam in chg table */
                sys_msg(0, &mjam_msg, i );      /* more than one pin has a jam */
                enab_jam_restart(i);
                }
        }
}
```

```
/*******************************************************

 stop the gatherer for a jam in learn error and enable
 the system to be restarted at a hopper closest to the
 jam.

*******************************************************/


IMPORT UCOUNT       o_stop_mask, o_miss_mask[], o_dbl_mask[];
IMPORT UCOUNT       num_stations;
IMPORT STAT_TMPLT   sta_stat[];
IMPORT UCOUNT       out_table[];
IMPORT UCOUNT       rj_num_tries;
IMPORT TBOOL        fault_flag;
IMPORT VOID         chg_light();

enab_jam_restart(jam)

UCOUNT jam;

{

FAST STAT_TMPLT  *p_stat;
UCOUNT  *p_outtbl;

out_table[0] |= o_stop_mask;                            /* stop gatherer */
fault_flag = YES;
p_stat = &sta_stat[ jam_table[jam].station ];

p_stat->flt_stop = YES;                 /* allows the first hopper to restart test */
killtime (p_stat->dbl_timer);
killtime (p_stat->miss_timer);
p_outtbl = p_stat->out_address;
*p_outtbl |= o_miss_mask[p_stat->pmux_hop];
*p_outtbl |= o_dbl_mask[p_stat->pmux_hop];
settime (p_stat->dbl_timer, &chg_light, p_stat->station, 40 );
startime( p_stat->dbl_timer );
return;
}
IMPORT   UCOUNT          o_rjls_mask;

rej_cycle()
{

out_table[0] &= ~o_rjls_mask;                   /* let it cycle up down */

}
```

```
/*****************************************************************************

                    COPYRIGHT (C)  1985
            BY HARRIS GRAPHICS CORP., CHAMPLAIN, NY
                    ALL RIGHTS RESERVED


Project:        CABCON II

Module:         ini_angles

Version:        X1

Abstract:       set up link list of routines for service at encoder angles

Author:         T.ROWE

Created:

Modified by:

        Who             Date            Description of Modification
        ---             ----            ---------------------------


*****************************************************************************/
#include <std.h>
#include <config.h>
#include <service.h>

SECTION( TEXT, 4);              /* prom */
SECTION( DATA, 1);              /* onboard ram */
IDNT( 1,1,"");


VOID ini_angles()
{

IMPORT  RJ_TMPLT        rj_one_angles[];
IMPORT  RJ_TMPLT        rj_two_angles[];
IMPORT  UCOUNT          num_rj_angles;

IMPORT  TBOOL           start_at_zero;
IMPORT  TBOOL           cross_zero;

IMPORT  VOID            flt_serv(), shift();
IMPORT  VOID            ver_miss();             /* verify miss service */
IMPORT  VOID            bk_verify();

IMPORT  TBOOL           two_up;
IMPORT  SRV_TMPLT       hop_serv_lst[];
IMPORT  SRV_TMPLT       *next_service;
IMPORT  STAT_TMPLT      sta_stat[];
IMPORT  UCOUNT          num_stations;
IMPORT  UCOUNT          bk_eye_angle;
IMPORT  LRN_TMPLT       lrn_table[];

FAST    STAT_TMPLT      *p_stat;
FAST    SRV_TMPLT       *p_serv;
RJ_TMPLT                *p_reject;
FAST    UCOUNT          i;
UCOUNT                  j;
UCOUNT                  blk_bk_eye;             /* temp to hold black eye angle. */

/*
        setup angle for black book good book eye service angle.
*/

blk_bk_eye = (bk_eye_angle + 180) % 360;

/*************************************************************

        insert shift routine into the service table.

*************************************************************/

p_serv = hop_serv_lst;
p_serv->angle = 0;
p_serv->routine = (ARGINT)shift;
p_serv->tcw = NULL;
p_serv->next = ++p_serv;

for ( i=0; i < 360; i++ )
    {
/*************************************************************
```

```
        determine reject gate insertion order
*************************************************************/

        if ( two_up )
                {
                p_reject = rj_two_angles;
                num_rj_angles = 4;
                }
        else
                {
                p_reject = rj_one_angles;
                num_rj_angles = 2;
                }
        for ( j=1; j <= num_rj_angles; p_reject++, j++ )
                {
                if ( (p_reject->angle == i ) && p_reject->routine )
                        {
                        p_serv->angle = p_reject->angle;
                        p_serv->routine = p_reject->routine;
                        p_serv->tcw = p_reject->tcw;
                        p_serv->next = ++p_serv;
                        }
                }
/*************************************************
        determine hopper service insertion order
*************************************************/

        p_stat = &sta_stat[1];
        for( j=1; j <= num_stations; p_stat++, j++ )
                {
                if( p_stat->physical )
                        {
                        if (two_up)
                                {
                                if( lrn_table[j].num_2up_pins )
                                        if( p_stat->ser_2up_angle == i )
                                                {
                                                p_serv->angle = i;
                                                p_serv->routine = (ARGINT)flt_serv;
                                                p_serv->tcw = p_stat->station;
                                                p_serv->next = ++p_serv;
                                                }
                                        else if( p_stat->ver_2up_ang == i )
                                                {
                                                p_serv->angle = i;
                                                p_serv->routine = (ARGINT)ver_miss;
                                                p_serv->tcw = p_stat->station;
                                                p_serv->next = ++p_serv;
                                                }
                                }
                        else
                                {
                                if( lrn_table[j].num_1up_pins )
                                        if( p_stat->ser_1up_angle == i )
                                                {
                                                p_serv->angle = i;
                                                p_serv->routine = (ARGINT)flt_serv;
                                                p_serv->tcw = p_stat->station;
                                                p_serv->next = ++p_serv;
                                                }
                                        else if( p_stat->ver_1up_ang == i )
                                                {
                                                p_serv->angle = i;
                                                p_serv->routine = (ARGINT)ver_miss;
                                                p_serv->tcw = p_stat->station;
                                                p_serv->next = ++p_serv;
                                                }
                                }/* end if !twoup. */

                        }/* end if physical. */

                }/* for numstations. */

/*************************************************************
        determine book eye service angle insertion
*************************************************************/

        if( two_up )
                {
                if ( bk_eye_angle == i )
                        {
                        p_serv->angle = i;
                        p_serv->routine = (ARGINT)bk_verify;
                        p_serv->tcw = 1;
                        p_serv->next = ++p_serv;
                        }
                else if ( blk_bk_eye == i )
                        {
```

```
                        p_serv->angle = i;
                        p_serv->routine = (ARGINT)bk_verify;
                        p_serv->tcw = 0;
                        p_serv->next = ++p_serv;
                        }
                }
        else
                {
                if ( bk_eye_angle == i )
                        {
                        p_serv->angle = i;
                        p_serv->routine = (ARGINT)bk_verify;
                        p_serv->tcw = 0;
                        p_serv->next = ++p_serv;
                        }
                }

        }/* for 360 */

 ini_ver_angle();                                   /* miss verify initialization. */

 --p_serv;
 p_serv->next = next_service = hop_serv_lst;                /* point back to top of list */

 start_at_zero = NO;                                        /* start at  zero crossing */
 cross_zero = NO;                                           /* indicates when zero crossed */

 return;
 }

        display("\33[3;3HINVALID FIRST TO LAST");
        sleep(200);
        display("\33[3;1H\33[2K");
        break;
    }
display("\33[3;3HSTOPPING GATHERER");   /* flash message */
stop_gath();                            /* stop gatherer */
set_jam_table();                        /* setup angle table */
display("\33[3;1H\33[2K");              /* clear message */
display("\33[3;3HSWITCH     IS BEING LEARNED"); /* display message */
display("\33[4;3H     CHAIN PINS FROM LE.");
p_jam = jam_table;
while( !p_jam->set_jam_pt )     /* while learning */
    {
        dspnum(jam_in_learn,3,10,3);    /* display hopper number being learned */
        p_jam2 = &jam_table[jam_in_learn];
        dspnum(p_jam2->num_pins,4,3,3);
        dismsgline();
        dspnum( enc_deg, 1, 20, 3);
        prt_time();
        /* Read in botton. */

        in = response();

        switch ((in >= -1 && in <= 60) ? buttons[in+1] : in )
                {
                case 'F':
                        if( exitdis )
                                {
                                if( !fault_flag )
                                        fstop_regath();         /* stop gatherer */
                                jam_lrn_flg = NO;
                                p_jam->set_jam_pt = YES;
                                schedule( ini_angles , NULL );
                                uclearline( 5 );
                                return;
                                }
                        else
                                {
                                exitdis = YES;
                                utimemsg( 1000, 5, &abortlrn, NULL );
                                startime( &noexit );
                                }
                        break;

                case 'h':
                        paintcrt();
                        display("\33[3;3HSWITCH     IS BEING LEARNED"); /* display message */
                        display("\33[4;3H     CHAIN PINS (28 INCHES).");
                        up_con_jam();   /* update screen */
                        dspnum(num,7,19,3);     /* display new number */
                        break;

                default:
                        break;
                }
    }
display("\33[3;1H\33[2K");              /* clear message */
display("\33[4;32H\33[1K");             /* clear message */
display("\33[3;7HJAM SWITCHES LEARNED");        /* flash message */
```

```
        dspnum(num_completed,3,3,3);            /* display number */
        sleep(200);                             /* delay */
        display("\33[3;1H\33[2K");              /* clear message */
        jam_lrn_flg = NO;
        schedule( ini_angles , NULL );
        if( !fault_flag )
                fstart_gath();                  /* start gatherer */
        display("\33[3;3HEITHER LEARN MORE SWITCHES OR EXIT"); /* flash message */

        clear_resp();           /* clear any touches made while learning */

        break;

case 'D':               /* decrement number */
        beep();
        if( firsthit )
                {
                firsthit = 0;
                uclearline( 5 );
                display("\33[5;36H\33[m");
                display("\33[6;36H\33[m");
                break;
                }
        display("\33[14p");     /* turn on auto repeat */
        if(num == 0)    /* if num is zero */
                num = last_swi; /* set to last hopper number */
        else            /* if not */
                num--;  /* decrement */
        dspnum(num,7,19,3);     /* display new number */
        break;

case 'E':               /* set last hopper to be learned */
        beep();
        if( firsthit )
                {
                firsthit = 0;
                uclearline( 5 );
                display("\33[5;36H\33[m");
                display("\33[6;36H\33[m");
                break;
                }
        display("\33[15p");     /* turn off auto repeat */
        if(num == 0)    /* if number is zero */
                cj_no_jam();    /* flash error mesage */
        else            /* if not */
            {
                lst_jam = num;  /* save number to be displayed */
                cnt = 0;                        /* flag to update */
            }
        break;

case 'F':               /* exit */
        beep_ack();
        uclearline( 5 );
        display("\33[15p");     /* turn off auto repeat */
        display("\33[2J");      /* clear the screen */
        return;                 /* return to confgmenu */
        break;

case 'X': /* not a botton */
                        break;

                case 'n':  /* error */
                        goto again;
                        break;

                default:
                        break;
                        } /* End switch */


                } /* End forever */


        } /* End confgang */


up_con_jam()    /* update screen */
{


        dspnum(fst_jam,10,39,3);        /* display first */

        dspnum(lst_jam,14,39,3);        /* display last */

        return;

}
```

```
cj_no_jam()     /* message for zero hopper */
{
        display("\33[6;30H\33[m");      /* turn off enhancements */
        display("\33[6;13H\33[6;7m NO SWITCH ZERO");    /* flash message */

        sleep(200);     /* delay */

        display("\33[6;13H                    "); /* clear message */

        return;
}

LOCAL paintcrt()
{
        flush_outq();

        ini_fluke();


                /* Row 1 */
        display("\33[1;1HENCODER ANGLE - \33[1;26HLEARN JAM SWITCHES");


                /* Row 4 */
        display("\33[4;72H\33[m");
        display("\33[4;33H\33[8mkdddddddddddd1");
        display("\33[4;57H\33[8mkdddddddddddd1");


                /* Row 5 */
display("\33[5;34H\33[3p9\33[2p     AUTO     \33[3p9\33[2p");
display("\33[5;58H\33[3p9\33[2p     JAM      \33[3p9\33[2p");


        /* Row 6 */
display("\33[6;34H\33[3p9\33[2p    LEARN     \33[3p9\33[2p");
display("\33[6;58H\33[3p9\33[2p DIAGNOSTIC \33[3p9\33[2p");


        /* Row 7 */
display("\33[7;72H\33[m");
display("\33[7;11HNUMBER-[   ]");
display("\33[7;33H\33[8mmddddddddddddn");
display("\33[7;57H\33[8mmddddddddddddn");


        /* Row 8 */
display("\33[8;24H\33[m\33[8;48H\33[m\33[8;72H\33[m");
display("\33[8;9H\33[8mkdddddddddddd1");
display("\33[8;33H\33[8mkdddddddddddd1");
display("\33[8;57H\33[8mkdddddddddddd1");


        /* Row 9 */
display("\33[9;10H\33[3p9\33[2p     INC      \33[3p9\33[2p");
display("\33[9;34H\33[3p9\33[2p FIRST JAM  \33[3p9\33[2p");
display("\33[9;58H\33[3p9\33[2p    LEARN     \33[3p9\33[2p");


        /* Row 10 */
display("\33[10;10H\33[3p9\33[2p     NUM      \33[3p9\33[2p");
display("\33[10;34H\33[3p9\33[2p              \33[3p9\33[2p");
display("\33[10;58H\33[3p9\33[2p     JAMS     \33[3p9\33[2p");


        /* Row 11 */
display("\33[11;24H\33[m\33[11;48H\33[m\33[11;72H\33[m");
display("\33[11;9H\33[8mmddddddddddddn");
display("\33[11;33H\33[8mmddddddddddddn");
display("\33[11;57H\33[8mmddddddddddddn");


        /* Row 12 */
display("\33[12;24H\33[m\33[12;48H\33[m\33[12;72H\33[m");
display("\33[12;9H\33[8mkdddddddddddd1");
display("\33[12;33H\33[8mkdddddddddddd1");
display("\33[12;57H\33[8mkdddddddddddd1");


        /* Row 13 */
display("\33[13;10H\33[3p9\33[2p     DEC      \33[3p9\33[2p");
display("\33[13;34H\33[3p9\33[2p  LAST JAM   \33[3p9\33[2p");
display("\33[13;58H\33[3p9\33[2p     EXIT     \33[3p9\33[2p");


        /* Row 14 */
display("\33[14;10H\33[3p9\33[2p     NUM      \33[3p9\33[2p");
display("\33[14;34H\33[3p9\33[2p              \33[3p9\33[2p");
display("\33[14;58H\33[3p9\33[2p              \33[3p9\33[2p");
```

```
            /* Row 15 */
        display("\33[15;24H\33[m\33[15;48H\33[m\33[15;72H\33[m");
        display("\33[15;9H\33[8mddddddddddddn");
        display("\33[15;33H\33[8mddddddddddddn");
        display("\33[15;57H\33[8mddddddddddddn");

}
/*

        cal_jams()


        This routine is called form the confgjams display.
        this routine uses the values of fst jam and lst jam
        and calculates the jams in between.

*/
cal_jams()
{
IMPORT  JAM_TMPLT  jam_table[];
IMPORT  UCOUNT be_to_rg, le_to_rg;
IMPORT  JAM_TMPLT  jam_table[];
IMPORT  UCOUNT  chg_table[];

JAM_TMPLT  *p_jam;

LONG    difspace;       /* differance in spaces between fst_jam and lst_jam */
LONG    difangle;       /* differance in angles between fst_jam and lst_jam */
LONG    deg_jam;        /* number of degrees of encoder rotation between jams. */
LONG    totaldeg;       /* number of degrees between jam 1 and jam j. */
LONG    numspace;       /* number of spaces between jam 1 and jam j. */
LONG    jamangle;       /* angle that jam j should be service at. */
COUNT   j;
COUNT   temp_offset;
IMPORT  MSG_TBL bad_entry;      /* Invalid first to last entry. */

if( fst_jam >= lst_jam )
        {
        utimemsg( 400, 6, &bad_entry, NULL );
        }
else
        {
        temp_offset = be_to_rg + le_to_rg;
        difspace = jam_table[lst_jam].num_pins - jam_table[fst_jam].num_pins;
        difangle = jam_table[lst_jam].even_angle - jam_table[fst_jam].even_angle;
        deg_jam = ((difspace * 360) - difangle) / ( lst_jam - fst_jam );

        for( j = lst_jam - 1; j > fst_jam ; j-- )
                {
 totaldeg = ((lst_jam - j ) * deg_jam) + jam_table[lst_jam].even_angle;
 numspace = totaldeg / 360;
 jamangle = totaldeg % 360;
 p_jam = &jam_table[j];
 p_jam->jam_number = j;
 p_jam->num_pins = jam_table[lst_jam].num_pins - numspace;
 p_jam->init_1up_offset = p_jam->init_2up_offset =
        (p_jam->num_pins + temp_offset) * 2;
 p_jam->even_angle = jamangle;
 p_jam->odd_angle = (jamangle + 180) % 360;
 p_jam->num_faults = 1;
 p_jam->pamux_jam = (j - 1) % 2;                /* jam # for each pamux  (0 or 1)*/
 p_jam->chg_address = (ULONG)&chg_table[(j - 1)/2 + 1];  /* change table address for this jams */
 p_jam->even_offset = 2;                        /* two_up even (black) offset */
 p_jam->odd_offset = 1;                         /* two_up odd (white) offset */
}
        }
return;
}
```

Having described specific preferred embodiments of the invention, the following is claimed:

1. An apparatus for controlling a collator having a plurality of hoppers that feed signatures to feed locations on a conveyor to form assemblages, each of the hoppers including a rotatable drum for transporting signatures from an associated first. location to feed locations on the conveyor, said apparatus comprising:

drive means operatively connected to the hoppers and to the conveyor for driving the hopper drum of each hopper in rotation and for moving the conveyor;

coded signal generating means for generating a plurality of coded electrical signals during operation of said drive means, each coded signal being indicative of a finite distance the conveyor is moved by said drive means, a machine cycle being an amount of conveyor movement necessary to displace a feed location on the conveyor downstream one complete feed location distance, said coded signal generating means being reset once each machine cycle;

first sensing means for sensing an improper signature feed from a hopper and for generating an electrical signal indicative thereof;

means, located downstream of the hoppers, for rejecting a signature assemblage in response to a reject signal;

second sensing means, located a predetermined distance from said reject means, for generating an electrical signal indicative of a signature being present at the location of said second sensing means;

means for feeding a single signature from one of the hoppers to a feed location on the conveyor;

counting means for counting the number of complete machine cycles that occur when the drive means moves the feed location containing the single feed signature from its initial location where it first received the signature to the location of the second sensing means;

means, responsive to the counting means, for determining the distance, in machine cycle counts, between the initial location of the feed location where it first received the single signature fed from the feeding hopper and the location of said rejecting means;

storing means, responsive to the determining means, for storing the determined distance for each of the hoppers; and control means for, upon the occurrence of a signal from the first sensing means indicative of an improper signature feed from a hopper, recalling from said storing means the stored distance the hopper having the sensed improper signature feed is from the rejecting means, counting the number of present machine cycles that occur after the improper signature feed was sensed by the first sensing means, and generating the reject signal to the rejecting means when the present machine cycle count is equal to the recalled distance.

2. The apparatus of claim 1 wherein said first sensing means generates an electrical signal when no signature is fed from the hopper when a feed should occur.

3. The apparatus of claim 1 wherein said first sensing means generates an electrical signal when more than one signature is simultaneously fed from a hopper.

4. The apparatus of claim 1 wherein said first sensing means generates a first electrical signal when no signature is fed from a hopper when a signature feed should occur and a second electrical signal when more than one signature is simultaneously fed from a hopper.

5. The apparatus of claim 1 wherein the second sensing means is located upstream of the reject means.

6. An apparatus for controlling a collator having a plurality of hoppers that feed signatures to feed locations on a conveyor to form assemblages, each of the hoppers including a rotatable drum for transporting signatures from an associated first location to feed locations on the conveyor, said apparatus comprising:

drive means operatively connected to the hoppers and to the conveyor for driving the hopper drum of each hopper in rotation and for moving the conveyor;

coded signal generating means for generating a plurality of coded electrical signals during operation of said drive means, each coded signal being indicative of a finite distance the conveyor is moved by said drive means, a machine cycle being an amount of conveyor movement necessary to displace a feed location on the conveyor downstream one complete feed location distance, said coded signal generating means being reset once each machine cycle;

a plurality of drum angle sensing means, each hopper having an associated drum angle sensing means, for generating an electrical signal when its associated drum is at a predetermined rotational angle;

a plurality of first storing means, each hopper having an associated first storing means, for, when its associated hopper is in an initially phased condition, storing the signal from the coded signal generating means when its associated drum angle sensing means generates the electrical signal indicative of its drum being at its predetermined rotational angle;

signature feed sensing means for sensing an improper signature feed from a hopper and for generating an electrical signal indicative thereof;

means, located downstream of the hoppers, for rejecting a signature assemblage in response to a reject signal;

means for determining for each of the hoppers the distance, in machine cycle counts, between an associated feed location which first receives a signature from such hopper when such hopper is in its initially phased condition and the location of said rejecting means;

second storing means responsive to the determining means for storing the determined distance for each of the hoppers;

means for subsequently monitoring the coded signal generated by the coded signal generating means for each hopper when its associated drum is at its predetermined rotational angle;

means for comparing the coded signal for each hopper stored in the first storing means with the subsequently monitored coded signal for such hopper; and control means for, upon the occurrence of a signal from the signature feed sensing means indicative of an improper signature feed from a hopper, recalling from said second storing means the stored distance that such hopper having the improper signature feed is from the rejecting means, correcting the recalled distance if the subsequently monitored coded signal varies from the coded signal stored in its asociated first storing means by greater than a predetermined amount, counting the number of machine cycles that occur after the improper signature feed is sensed, and generating the reject signal when (i) the counted number of machine cycles is equal to the recalled distance if no correction was made and (ii) the counted number of machine cycles is equal to the corrected distance if a correction was made.

7. The apparatus of claim 6 wherein said monitoring means includes a plurality of optical sensors, each drum having an associated optical sensor mounted adjacent to its drum, and a plurality of light reflectors, each drum having a light reflector mounted thereto in a location that is not covered by a signature during the transporting of such signature to a feed location.

8. The apparatus of claim 6 wherein a machine cycle is equal to 360° and each coded electrical signal from the coded signal generating means is equal to a portion of the 360° division, said control means correcting the recalled distance when a monitored coded signal varies from the coded signal stored in its associated first storing means through 360°.

9. The apparatus of claim 6 wherein said determining means includes:

third sensing means, located a predetermined distance from said reject means, for generating an electrical signal indicative of a signature being present at the location of said third sensing means;

means for feeding a single signature from one of the hoppers to a feed location on the conveyor; and counting means for counting the number of complete machine cycles needed to move the feed location containing the single feed signature to the location of the third sensing means.

10. An apparatus for controlling a collator having a plurality of hoppers that feed signatures to feed locations on a conveyor to form assemblages, the conveyor including a plurality of spaced apart pins, spaced in a direction of raceway travel, the space between the pins defining the signature feed locations, said apparatus comprising:

drive means operatively connected to the hoppers and to the conveyor for driving the hoppers and moving the conveyor;

coded signal generating means for generating a plurality of coded electrical signals during operation of said drive means, each coded signal being indicative of a finite distance the conveyor is moved by the drive means, a machine cycle being an amount of conveyor movement necessary to displace a feed location on the conveyor downstream one complete feed location distance, said coded signal generating means being reset once each machine cycle;

means, located downstream of the hoppers, for rejecting a signature assemblage in response to a reject signal;

sensing means, located a predetermined distance from said reject means, for generating an electrical signal indicative of a signature being present at the location of the sensing means;

a plurality of jam detection switches, each of the jam switches being located between hoppers and adapted to detect a fed signature overlying a pin and to generate an electrical signal indicative thereof;

means for aligning a pin under each of the jam switches separately, means for placing a signature downstream of an aligned pin, means for tripping the jam switch, means for moving the conveyor toward the reject means, means for counting the number of machine cycles that occur when the signature is moved to the sensing means, and means for determining the distance between the jam switch location and the reject gate.

11. A method for controlling a collator having a plurality of hoppers that feed signatures to feed location on a conveyor to form assemblages, each of the hoppers including a rotatable drum for transporting signatures from an associated first location to feed locations on the conveyor, said method comprising the steps of:

(a) driving the hopper drum of each hopper in rotation;

(b) moving the conveyor;

(c) generating a plurality of coded signals during driving of said hopper drum, each coded signal being indicative of a finite distance the conveyor is moved by said drive means, a machine cycle being an amount of conveyor movement necessary to displace a feed location on the conveyor downstream one complete feed location distance;

(d) resetting the generated coded electrical signal once each machine cycle;

(e) sensing an improper signature feed from a hopper and generating an electrical signal indicative thereof;

(f) rejecting a signature assemblage in response to a reject signal at a rejecting location on the conveyor;

(g) generating an electrical signal indicative of a signature being present at a sensing location a predetermined distance from the rejecting location;

(h) feeding a single signature from one of the hoppers to a feed location on the conveyor;

(i) counting the number of complete machine cycles needed to move the feed location receiving the single fed signature to the sensing location;

(j) determining the distance, in machine cycle counts, between the feed location in which the single signature was fed from the feeding hopper and the location where the signatures are rejected;

(k) storing the determined distance, machine cycle counts, for each of the hoppers; and (l) upon the occurrence of a signal indicative of an improper signature fed from a hopper, recalling the stored distance for the hopper having the improper signature feed, counting the number of machine cycles that occur after the improper signature feed was sensed, and generating the reject signal when present machine cycle count is equal to the recalled distance in machine cycle counts.

12. The method of claim 11 wherein the step of generating an electrical signal indicative of a signature being present at a sensing location includes the step of locating a signature sensor a predetermined distance upstream of the rejecting location.

13. A method for controlling a collator having a plurality of hoppers that feed signatures to feed locations on a conveyor to form assemblages, each of the hoppers including a rotatable drum for transporting signatures from an associated first location to feed locations on the conveyor, said method comprising the steps of:

(a) driving the hopper drum of each hopper in rotation;

(b) moving the conveyor;

(c) generating a pluality of coded electrical signals during said driving, each coded signal being indicative of a finite distance the conveyor is moved, a machine cycle being an amount of conveyor movement necessary to displace a feed location on the conveyor downstream one complete feed location distance;

(d) resetting said coded signal once each machine cycle;

(e) generating an electrical signal for each hopper when its associated drum is at predetermined rotational angle;

(f) storing in a first storing means the electrical signal which is generated indicative of its associated drum being at its predetermined rotational angle when its associated hopper is in an initially phased condition;

(g) sensing an improper signature feed from a hopper and generating an electrical signal indicative thereof;

(h) rejecting a signature assemblage at a reject location in response to a reject signal;

(i) determining for each hopper the distance, in machine cycle counts, between the associated feed location where a signature is fed from the associated feeding hopper when such hopper is in its initially phased condition and the reject location;

(j) storing in a second storing means the determined distance, in machine cycle counts, for each of the hoppers;

(k) subsequently monitoring the coded electrical signal for each hopper when such hopper drum is at its predetermined rotational angle;

(l) comparing the coded electrical signal for each hopper stored in the first storing means with the coded electrical signal for such hopper subsequently monitored; and (m) upon the occurrence of a signal indicative of an improper signature feed from a hopper, recalling the stored distance in machine cycle counts for the hopper having the improper signature feed is from the reject location, correcting the recalled distance if the subsequently monitored coded electrical signal varies from the stored coded signal for such hoppers by greater than a predetermined amount, counting the number of machine cycles that occur after the improper signature feed is sensed, and generating the reject signal when (i) the counted number of machine cycles is equal to the recalled distance in machine cycle counts if no correction was made and (ii) the counted number of machine cycles is equal to the corrected distance if a correction was made.

14. The method of claim 13 wherein the step of determining includes the steps of generating an electrical signal indicative of a signature being present at a first predetermined location spaced a predetermined distance from the reject location, feeding a single signature from one of the hoppers to a feed location on the conveyor, and counting the number of complete machine cycles needed to move the feed location containing the single feed signature to the first predetermined location.

15. A method for controlling a collator having a plurality of hoppers that feed signatures to feed locations on a conveyor to form assemblages, the conveyor including a plurality of spaced apart pins, spaced in a direction of raceway travel, the space between the pins defining the signature feed locations, said method comprising the steps of:

(a) driving the hoppers;

(b) moving the conveyor;

(c) generating a plurality of coded electrical signals during operation of said drive means, each coded signal being indicative of a finite distance the conveyor is moved by the drive means, a machine cycle being an amount of conveyor movement necessary to displace a feed location on the conveyor downstream one complete feed location distance, said coded signal generating means being reset once each machine cycle;

(d) rejecting a signature assemblage in response to a reject signal at a location downstream of the hoppers;

(e) generating an electrical signal indicative of a signature being present at the location of the second sensing means;

(f) providing a plurality of jam detection switches, each of the jam switches being located between hoppers and adapted to detect a fed signature overlying a pin and to generate an electrical signal indicative thereof;

(g) aligning a pin under each of the jam switches separately;

(h) placing a signature downstream of an aligned pin;

(i) tripping the jam switch;

(j) moving the conveyor toward the reject means;

(k) counting the number of machine cycles that occur when the signature is moved to the second sensing means; and (l) determining the distance between the jam switch location and the rejecting location.

* * * * *